US007982122B2

(12) United States Patent
Gatzsche et al.

(10) Patent No.: US 7,982,122 B2
(45) Date of Patent: Jul. 19, 2011

(54) DEVICE AND METHOD FOR ANALYZING AN AUDIO DATUM

(75) Inventors: Gabriel Gatzsche, Martinroda (DE); David Gatzsche, Weimar (DE); Michael Beckinger, Erfurt (DE); Frank Melchior, Ilmenau (DE)

(73) Assignee: Fraunhofer-Gesellschaft zur Foerderung der angewandten Forschung e.v., Munich (DE)

( * ) Notice: Subject to any disclaimer, the term of this patent is extended or adjusted under 35 U.S.C. 154(b) by 168 days.

(21) Appl. No.: 12/278,177

(22) PCT Filed: Jan. 23, 2007

(86) PCT No.: PCT/EP2007/000560

§ 371 (c)(1),
(2), (4) Date: Sep. 12, 2008

(87) PCT Pub. No.: WO2007/096035

PCT Pub. Date: Aug. 30, 2007

(65) Prior Publication Data

US 2009/0173216 A1 Jul. 9, 2009

(30) Foreign Application Priority Data

Feb. 22, 2006 (DE) ..... 10 2006 008 260

(51) Int. Cl.
*G10H 1/38* (2006.01)

(52) U.S. Cl. ..... 84/613

(58) Field of Classification Search ..... 84/613, 84/477 R

See application file for complete search history.

(56) References Cited

U.S. PATENT DOCUMENTS

| | | | |
|---|---|---|---|
| 4,121,488 | A | 10/1978 | Akiyama |
| 4,450,743 | A | 5/1984 | Tanimoto |
| 4,452,119 | A | 6/1984 | Tanimoto |
| 5,099,738 | A | 3/1992 | Hotz |
| 5,393,926 | A | 2/1995 | Johnson |
| 5,415,071 | A | 5/1995 | Davies |
| 5,491,297 | A | 2/1996 | Johnson et al. |
| 5,502,274 | A | 3/1996 | Hotz |
| 5,619,003 | A | 4/1997 | Hotz |
| 5,665,927 | A | 9/1997 | Taki et al. |
| 5,670,729 | A | 9/1997 | Miller et al. |

(Continued)

FOREIGN PATENT DOCUMENTS

DE 80 05 260 U1 8/1980

(Continued)

OTHER PUBLICATIONS

Official communication issued in counterpart International Application No. PCT/EP2007/001509, mailed on May 11, 2007.

(Continued)

*Primary Examiner* — Jianchun Qin
(74) *Attorney, Agent, or Firm* — Keating & Bennett, LLP

(57) ABSTRACT

A device and a method for analyzing an audio datum is described, having a semitone analyzer which is implemented to analyze the audio datum with regard to a volume information distribution over an amount of semitones, and a vector calculator which is implemented to calculate a sum vector over two-dimensional intermediate vectors for each semitone or each element of the definition amount and output an analysis signal based on the sum vector, based on the volume information distribution or a distribution derived from the volume information distribution, which includes a definition amount based on the amount of semitones.

13 Claims, 16 Drawing Sheets

U.S. PATENT DOCUMENTS

| | | | | |
|---|---|---|---|---|
| 5,709,552 | A | 1/1998 | LeGrange | |
| 5,723,802 | A | 3/1998 | Johnson et al. | |
| 5,777,248 | A | 7/1998 | Campbell | |
| 7,356,465 | B2 * | 4/2008 | Tsingos et al. | 704/220 |
| 2001/0052283 | A1 | 12/2001 | Boyer | |
| 2002/0178896 | A1 | 12/2002 | George | |
| 2003/0209130 | A1 | 11/2003 | Anderson et al. | |
| 2004/0255759 | A1 | 12/2004 | Gayama | |
| 2005/0114121 | A1 | 5/2005 | Tsingos et al. | |
| 2006/0027080 | A1 | 2/2006 | Schultz | |

FOREIGN PATENT DOCUMENTS

| | | | |
|---|---|---|---|
| DE | 37 44 255 | A1 | 7/1989 |
| DE | 89 02 959.3 | U1 | 8/1989 |
| DE | 40 02 361 | A1 | 8/1991 |
| DE | 42 16 349 | A1 | 11/1993 |
| DE | 295 12 911 | U1 | 11/1995 |
| DE | 298 01 154 | U1 | 6/1998 |
| DE | 198 59 303 | A1 | 7/1999 |
| DE | 198 31 409 | A1 | 1/2000 |
| DE | 100 42 300 | A1 | 3/2002 |
| DE | 203 01 012 | U1 | 4/2003 |
| DE | 103 51 817 | A1 | 5/2005 |
| DE | 20 2005 009 551 | U1 | 3/2006 |
| EP | 1 533 786 | A1 | 5/2005 |
| GB | 2 312 085 | A | 10/1997 |
| GB | 2 324 642 | A | 10/1998 |
| JP | 11-126063 | A | 5/1999 |
| JP | 2004-286917 | A | 10/2004 |
| WO | 86/06193 | A1 | 10/1986 |
| WO | 90/07771 | A1 | 7/1990 |
| WO | 90/09650 | A1 | 8/1990 |
| WO | 96/36034 | A1 | 11/1996 |
| WO | 2005/122133 | A1 | 12/2005 |
| WO | 2006/005567 | A1 | 1/2006 |

OTHER PUBLICATIONS

Dorrell: "Vector Analysis of Musical Intervals," What is Music; Chapter 5; XP-002430508; 2004; http://web.archive.org/web/20051124063808/http://whatismusic.info/download.html>;pp. 87-106.

Gatzsche: "Visualization of Musical Parameters in Music Theory," Dissertation: Liszt School of Music Weimar; 2004; pp. 1-19.

Riemann: "Ideas for a Study on the Imagination of Tone,"Journal of Music Theory; vol. 36, No. 1; Spring 1992; pp. 81-117.

Shepard: "Geometrical Approximations to the Structure of Musical Pitch," Psychological Review; vol. 89, No. 4; Jul. 1982; pp. 305-333.

Gatzsche et al.: "Device and Method for Generating a Note Signal and Device and Method for Outputting an Output Signal Indicating a Pitch Class,"; U.S. Appl. No. 12/096,934, filed Jun. 11, 2008.

Official Communication issued in International Patent Application No. PCT/EP2007/000560, mailed on May 11, 2007.

Izmirli: "An Algorithm for Audio Key Finding," Mirex 2005 Contest Results; XP-002426658; http://www.music-ir.org/evaluation/mirex-results/articles/key_audio/izmirli.pdf; 2005, 3 pages.

Gomez et al.: "Tonality Visualization of Polyphonic Audio," ICMC 2005 Proceedings; XP-00246659; http://www.iua.upf.es/~gomez/TonalDescription/GomezBonada-ICMC2005.pdf; Sep. 5, 2005, 4 pages.

Chuan et al.: "Polyphonic Audio Key Finding Using the Spiral Array CEG Algorithm," Multimedia and Expo, 2005; XP010843224; Jul. 6, 2005; pp. 21-24.

Bello et al.: "A Robust Mid-Level Representation for Harmonic Content in Music Signals," ISMIR 2005; XP-002426660; Sep. 2005, pp. 304-311.

Purwins et al.: "Correspondence Analysis for Visualizing Interplay of Pitch Class, Key, and Composer," Perspectives in Mathematical Music Theory; XP-002426661; 2003, pp. 1-23.

Official Communication issued in corresponding Korean Patent Application No. Oct. 2008-7020716, mailed on Dec. 22, 2010.

* cited by examiner

DEVICE AND METHOD FOR ANALYZING AN AUDIO DATUM

BACKGROUND OF THE INVENTION

The present invention relates to a device and a method for analyzing an audio datum, in particular to a device which may be used, for example, in connection with a display device, an accompaniment device or another evaluation device, for example to enable a faster and simpler determination of a key of the key change, a chord or a chord change.

When making music, but also when otherwise dealing with a piece of music or an existing sequence of chords, an analysis of the existing or sounding piece of music is required in many situations, for example to enable improvising on the existing piece of music, i.e. creatively generating harmonically and consonantly sounding melodies, or accompanying the existing piece of music, i.e. creating a sequence of chords and/or a sequence of single tones which go with the melody and tend to underline the same.

This frequently requires of a person a minimum measure of experience in dealing with music, which may frequently only be learned by several years of working with music and/or a musical instrument. In addition to that, a corresponding analysis frequently requires of a person a certain musical talent, which may request partially even absolute hearing in the case of very complex pieces of music. This, however, excludes many people who lack the required background knowledge of music theory, sufficient experience in dealing with music and/or a musical instrument, or the corresponding talent.

In literature, many teaching aids and means for learning and/or finding chords, harmonies and keys are known. These are often templates, discs or other objects, in particular mechanically connected, shiftable or rotatable templates on which connections regarding music theory are illustrated. Such learning aids and means are, for example, described in the following documents DE 8005260 U1, DE 8902959 U1, DE 3744255 A1, U.S. Pat. No. 5,709,552, DE 3690188 T1, US 2002/0178896 A1, DE 4002361 A1, DE 19831409 A1, DE 19859303 A1, DE 29801154 U1 and DE 20301012 U1. In general, on one of the discs or the corresponding objects a sequence of pitches is applied which in general either corresponds to the chromatic scale consisting of a sequence of twelve semitones and thus all available pitches of an equal temperament, or to the circle of fifths, wherein a pitch interval of two adjacent pitches is a fifth (for example C-G or F-C). DE 8005260 shows a device for finding chords, harmonies and keys with an arrangement in an interval of a third.

The utility model DE 29512911 U1 describes a teaching and learning aid for a synthesis and analysis of connections regarding music theory with several different templates and at least twelve gaming pieces provided with designations of pitches.

The European patent EP 0452347 B1 refers to a universal operating unit for an electronic musical instrument comprising a number of note selectors, each of which provides a note selection signal when a note is selected and a note deselection signal with a deminishment of a note, note turn-on devices coupled to the number of note selectors for providing note-designating information associated with each note selector and for providing a note turn-on signal triggered by the note selection signal which includes the corresponding note-designating information, a memory means for storing the note-designating information provided as triggered by the note selection signal, means coupled to the note turn-on device for changing the note-designating information and note turn-off devices coupled to the number of note selectors and to the memory means for providing a note turn-off signal triggered by the note deselection signal which includes the note-designating information stored when providing the note selection signal.

The patent DE 4216349 C2 describes an electronic musical instrument having a melody and an accompaniment keyboard. The musical instrument described has a melody keyboard whose melody keys include switches including two switching stages, wherein those pitches corresponding to the white keys are associated with the first switching stages and those pitches corresponding to the black keys of a keyboard are associated with the second switching stages, and an accompaniment keyboard comprising accompaniment keys which, when operated, may call an automatic chord accompaniment, wherein the accompaniment keys are respectively implemented as switches having at least two switching stages which have different associated accompaniment chords. An operation of the described electronic musical instrument does not request the knowledge of musical notation, but requires, due to the described modeling according to a fingerboard, an operator who is educated in music theory, as in particular certain combinations of individual pitches and chords, which are needed in particular for pedagogical purposes, are obvious. In particular, the document describes a musical instrument with a one-finger accompaniment system, which a user may operate manually to generate an accompaniment chord.

The patent DE 2857808 C3 describes an electronic musical instrument combined with an electronic clock. The invention relates to an electronic musical instrument, wherein via input and storage means any pitch sequences and pieces of music may be input and retrieved again. The described electronic musical instrument thus enables only an input with a subsequent storage of a pitch sequence and a reproduction of the stored pitch sequence via a pitch generator circuit to reproduce the stored sequence of pitches in the form of a sequential acoustic presentation. It is in particular disadvantageous with regard to the musical instrument described, that the input and/or the "programming" of the pitch sequence takes place via a 10-key pad, extended by several additional keys. In particular, the electronic musical instrument described also requires a certain minimum of theoretical musical knowledge, as otherwise a programming of the musical instrument will hardly be realizable.

The European patent EP 0834167 B1 refers to a virtual musical instrument with a new input device. In particular, the above-mentioned patent application refers to a virtual musical instrument having a portable accessory of a type which is to be brought in contact with a musical instrument in order to play this instrument, wherein the mentioned portable accessory comprises a switch which generates an activation signal as a reaction to a person holding the mentioned portable accessory causing the mentioned portable accessory to hit another object. The mentioned activation signal is received by a digital processor, which in turn generates a control signal which causes a synthesizer to generate a note which is represented by a selected note data structure. In particular, the patent application describes a virtual musical instrument, wherein the mentioned portable accessory is a guitar plectrum and wherein a user may only make pitches from within a predetermined amount of pitches sound via the synthesizer.

The European patent EP 0632427 B1 relates to a method and a device for inputting musical data. More specifically, the mentioned patent relates to a musical data input device including an input recording means for recording a hand-written input on it, a position detection means for detecting a position on the input recording means where the hand-written input is performed to obtain pitch data representative of a pitch of a musical note, an input detection means for detecting the hand-written input performed on the input recording means, wherein the input detection means comprises a means for detecting the number of pushing events performed on the input recording means or for detecting a time period in which the input recording means is pushed, or for detecting the intensity of pressure which is exerted on the input recording means during the hand-written input, or comprises a number detection means to detect a number written onto the input recording means, or a line detection means to detect the length of a line which is drawn onto the input recording means, a time designation means for designating time data representative of the length of a musical pitch, on the basis of the detected number of pushing events or the detected time period or the detected intensity of pushing events or the detected number or the detected length of a line detected by the input detection device, and a musical pitch generation means for detecting musical pitch data on the basis of pitch level data obtained from the position detection means and the time data obtained from the time designation means. In particular, the mentioned patent application describes a musical data input device having an LCD unit (LCD=liquid crystal display) and a touch pad arranged on the same, via which, with the help of a pen, pitches may be inserted into a pitch system. The described musical data input device thus relates to people having a sufficiently high knowledge of connections regarding music theory.

The patent application U.S. Pat. No. 5,415,071 relates to a method and a device for generating relationships between musical pitches. Here, an arrangement of offset lines or rows of symbols is described, wherein each symbol represents a musical note. Each line includes a repeating series of twelve symbols which forms a musical series of semitones which is also known as the chromatic scale. Here, each line is offset with regard to the adjacent lines so that groups of symbols which represent the same musical relationship, i.e., for example, intervals, scales, chords, etc., form the same visually recognizable configurations, like, for example, diagonal configurations or vertical configurations at certain locations in the arrangement. In one embodiment, such a device which includes such an arrangement may be used as a learning aid, wherein the learning aid comprises two overlapping components which may be shifted against one another. Apart from that, the patent application describes an arrangement of the contact area of a keyboard and/or a claviature of a musical instrument with a claviature or a fingerboard of a musical string instrument which are arranged in accordance with the arrangement. The patent application thus describes a claviature having keys arranged in the form of concentric circles.

SUMMARY

According to an embodiment, a device for analyzing an audio datum may have a semitone analyzer, which is implemented to analyze the audio datum with regard to a volume information distribution over an amount of semitones; and a vector calculator, which is implemented to calculate a sum vector over two-dimensional intermediate vectors for each semitone or each element of the definition amount and to output an analysis signal based on the sum vector, based on the volume information distribution or a distribution derived from the volume information distribution, which comprises a definition amount based on the amount of semitones.

According to another embodiment, an accompaniment system, may have a device for analyzing an audio datum, having a semitone analyzer, which is implemented to analyze the audio datum with regard to a volume information distribution over an amount of semitones; and a vector calculator, which is implemented to calculate a sum vector over two-dimensional intermediate vectors for each semitone or each element of the definition amount and to output an analysis signal based on the sum vector, based on the volume information distribution or a distribution derived from the volume information distribution, which comprises a definition amount based on the amount of semitones; and an accompaniment device, which is coupled to the device and implemented to receive the analysis signal and provide a note signal based on the analysis signal.

According to another embodiment, a measurement system may have a device for analyzing an audio datum which may have a semitone analyzer, which is implemented to analyze the audio datum with regard to a volume information distribution over an amount of semitones; and a vector calculator, which is implemented to calculate a sum vector over two-dimensional intermediate vectors for each semitone or each element of the definition amount and to output an analysis signal based on the sum vector, based on the volume information distribution or a distribution derived from the volume information distribution, which comprises a definition amount based on the amount of semitones; and a display device which is coupled to the device to receive the analysis signal and implemented to provide an output signal indicating an angle of the sum vector based on the output signal.

According to another embodiment, a detection system may have an integrator, which is implemented to integrate a time-dependent audio input signal regarding time and provide the same as an audio datum; a device for analyzing an audio datum, which may have a semitone analyzer, which is implemented to analyze the audio datum with regard to a volume information distribution over an amount of semitones; and a vector calculator, which is implemented to calculate a sum vector over two-dimensional intermediate vectors for each semitone or each element of the definition amount and to output an analysis signal based on the sum vector, based on the volume information distribution or a distribution derived from the volume information distribution, which comprises a definition amount based on the amount of semitones, which is coupled to the integrator and provides the analysis signal; and an evaluation device, which is coupled to the device and is implemented to analyze a time course of a length of the sum vector based on the analysis signal and, when the time course of the length of the sum vector comprises a maximum or a minimum, output a detection signal.

According to another embodiment, a key determination system may have a device as mentioned above; and a key determinator, which is coupled to the device and is implemented to generate a key signal indicating a key based on the analysis signal of the device and provide the same at an output.

According to another embodiment, a method for analyzing an audio datum may have the steps of analyzing the audio datum with regard to a volume information distribution over an amount of semitones; calculating a two-dimensional intermediate vector based on the volume information distribution or a distribution derived from the volume information distribution, which comprises a definition amount based on the amount of semitones, for each semitone or each element of the definition amount; calculating a sum vector based on the two-dimensional intermediate vectors; and outputting an analysis signal which is based on the sum vector.

According to another embodiment, a computer program may have a program code for performing the method for analyzing an audio datum, which may have the steps of analyzing the audio datum with regard to a volume information distribution over an amount of semitones; calculating a two-dimensional intermediate vector based on the volume information distribution or a distribution derived from the volume information distribution, which comprises a definition amount based on the amount of semitones, for each semitone or each element of the definition amount; calculating a sum vector based on the two-dimensional intermediate vectors; and outputting an analysis signal which is based on the sum vector, when the computer program runs on a computer.

The inventive device for analyzing an audio datum includes a semitone analysis means which is implemented to analyze the audio datum with regard to a volume information distribution over an amount of semitones, and a vector calculation means which is implemented, based on the volume information distribution or a distribution derived from the volume information distribution, which comprises a definition amount based on the amount of semitones, to calculate for each semitone or each element of the definition amount a sum vector over two-dimensional intermediate vectors for each semitone or each element and to output an analysis signal based on the sum vector.

The present invention is based on the finding that a faster and more efficient analysis of an audio datum, for example with regard to a determination of a key, a change of key, a chord, a change of chord and other connections regarding music theory, is enabled by the fact that the audio datum is analyzed over an amount of semitones with regard to a volume information distribution, and based on the volume information distribution or a distribution derived from the volume information distribution a sum vector is calculated and output as the analysis signal. By the calculation of the sum vector, i.e. a mapping of the volume information distribution to the two-dimensional sum vector, substantial information about a piece of music, perceived to be harmonic and/or consonant by many people, which is present in the form of the audio datum, are gained. Regarding this, it is especially advantageous that, by the calculation of the two-dimensional sum vector, also from a very complex audio datum, significant and thus relevant information may be extracted from the audio datum, and that thus the same may be analyzed. The inventive device for analyzing an audio datum is thus able to extract substantial information from the audio datum and make the same available in the form of the analysis signal.

It is a substantial advantage that the inventive device for analyzing an audio datum requires a suitable implementation which may perform the analysis in "real time" on the basis of a current value of the audio datum. Limitations to the possibility of an instantaneous and/or direct calculation of the sum vector are basically presented by the semitone analysis means which requires a certain time for the analysis of the volume information distribution due to the physical characteristics of sound waves, when the audio datum includes analog or digital audio signals. If, however, the audio datum includes note sequence signals, i.e., for example, analog or digital control signals for a sound generator (e.g. midi signals), then the semitone analysis means may perform a corresponding analysis quasi instantaneously.

It is a further advantage, that the vector calculation means may be implemented to perform the calculation of the two-dimensional intermediate vectors by a weighting of the unit vectors, which are associated with the respective semitones and/or the respective elements of the definition amount, with the volume information distribution or the distribution derived from the same. By this, the calculation may be significantly accelerated. In addition to that, as a further advantage, the semitone analysis means may analyze the audio datum with regard to the volume information distribution under consideration of a frequency-dependent weighting function, so that a difference of the perception of consonance and/or harmony regarding the frequency, in particular regarding an octave position, is considered. By this, it is possible to consider hearing specific characteristics, for example to consider that a C major chord is perceived to be differently pleasant in different octavings and/or octave positions.

It is a further advantage that the calculation may be further accelerated by the inventive device for analyzing an audio datum further comprising a pitch class analysis means which forms a pitch class volume information distribution based on the volume information distribution and simultaneously maps the amount of semitones to an amount of pitch classes as the definition amount of the pitch class volume information distribution. Here, a pitch class is referred to as the indication of a pitch neglecting the octave to which this pitch (tone) belongs. In other words, a pitch may be identified by the fact that its pitch class (e.g. C) and the associated octaving and/or octave position are determined. Thus, for example, the pitches C, C', C", C'" comprise the pitch class C.

It is a special advantage of the present invention that the vector calculation means may be implemented such that the unit vectors, which are associated with the pitch classes, the semitones or the elements of the definition amount, comprise an angle value regarding a preferential direction, so that the two-dimensional sum vector may be used within the context of an arrangement of pitch classes referred to as "circle of thirds" or an arrangement referred to as "symmetry model", to represent connections regarding music theory in an especially efficient and simple way.

It is a further advantage of the present invention, that the semitone analysis means may analyze the audio datum with regard to a plurality of different volume information distributions. Thus, the volume information distribution may comprise information regarding an amplitude, an intensity, a volume, a hearing-adapted volume or other volume information. By this, depending on the application-specific circumstances, the inventive device for analyzing an audio datum may analyze the same regarding different pieces of volume information adapted to the application and thus enable an especially efficient analysis.

It is a further advantage, that the inventive device may also output an analysis signal which comprises a time course in case the audio datum comprises a time course. By this, for example, an analysis of a piece of music in real time is possible, so that the analysis signal may provide information regarding data regarding music theory of the piece of music to a person during the course of a piece of music for controlling further devices and/or after displaying the same on a display device.

Here, the audio datum may be provided to the inventive device in different forms. Thus, it is possible to provide the audio datum in the form of a microphone signal, a line signal, an analog audio signal, a digital audio signal, a midi signal, a note signal, a note sequence signal of an analog control signal for controlling a sound generator or a digital control signal for controlling a sound generator, so that the inventive device for analyzing an audio datum may be used within the scope of many applications, which represents a further substantial advantage.

As the embodiments will show, thus the inventive device may, for example, be used in an accompaniment system, which apart from the inventive device includes an accompaniment device, which is coupled to the inventive device for analyzing an audio datum and implemented such that the accompaniment device may receive the analysis signal and provide a corresponding note signal based on the analysis signal. Thus, for example, the accompaniment device of an accompaniment system may be implemented such that, based on the analysis signal, the same determines a chord and/or a diatonic scale and provides corresponding note signals based on the determined chord and/or the determined diatonic scale and/or both. The inventive device may thus be integrated into an accompaniment system which enables a very flexible, automatic and efficient provision of a note signal for the accompaniment of the piece of music underlying the audio datum. It is thus a substantial advantage of the present invention that the inventive device may be integrated into an accompaniment system which comprises the above-mentioned characteristics.

It is a further advantage of the present invention, that the inventive device may be integrated into a measurement system which further comprises a display device, which is coupled to the inventive device to receive the analysis signal and which is implemented, based on an angle of the sum vector, to provide an output signal indicating the same. If the output device, for example, has an output field having an output field center and an output field preferential direction, then the display device may accentuate an output field radial direction based on the angle of the sum vector on the output field. From this, the advantage results, that the analysis signal representing the sum vector may be geometrically represented on the output field and that, by this, the analysis signal may be presented to a person in an especially understandable way.

This advantage is in particular increased when the output field and the device for analyzing an audio datum use a geometric arrangement of pitch classes, as they occur in the above-mentioned circle of thirds or symmetry model. By this, the meaning of the analysis signal regarding music theory may be presented to a user of the measurement system in an even more efficient way.

In addition to that, it is possible not only to represent the angle of the sum vector on the display device but also a length of the same which, for example, indicates an estimate for the tonal context and/or the definedness of the key or the consonance and/or dissonance or the present chord, which represents a substantial advantage.

In addition to that, the inventive device may also be used in a detection system which, apart from the inventive device for analyzing an audio datum, further comprises an integrator device and an evaluation device, which enables an automatic detection of a change of chord and/or a change of key.

Other features, elements, steps, characteristics and advantages of the present invention will become more apparent from the following detailed description of preferred embodiments of the present invention with reference to the attached drawings.

BRIEF DESCRIPTION OF THE DRAWINGS

In the following, preferred embodiments of the present invention are explained in more detail with reference to the accompanying drawings, in which.

DETAILED DESCRIPTION OF THE INVENTION

Figure 1:
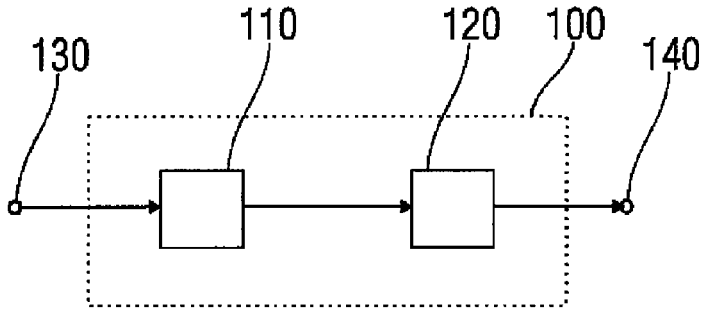
FIG. 1 shows a schematical block diagram of an inventive device for analyzing an audio datum.

With reference to FIGS. 1-27, now a first embodiment of an inventive device for analyzing an audio datum is described. Here, in FIGS. 1 to 27, for elements having the same or similar functional characteristics the same reference numerals are used, wherein the corresponding implementations and explanations are thus respectively mutually applicable and exchangeable.

The present application is structured as follows: first, with reference to one embodiment, the basic setup and the basic functioning of an inventive device for analyzing an audio datum and of three systems, which include the inventive device, are explained. Subsequently, the synthesis and the analysis of tone combinations will be explained in more detail, before an introduction into two different positioning variants is given. Hereupon, a mathematical model description follows, which serves for a further understanding of the present invention. Subsequently, a symmetry model-based and a circle of thirds-based harmony analysis will be explained, before further embodiments are explained and discussed.

FIG. 1 shows a schematical block diagram of a first embodiment of an inventive device 100 for analyzing an audio datum. The device 100 comprises a semitone analysis means 110 which is coupled to a vector calculation means 120 to provide an analysis signal to the vector calculation means 120. The semitone analysis means is coupled to an input terminal 130 to receive the audio datum. In addition to that, the vector calculation means 120 is coupled to an output terminal 140, at which the vector calculation means 120 provides an analysis signal to an external component which is not illustrated in FIG. 1.

If an audio datum is provided to the semitone analysis means 110 at the input terminal 130, then the semitone analysis means 110 analyzes the audio datum with regard to a volume information distribution across an amount of semitones and makes the same available to the vector calculation means 120 or optionally a distribution derived from the same. The vector calculation means 120 now calculates a two-dimensional intermediate vector based on the volume information distribution or the distribution derived from the volume information distribution, for each semitone or each element of a definition amount, via which the derived distribution was determined. Subsequently, the vector calculation means 120 calculates a sum vector based on the two-dimensional intermediate vectors and outputs the same as an analysis signal to the output terminal 140.

Figure 2:
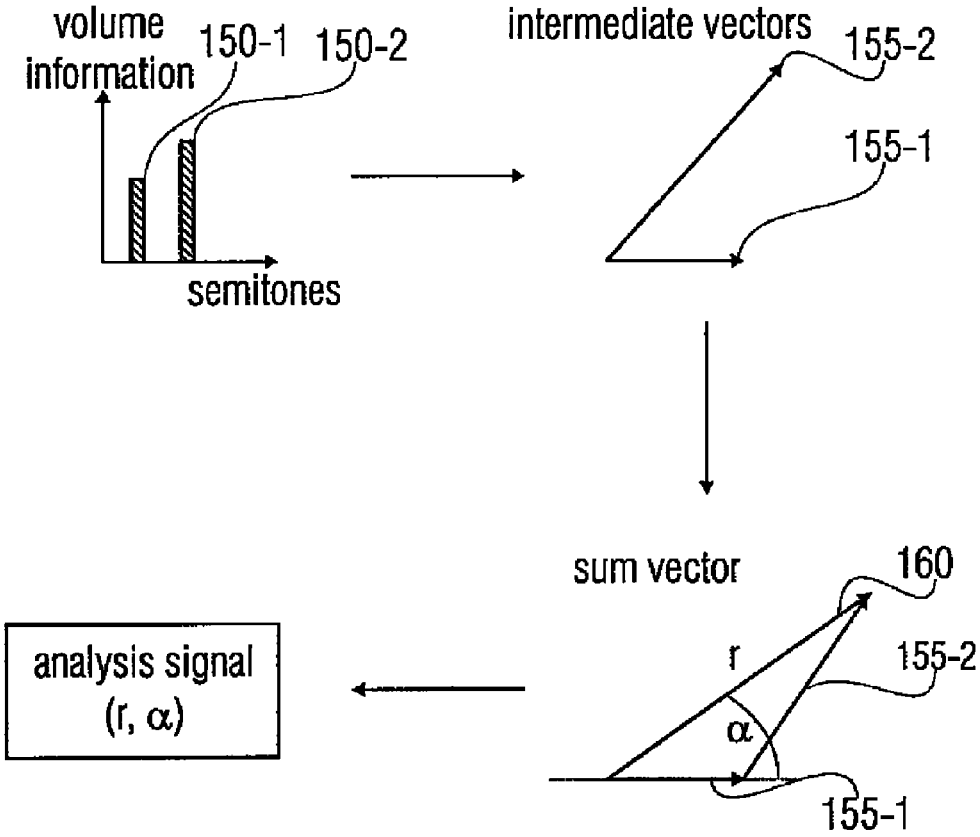
FIG. 2 shows a graphical illustration of the inventive method for analyzing an audio datum.

To explain this in more detail, in FIG. 2 the inventive method for analyzing an audio datum and the operation and/or the procedure for the analysis of an audio datum by the inventive device is graphically illustrated. Starting from an audio datum, the semitone analysis means 110 analyzes the same via an amount of semitones and thus obtains a volume information distribution which is illustrated as an example at the top left of FIG. 2. The volume information distribution illustrated there comprises two contributions 150-1 and 150-2 which are associated with two different semitones. In the example plotted in FIG. 2, the semitone analysis means 110 transmits the volume information distribution to the vector calculation means 120, whereupon the vector calculation means 120 calculates a two-dimensional intermediate vector for each semitone based on the volume information distribution. In particular, the vector calculation means 120 calculates an intermediate vector 155-1 for the contribution 150-1 and an intermediate vector 155-2 for the contribution 150-2, which are both illustrated on the top right of FIG. 2. Subsequently, the vector calculation means 120 calculates a sum vector 160 based on the two intermediate vectors 155-1 and 155-2, which comprises an angle $\alpha$ and a length r with regard to a preferential direction. The step of calculating the sum vector 160 is illustrated on the bottom right of FIG. 2. The vector calculation means 120 then generates an analysis signal based on the sum vector 160 and outputs the same to the output terminal 140. The analysis signal may thus, for example, comprise information regarding the length r and the angle $\alpha$ of the sum vector.

Depending on the concrete implementation of the device 100 for analyzing an audio datum, the semitone analysis means 110 may be set up in a different way. It is decisive here, in which form the audio datum is present. If the audio datum is, for example, a note sequence signal and/or a control signal, i.e. a signal which, for example, indicates to a sound generator which note and/or which pitch it has to play, the semitone analysis 110 of the device 100 for analyzing an audio datum may store the corresponding note sequence signals in a memory. The semitone analysis means 110 may then, for example on the basis of the note sequence signals stored in the memory, combine or "sum up" all note sequence signals which belong to a certain semitone, to subsequently provide the same as a volume information distribution to the vector calculation means 120. Here, depending on the concrete implementation of the semitone analysis means 110, the volume information distribution may be weighted according to a number of note sequence signals which belong to a certain semitone. If the note sequence signals comprise volume information, for example in the form of attack and/or touch values or other data indicating the volume, then the semitone analysis means 110 may gain the volume information distribution over the amount of semitones via putting together the corresponding note sequence signals. Examples for note sequence signals are, for example, midi signals (midi=musical instrument digital interface) or other digital or analog control signals for sound generators.

If, however, an analog or a digital audio signal is provided to the inventive device 100 for analyzing an audio datum, it may be required for the semitone analysis means 110 to analyze, if applicable, with regard to a frequency composition, in order to achieve the volume information distribution over the amount of semitones. In the case of digital audio signals being the audio datum, such an analysis may, for example, take place with the help of a so-called constant-Q transformation. In a constant-Q transformation, the incoming audio signal is analyzed by a plurality of bandpass filters respectively characterized by a central frequency and a bandwidth. Here, the central frequency of a bandpass filter is used according to the frequency and/or basic frequency of a pitch. The basic frequency of a pitch (e.g. 440 Hz for the pitch A') in this case corresponds to the central frequency of the bandpass filter which is responsible for an analysis of the audio datum with regard to this pitch and/or semitone. The bandwidth of the filters here corresponds to the distance of two pitches and/or tones in the frequency domain, so that the quotient of the central frequency and the bandwidth of every filter is constant. By this fact also the term constant-Q transformation is taken into account, as the letter Q here stand for quotient. Examples for digital audio signals are PCM signals (PCM=pulse code modulation), as they are, for example, used in connection with CDs. Depending on which digital audio signals are used, a further conversion into PCM signals or other digital audio signals may be required. One example for this is, for example, an MP3-encoded audio signal.

In the case of analog audio signals being the audio datum, for example a conversion and/or sampling of the analog audio signals into a digital audio signal may be required before a corresponding constant-Q transformation can be performed. This sampling of such an analog audio signal may, for example, be performed with the help of an analog/digital converter (ADC). Examples for analog audio signals are analog microphone signals, analog headset signals or line signals, as they are used, for example, in the field of stereo systems.

Optionally, a pitch class analysis means may be coupled between the semitone analysis means 110 and the vector calculation means 120, which calculates a pitch class volume information distribution over the amount of pitch classes and as a definition amount on the basis of the volume information distribution over the amount of semitones. As already explained above, a pitch class is here information regarding a pitch disregarding the octave to which the pitch belongs. In other words, a pitch is determined by indicating the pitch class and the octaving, i.e. the indication to which octave the pitch belongs. Thus, the pitches C, C', C", C"', . . . have the pitch class C. On the piano, thus twelve pitch classes are defined: D, D sharp, E, F, F sharp, G, G sharp, A, A sharp (B and/or H), C and C sharp.

The semitone analysis means 110 may further consider a frequency-dependent weighting function g(f) in the determination of the volume information distribution, which weights the analyzed semitones depending on their pitch level and/or their frequency and/or their basic frequency f. By considering the weighting function g(f) it is possible to consider how different the influence of two pitches and/or semitones of the same pitch class but of a different frequency, and thus of different octaves, is on the perception of harmony in the case of a chord and/or harmony.

The vector calculation means 120 may, for example, be implemented such that to each semitone or each pitch class a two-dimensional unit vector is assigned, which is weighted and/or multiplied with the associated component of the volume information distribution and/or the distribution derived from the volume information distribution. The vector calculation means 120 may do this, for example, on the basis of Cartesian coordinates with the help of a corresponding arithmetic logic unit. Likewise, the subsequent calculation of the sum vector 160 may take place on the basis of the intermediate vectors with the help of a (digital) arithmetic logic unit on the basis of Cartesian coordinates. Depending on the implementation of the inventive device 100 for analyzing an audio datum, the analysis signal may include the length r and the angle $\alpha$ of the sum vector with regard to a differential direction in the form of a digital data package.

Figure 3A:
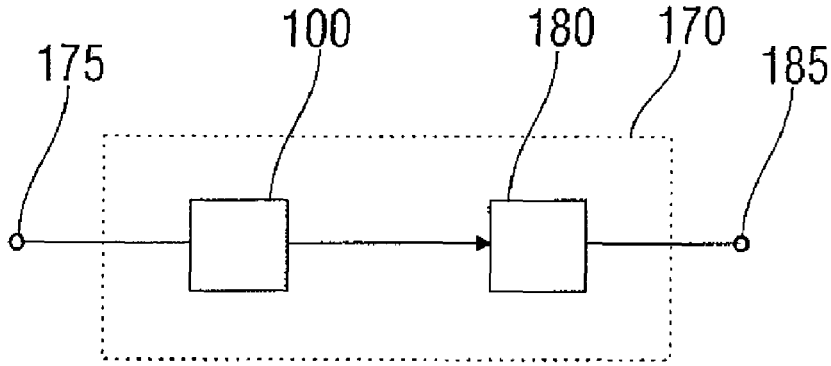
FIG. 3A shows a schematical block diagram of an inventive accompaniment system.

FIG. 3A shows an accompaniment system 170 which includes an inventive device for analyzing an audio datum 100. The audio datum is provided to the accompaniment system 170 and thus to the device 100 as an accompaniment system input terminal 175. Additionally, the accompaniment system 170 includes an accompaniment device 180, which is coupled to the device 100 for analyzing an audio datum, so that the accompaniment device receives the analysis signal output by the device 100. On the basis of the analysis signal, the accompaniment device 180 may identify, depending on the implementation, for example the currently played key and/or the currently played chord. On the basis of this information, the accompaniment device 180 may in turn generate corresponding note signals and output the same at the accompaniment system output 185. A sound generator, which is not illustrated in FIG. 3A, which may convert the note signals of the accompaniment system 170 into audible signals, may be connected to the accompaniment system output 185.

The accompaniment device 180 may, for example, be implemented such that, based on a mapping function which links the angle $\alpha$ of the sum vector 160 with an amount of note signals, which are output at the accompaniment system output 185. One example for the determination of a chord and/or the tonal context is explained in more detail in connection with FIG. 7. As already explained in connection with FIGS. 1 and 2, the audio datum, which is provided to the accompaniment system 170 at the accompaniment system input 175, may represent a note sequence signal or also an analog or a digital audio signal. The explanations in connection with FIGS. 1 and 2 with regard to the device 100 may thus also be applied to the accompaniment system 170 illustrated in FIG. 3A.

Optionally, in addition to that, the accompaniment system 170 may be extended by a melody detection means and a melody generation means, which are coupled to each other. The melody detection means detects a melody signal which is, for example, the audio datum, which is supplied to the device 100, which may, however, also be another audio signal, analyzes the same with regard to a volume information distribution over an amount of semitones and provides the same to the melody generation means as the melody detection signal. The melody generation means in turn generates a melody note signal on the basis of the melody detection signal, which may, for example, be supplied to an optional sound generator.

Thus, a melody audio datum, for example singing, may be provided to the melody detection means, for example via a suitable input, via a microphone input or another digital or analog audio signal, which is analyzed by the melody detection means. On the basis of the result of the melody detection means, the melody generation means may generate a melody note signal which may, for example, be provided to a sound generator, so that the same may replay the sung melody. By this, the accompaniment system 170 is able to simultaneously replay, for example, a sung melody and accompany the same.

Figure 3B:
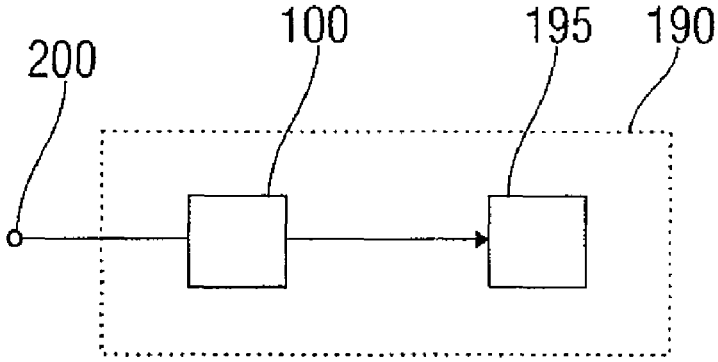
FIG. 3B shows a schematical block diagram of an inventive measurement system.

FIG. 3B shows a measurement system 190 which includes an inventive device for analyzing an audio datum and a display device 195, which are coupled to each other. The measurement system 190 additionally comprises a measurement signal input 200, which corresponds to the input terminal of the inventive device 100. As it was already explained in connection with FIGS. 1 and 2, the audio datum may both be a note sequence signal and also an analog or a digital audio signal. The inventive device 100 for analyzing the audio datum outputs a corresponding analysis signal which is provided to the display device 195. The display device 195 may then optically indicate the analysis signal to a user, for example in a graphically rendered form.

Figure 3C:
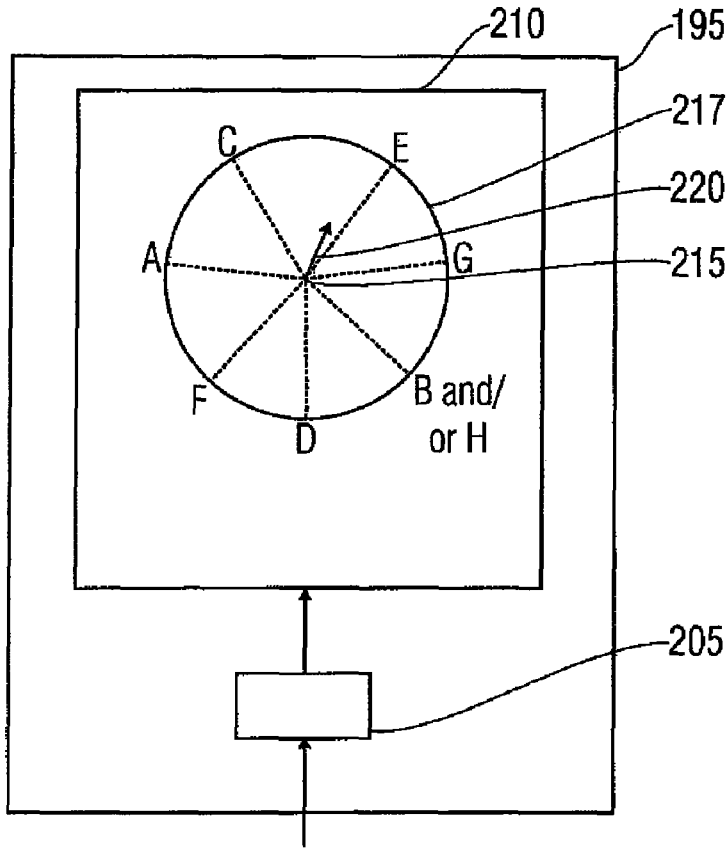
FIG. 3C shows an embodiment of an illustration of an output field of the measurement system (symmetry model)

FIG. 3C shows an embodiment of a display device 195. The display device 195 further comprises a display control means 205, which is coupled to an output field 210. The display control means 205 here receives the analysis signal from the inventive device for analyzing an audio datum.

The output field 210 may, for example, include an LCD display (LCD=liquid crystal display), a screen or another optical display area, like in the form of a field of light emitting diodes arranged in a matrix (LED=light emitting diode). Likewise, the output field 210 may include a TFT display (thin film transistor), a screen or another pixel-oriented display field. Depending on the concrete implementation of the output field 210, the display control means 205 may control the output field 210 such that, based on a central point 215, any output field radial direction may be optically accentuated. In the case of a field of light emitting diodes arranged in a matrix, this may, for example, be realized by the fact that, starting from a light emitting diode associated with the central point 215, a plurality of light emitting diodes is controlled by the display control means 205, which originate from the central point 215 in a straight line.

In the case of an output field, which enables a more complex illustration, like, for example, of a TFT display or an LCD display, the display control means 205 may be implemented to represent more complex patterns. In this case, not only an output field radial direction may be accentuated, but more complicated patterns may be represented. Thus it would in this case be obvious to represent an arrangement of pitch classes and/or pitches on the display 210, in connection with which the sum vector, which is provided by the inventive device 100 in the form of the analysis signal, is to be made clearer for an viewer of the measurement system 190.

In FIG. 3C, for this purpose an arrangement referred to as symmetry model and/or symmetry circle and/or cadence circle 217 is illustrated on the output field 210. The exact arrangement of the pitch classes in the symmetry model 217 is explained in more detail in connection with FIG. 7.

Independent of the concrete implementation of the output field 210, the display means 205 controls the output field 210 such that, starting from the central point 215, the sum vector is illustrated in the form of an output field radial direction or a more complicated pattern. In FIG. 3C, this is illustrated by the arrow 220. The display control means 205 here controls the output field 210 such that the arrow 220 appears under an angle with regard to a preferential direction of the output field 210 which depends on the angle of the sum vector. Here the display device 195 and the inventive device for analyzing an audio datum 100 are tuned with regard to each other such that the angles of the intermediate vectors, which are associated with different semitones or with the elements of the definition amount, and the angles, under which different pitch classes are illustrated on the output field 210 (e.g. the symmetry model 217), may be merged by a simple mapping and/or illustration. This mapping is a linear mapping, i.e., for example, around the identity. In other words, the inventive device 100 and the display device 195 are tuned to each other such that a 1:1 assignment of the angles of the intermediate vectors associated with the different pitch classes and/or the different elements of the definition amount and the directions under which the different pitch classes appear on the output field 210 is given. On the output field 210, thus, for example, the symmetry model 217 and the arrow 220 indicating the sum vector may be illustrated such that the output on the output field spatially models the symmetry model. Here, within the scope of the present application, a "spatial modeling" is an arrangement in which elements of an arrangement, i.e., for example, input means, output filed radial directions and output areas, are arranged with regard to a central point such that elements which are associated with a certain pitch class are arranged under such an angle that the same also appear under this angle in a pitch space.

Optionally, via the length of the illustrated arrow 220 also the length of the sum vector may be illustrated. The length of the arrow 220 and the length of the sum vector may here be linked to each other via a function which may, for example, be implemented within the context of the display control means 205. Here, virtually any functions are possible. Thus, a simple linear assignment may take place just like, for example, a logarithmic, a quadratic, or another, perhaps more complicated, mapping of the length of the sum vector to the length of the illustrated arrow 220.

Figure 3D:
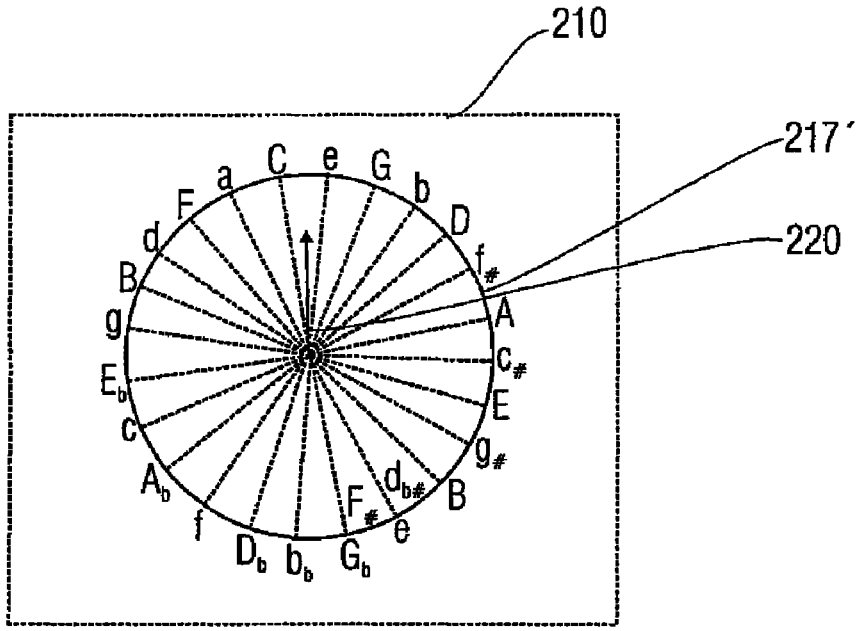
FIG. 3D shows an embodiment of an illustration of an output field of the measurement system (circle of thirds)

FIG. 3D shows a second embodiment of a possible illustration on the output field 210. In contrast to the output field 210 illustrated in FIG. 3C, on the output field 210 illustrated in FIG. 3D not the symmetry model 270, but an arrangement of pitch classes is illustrated, which is referred to as the circle of thirds 217'. The symmetry model is explained in more detail in connection with FIGS. 8-14, which is why at this point reference is made to the corresponding sections within the scope of the present application.

Within the scope of the present application, in the notation of the pitches classes, there is a difference between upper case and lower case pitch classes. If a pitch class is designated by an upper-case letter, like, for example, C or F, the corresponding major triad sounds when the corresponding pitch class and the two pitch classes which are adjacent to the corresponding pitch class in a clockwise direction are selected. In the case of C, this means that the pitch classes C-e-G for example represent a C major triad. Accordingly, the three pitch classes F, a and C together represent an F major triad. Pitch classes which are designated by small letters correspondingly represent minor triads. An example of this is the D minor triad which includes the pitch classes d, F and a. The triad designated by h0 has a special status, which is the diminished triad h0 when, based on the pitch class h0, the two clockwise adjacent pitch classes also sound. Here, this is the triad h/b-d-F which consists of a sequence of two minor thirds.

Basically, it is also possible that the output field 210 is not a screen or a screen-like output field which passes on information to a viewer optically, but that it is here, for example, a mechanical output field, wherein individual output field radial directions, output field areas or parts of the output field may be accentuated mechanically. It is in this connection also possible that such an accentuation may take place by a mechanical vibration or by a lifting or lowering of a certain area. By this, it is possible to offer a corresponding representation also to visually handicapped people.

Optionally, the display control means 205 may additionally also be implemented to accentuate an output field radial direction of the output field 210 or an area of the output field 210 which is associated with a pitch class of the symmetry model 217 or the circle of thirds 217', when a corresponding signal is transmitted to the display control means 205.

Of course, on the output field 210 also other arrangements of pitch classes or semitones may be illustrated. Arrangements of pitch classes are especially sensible in this context, in which pitch classes are associated with adjacent angles, which are based on special connections regarding music theory. The selection of a concrete output field preferential direction here represents no limitation regarding the term "adjacent angle" or "directly adjacent angle". Thus, for example, an angle to which a pitch class is associated and which is located at an angle value of 359° may be directly adjacent to another angle to which a pitch class is associated and which is located at an angle value of 1°.

Figure 3E:
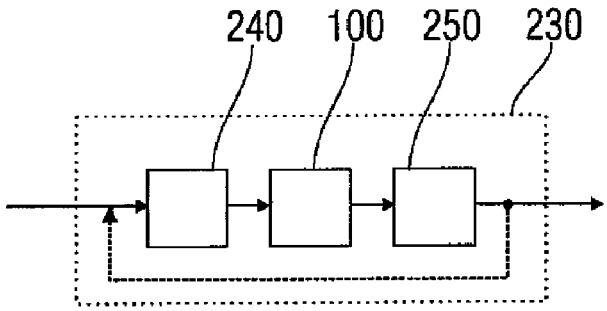
FIG. 3E shows a schematical block diagram of a detection system.

FIG. 3E shows a detection system 230 which also includes an integrator means 240 and an evaluation device 250 apart from the inventive device for analyzing an audio datum 100. A time-dependent audio input signal is provided to the integrator means 240 at one input, which temporally integrates the integrator means 240 and provides the same as a rendered audio datum to the inventive device 100 at one output.

If the time-dependent audio input signal is a note sequence signal, like, for example, a midi signal, the integrator means 240 may be implemented such that the number of parts of the note sequence signal referring to one pitch are added up. Here, a weighting of the volume information, which the note sequence signal includes, may be considered just like other weighting factors. Further, for example, the integrator means 240 may consider the "age" of a note sequence signal, i.e. a time difference between the arrival of a note sequence signal and a current time index. The integrator means 240 may, in this case, provide the audio datum to the inventive device 100 in the form of a further note sequence signal.

If the time-dependent audio input signal is an analog or a digital audio signal, like, for example, an analog microphone signal, it may be advisable to integrate a semitone analysis means into the integrator means 240, as it was already explained in connection with FIGS. 1 and 2. In this case it may thus be advisable, if applicable, to sample the time-dependent audio input signal by means of an analog/digital converter and analyze the same with regard to the amount of semitones by means of a constant-Q transformation. Also in this case, the integrator means 240 of the inventive device 100 may provide the audio datum in the form of a further note sequence signal, for example by the integrator means 240 generating corresponding midi signals based on an analysis by means of the constant-Q transformation and outputting the same to the inventive device.

Downstream to the inventive device 100 for analyzing the evaluation device 250 is connected, which receives the analysis signal from the device 100. The analysis signal of the device 100 in this case includes the length of the sum vector.

If the integrator means 240 is implemented such that it provides the time-dependent audio input signal in a time-integrated way as an audio signal to the device 100, for example in regular intervals, and if in addition to that the device 100, for example, performs the analysis in regular time intervals with a predetermined frequency and correspondingly respectively outputs the analysis signal, then the evaluation means 250 may determine a time course of the length of the sum vector on the basis of the incoming analysis signal, analyze the same and, if the time course of the length of the sum vector comprises a maximum or a minimum, output a detection signal at an output of the detection system 230. By this, the detection system 230 is able, for example, to detect a change of chords or a change of key. More details about this topic are explained in the further course of the present application.

Optionally, also the detection signal of the evaluation device 250 may be supplied to the integrator means 240, as the connection in dashed lines in FIG. 3E between the output of the evaluation device 250 and the integrator means 240 illustrates. By this, it is possible, a suitable implementation of the integrator means provided, to set the same back to an original state, i.e. to perform a restart, so that the audio datum provided to the inventive device 100 is not based on parts of the time-dependent audio input signal, which are based on time-dependent audio input signal data which came in before a certain point of time, for example the restart. By this, after a change of chord or a change of key was detected and a corresponding output of the detection signal took place, the detection system may optionally be set back into an original state, so that a new detection may be performed without "older" time-dependent audio input signals influencing the result of the detection.

Alternatively, the detection system may further be realized such that the integrator means 240 is connected between the semitone analysis means 110 and the vector calculation means 120. In other words, the detection system may further be implemented such that the integrator means 240 is implemented as an optional component of the inventive device 100. In this case, the integrator means 240 may be implemented such that the same, on the basis of the volume information distribution, provides a distribution derived from the same to the vector calculation means or a downstream pitch class calculation means.

A further embodiment of the present invention represents a key determination system, which, apart from an inventive device for analyzing an audio datum, comprises a key determination means, which is coupled to the inventive device. The key determination means receives the analysis signal from the inventive device and analyzes the current key or alternatively the current chord based on the angle of the sum vector included in the analysis signal. The key determination means may perform this, for example, on the basis of a key assignment function, which assigns the angle of the sum vector to a key or a chord. More detailed explanations regarding this are given in the further course of the present application in connection with the "symmetry model", the "third circle" and their mathematical description. Optionally, in addition to that, the key determination means may provide an estimate for the reliability of the analysis also on the basis of the analysis signal. Here, the length of the sum vector, which is also included in the analysis signal, may be used as a basis. Here, the estimate may be determined on the basis of a further functional assignment which assigns a certain estimate value to a length value of the sum vector. This further functional assignment may include a simple linear mapping, a step function or a more complicated function. The key determination means outputs the key and, if applicable, the estimate as the key signal at an output which may, for example, be output at an optional display device.

The chromatic scale consists of a sequence of twelve semitones which respectively have a pitch interval of a minor second. In other words, the chromatic scale includes twelve semitones which belong to an octave. To each pitch and semitone thus a frequency of a sound wave or another mechanical vibration is assigned. Due to the conventional division of the audible spectrum into octaves with respectively exactly twelve semitones in western music, each pitch and semitone of a certain octave and within an octave may thus be associated with a certain pitch class. In other words, this means that a semitone is clearly determined by the octave and its pitch class.

In other words, this means that a pitch class is referred to when, with regard to a pitch, it is disregarded to which octave it belongs. In western music and its instruments, i.e., for example, the piano, twelve pitch classes D, D sharp, E, F, F sharp, G, G sharp, A, A sharp, B and/or H, C and C sharp are defined, wherein, for reasons of clarity, enharmonic mix-ups are not mentioned here.

In music, a prime or a prime interval designates an interval of a semitone, wherein the starting pitch and the ending pitch are counted. In other words, two pitches with a prime interval have the same frequency and/or basic frequency (frequency ratio of the pitches 1:1), so that it is the same pitch. A minor second or an interval of a minor second in music is a pitch interval of two semitones, wherein also here the two pitches forming the interval are counted. Accordingly, a minor third and/or an interval of a minor third is a pitch interval of four semitones, a major third or a major third interval is an interval with five semitone steps and a fifth and/or a fifth interval is an interval with eight semitones, wherein the two pitches forming the interval are respectively counted.

In the notation of pitch classes, within the scope of the present application there is often a difference between upper-case and lower-case pitch classes. If a pitch class is designated by an upper-case letter, like, for example, C or F, this indicates that the corresponding pitch class is the base pitch (keynote) of a corresponding major triad, i.e. in the above case a C major triad or an F major triad. Correspondingly, pitch classes within the scope of the present invention representing a base pitch of a minor triad are designated by lower-case letters. An example of this is the a minor triad.

To enable a better understanding of the embodiments discussed in the further course of the present invention, first of all the synthesis of sensibly sounding pitch combinations will now be examined before the analysis of pitch combinations, the positioning variants of base pitches in the pitch space, the mathematical model description and the harmony analysis based on the symmetry model and on the circle of thirds are described in further sections.

Synthesis of Sensibly Sounding Pitch Combinations

The basic principle behind all embodiments proposed in this document is the following: in a so-called pitch space, base pitches and/or pitch classes are placed so that adjacent pitches and/or pitch classes make sensibly sounding pitch combinations. Here, within the scope of the present application, in general an oval/circular arrangement of the base pitches is taken as a basis. Due to this placement, it is possible to create harmonically sounding music by the selection of a suitable level section or space section. Based on the arrangement of the base pitches in an oval/circular arrangement, the level section and/or range/space section includes at least one input angle or one input angle range, as far as an input angle or input angle range was selected by the user at all. The selected space section may be varied infinitely or in leaps regarding its extension and its center of mass, i.e. its position. Apart from that, it is possible to occupy the selected space section with a selection weighting function. The selection weighting function makes it possible to define the relative volume at which the base pitches and/or pitch classes detected by the space section are to be played. Base pitches are thus placed at discrete positions of the pitch space.

But what happens with the positions in between? Which pitches sound when a space section was selected which lies in between two discrete base pitches? In order to solve this problem, in addition to the selection weighting function, a spatial pitch distribution function is defined. Each base pitch and/or pitch class placed in the pitch space has a function, which is in this case called a spatial single pitch distribution function. By introducing the spatial pitch distribution function and/or the spatial single pitch distribution function, wherein a corresponding spatial single pitch distribution function is associated with each pitch class and/or each base pitch, the spatial pitch distribution function results as an overlay (e.g. by addition, considering the pitch classes) of the spatial single pitch distribution function. The spatial pitch distribution function thus ensures that a pitch not only occupies an infinitely small discrete point and/or in case of an oval/circular pitch space an individual angle, but a section of a range and/or a finite angle range. The space sections occupied by two base pitches may here overlap. Thus, an angle may have more than one associated pitch class, in particular two pitch classes. The principles presented here thus offer completely new possibilities in the design of polyphonic audio signals, as it will become clear regarding the description of the embodiments in the further course of the present application.

Possibilities offered by this arrangement of basic pitches in the pitch space are explained in more detail in the further course regarding FIGS. 4 and 5.

Figure 4A:
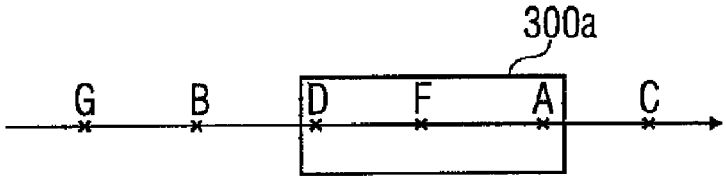
FIG. 4A shows a schematic illustration of an angle range mapped to a straight line with an assignment of pitch classes and an input angle or an input angle range.

FIG. 4A shows a schematic illustration of an angle area mapped to a straight line with an assignment of pitch classes, wherein here, for reasons of clarity, the pitch classes are not designated by upper-case and lower-case letters to specify the associated quality of sound (pitch color) (minor triad or major triad) in more detail. The direction of the arrow here indicates the direction of increasing angles and/or the clockwise direction. In FIG. 4A, the base pitches B and/or H, D, F, A and C are placed in the one-dimensional pitch space. Further, a range/space section 300*a* is selected which comprises the pitches of the d minor chord (D-F-A). A connected sound generator would thus play a d minor chord. By selecting the spatial section 300*a*, thus a d minor chord would be generated.

Figure 4B:
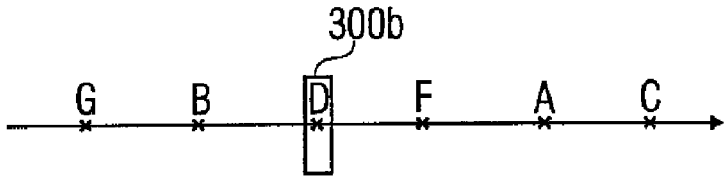
FIG. 4B shows a schematic illustration of an angle range mapped to a straight line with an assignment of pitch classes and an input angle or an input angle range.

In FIG. 4B, the pitch space, which was already illustrated in FIG. 4A, is illustrated again. In contrast to FIG. 4A, in FIG. 4B, however, a space section 300*b* is shown which is very small compared to the space section 300*a*. The space section 300*b* has an extension which almost disappears and/or is zero, which would correspond to a selection of an individual angle, i.e. an individual input angle. The space section 300*b* lies directly on a base pitch, i.e. the base pitch D. A connected sound generator would now play the individual pitch D.

Figure 4C:
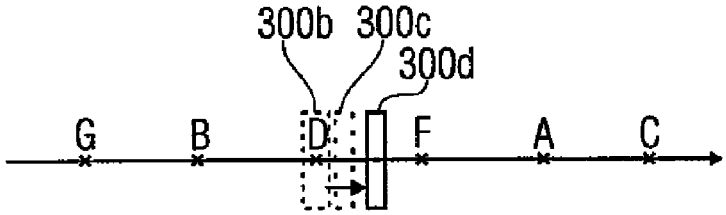
FIG. 4C shows a schematic illustration of an angle range mapped to a straight line with an assignment of pitch classes and three input angle ranges transferred into one another.

In FIG. 4C, again the already illustrated space section of FIG. 4A is illustrated. FIG. 4C shows how the space section 300*b* which was already illustrated in FIG. 4B is continuously moved from the position of the base pitch D via a position of a space section 300*c* in a center position between the base pitch D and the base pitch F, so that the space section 300*b* will have changed into a space section 300*d* at the end of its movement. A connected sound generator would fade out the sounding pitch D regarding its volume and fade in the pitch F regarding its volume according to the position of the space section 300*b*, 300*c* or 300*d*, when the corresponding volume information is considered. Details with regard to fading in and fading out of pitches are given by the selection weighting function and the spatial pitch distribution function, which are explained in more detail below. While FIG. 4B shows a generation of a single pitch, FIG. 4C shows a cross-fading between adjacent base pitches.

Figure 4D:
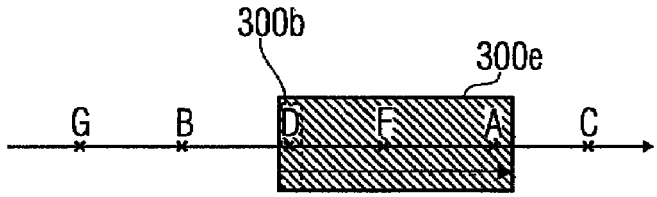
FIG. 4D shows a schematic illustration of an angle range mapped to a straight line with an assignment of pitch classes and an input angle range of an increasing magnitude.

In FIG. 4D, an example for a cross-fading between a single pitch and a chord is illustrated. Thus, in FIG. 4D, again the pitch space which was already illustrated in FIG. 4A is illustrated. In this case, the selected space section is continuously extended to a width of a triad, starting from the space section 300*b* of FIG. 4B, which corresponds to a space section 300*e*. A connected pitch generator would at the beginning again only play the pitch D. Subsequently, during the extension of the selected space section, the pitch F would slowly be faded in and subsequently the pitch A. Hereby, the pitch D is continuously "converted" into a D minor triad.

Figure 4E:
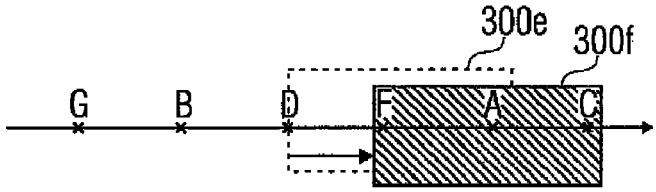
FIG. 4E shows a schematic illustration of an angle range mapped to a straight line with an assignment of pitch classes and two input angle ranges.

In FIG. 4E, a cross-fading between different chords is illustrated. FIG. 4E thus shows how the space section 300*e* of FIG. 4D is continuously shifted so that the same is changed into a new space section 300*f*. The space section 300*f* then does not start with the pitch D, but with the pitch F. A connected pitch generator would thus at the beginning play a D minor chord and then subsequently continuously cross-fade the same into an F major chord.

Figure 5A:
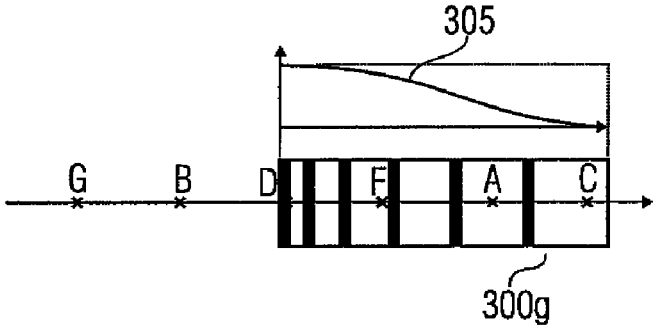
FIG. 5A shows a schematic illustration of an angle range mapped to a straight line with an assignment of pitch classes and an input angle range weighted with a selection weighting function.

In FIG. 5A, the effect of a selection weighting function is illustrated. Thus, FIG. 5A again shows the pitch space already known from FIG. 4A. In FIG. 5A, the selected space section includes the pitches D, F, A and C. Without introducing a selection weighting function, a connected sound generator would play a D minor 7 chord, wherein all pitches have the same volume. By introducing a selection weighting function 305, as it is also illustrated in FIG. 5A, the volume of each pitch may be adapted. In this example, the selection weighting function 305 is selected such that an emphasis is on the base pitch D and the third F of the chord and that the fifth A and the seventh C are played with a reduced volume.

Figure 5C:
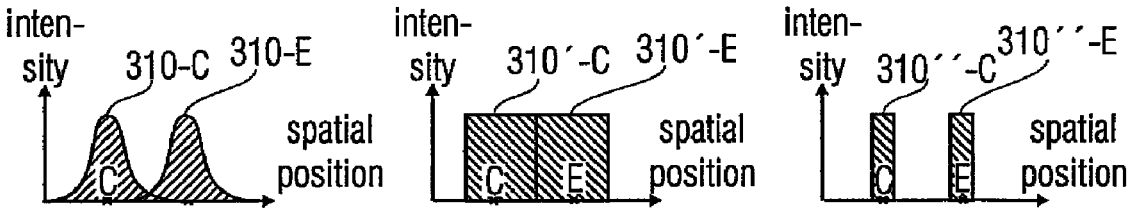
FIG. 5C shows a schematic illustration of three spatial pitch distribution functions.
Figure 5B:
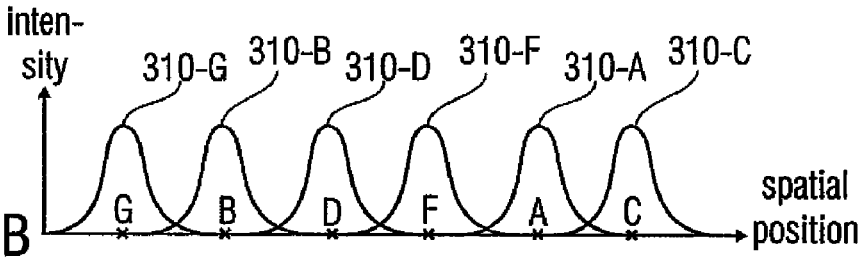
FIG. 5B shows a schematic illustration of an angle range mapped to a straight line with an assignment of pitch classes and a spatial pitch distribution function which is, for example, angle-dependent like in our example.

In FIG. 5B, the influence of a spatial pitch distribution function is illustrated. Thus, FIG. 5B again shows the pitch space already illustrated in FIG. 4A. Each base pitch and/or each pitch class has in this example an associated spatial pitch distribution function 310-C, 310-A, 310-F, 310-D, 310-B(H) and 310-G, however. By this, each base pitch is not only associated with a discrete location and/or an individual angle, but is also defined in a certain environment around the base pitch. Hereby, in the example illustrated in FIG. 5B, a bell-shaped spatial single pitch distribution function is associated to each base pitch.

In FIG. 5C, three examples of different space distribution functions and/or spatial pitch distribution functions are illustrated. In more detail, FIG. 5C shows three examples of spatial single pitch distribution functions which are plotted associated with their respective base pitches and/or pitch classes. In FIG. 5C on the left two bell-shaped single pitch distribution functions 310-C, 310-E are illustrated in a pitch space which only includes the two base pitches and/or pitch classes C and E. The two spatial single pitch distribution functions 310-C and 310-E comprise a maximum volume information in the form of an intensity in their respective base pitches and/or pitch classes C and E. Starting from the base pitches C and E, the volume information quickly drops off. In an area of the pitch space which lies between the two base pitches C and E, the two spatial single pitch distribution functions overlap, so that an inventive device for generating a note signal would generate note signals which correspond to both pitch classes, when, for example, the input angle is in this area of the pitch space.

The middle partial illustration of FIG. 5C shows a further possibility of a spatial single pitch distribution function. In this partial illustration, over the same pitch space as it is also illustrated in FIG. 5C on the left, two rectangular spatial single pitch distribution functions 310'-C and 310'-E are illustrated. The two spatial single pitch distribution functions 310'-C, 310'-E respectively extend starting from their associated base pitch C and E towards both sides across an angle range and/or a space area which corresponds to half a distance of two adjacent base pitches in the pitch space. Within these space areas, the volume information in the form of the intensity is in this example constant. Apart from that, in contrast to the example illustrated on the left in FIG. 5C, the two spatial single pitch distribution functions 310'-C and 310'-E do not overlap.

In FIG. 5C on the right a third example of two spatial single pitch distribution functions 310"-C and 310"-E are illustrated with respect to the pitch space already illustrated on the left in FIG. 5C. In contrast to the two spatial single pitch distribution functions 310'-C and 310'-E, the angle ranges and/or space areas in which the two spatial single pitch distribution functions 310"-C and 310"-E comprise a volume information which is unequal to zero are clearly reduced. But also here, these two spatial single pitch distribution functions are rectangular, so that, independent of the exact position within the spatial range in which the two spatial single pitch distribution functions have a volume information unequal to zero, the same is constant.

If now a sound generator is connected, and if a very narrow space section or also an individual input angle is shifted as an input angle range respectively starting from the base pitch C from left to right to the base pitch E, the following will happen regarding to sound: in the case illustrated on the left in FIG. 5C, a soft cross-fading between the pitches C and E would take place. While one pitch is faded out, the other is slowly faded in. In the case illustrated in the middle of FIG. 5C, the pitch C will sound for some time. Suddenly the pitch C will fall silent and the pitch E will sound. In the case illustrated on the right in FIG. 5C, the pitch C will sound for a short time, while the input angle and/or the very small input angle range is within the space area in which the spatial single pitch distribution function 310"-C comprises a volume information which is unequal to zero. Subsequently, when the input angle and/or the very small input angle range has left this range, the connected sound generator would generate no pitch, so that in this case there is silence. If subsequently the input angle or also the very small input angle range reaches the space area in which the spatial single pitch distribution function 310"-E comprises a volume information which is unequal to zero, the pitch E will sound.

In connection with FIG. 5C it would be obvious to note that the two pitch classes C and E, which are illustrated in FIG. 5C, comprise a smallest pitch distance which corresponds to a distance of a major third. In principle, the two pitch classes C and E also comprise different, larger pitch distances than that of a major third. The reason for this is, that base pitches and/or pitch classes comprise no indication regarding the octaving and/or octave position. For this reason, the two pitch classes C and E, for example, also comprise a pitch distance of a minor sixth, which is, however, larger than the smallest pitch distance, which corresponds to a major third.

The opening angle of the symmetry circle and/or the selected space section may also be interpreted as the "jazz factor". The greater the angle, the more jazz-typical pitches (tones) sound and/or are added. Among those are 7th chords, 7th-9th chords and 7th-9th-13th chords.

Analysis of Existing Pitch Combinations

In the following, the basic principle for the analysis of a pitch combination is explained in more detail. The principle for the synthesis of sensible sound combinations described in the above paragraphs may be reversed to analyze existing sound combinations. Just like in the synthesis, in a first step base pitches have to be positioned in the pitch space in such a way that adjacent base pitches result in sensible sound combinations. The thus generated pitch space is, however, not used to determine pitches to be generated but, if applicable, to represent and analyze already existing pitches. By this it is possible to examine whether an existing pitch combination is "sensible" or not with regard to the definition existing in the form of the pitch space. If a pitch combination is sensible, then the base pitches of this pitch combination are represented in spatially adjacent areas. If a pitch combination is less sensible, the base pitches are illustrated in remote areas. The advantage of this principle is that the term "sensible pitch combination" and the term "senseless pitch combination" are not rigid, but may be redefined by a reorganization of the base pitches in the pitch space.

In each of FIGS. 3C and 3D, on the output field 210 a pitch space is spatially modeled, which enables an estimate of the "sensibility" of a pitch combination. On the output field 210, in the examples illustrated in FIGS. 3C and 3D, the symmetry model 217 and/or the circle of thirds 217' is specially modeled. As already illustrated in FIGS. 3C and 3D, within the scope of the symmetry model 217 and/or the circle of thirds 217', the pitch classes are arranged in an oval/circular way. Here, within the scope of the present application, an oval/circular arrangement is an arrangement in which, regarding a central point, the elements of the arrangement, here the output areas, are arranged under a plurality of angles with regard to a zero direction or a preferential direction with a radius which is dependent on the angle. A difference between a maximum occurring radius and a minimum occurring radius is here typically different from a mean radius by less than 70% and better by less than 25%.

FIG. 6 shows four examples for a representation of pitch classes on an output field 210, as it is illustrated in FIGS. 3C and 3D. Here, for a simplification of the illustration, the oval/circular arrangement of the output field radial direction and/or the output areas was "broken up" into a straight line. The oval/circular arrangement of the output field radial directions and/or the underlying angle range were thus mapped to a straight line. By this, a more compact illustration of the output field 210 with different illustrated pitches, pitch combinations and sound combinations is possible. The arrows indicated in FIGS. 6A-6D here again indicate the direction of increasing angles and/or the clockwise direction. In FIGS. 6A-6D thus a pitch space is illustrated which includes the pitch classes G, B and/or H, D, F and A.

Figure 6A:
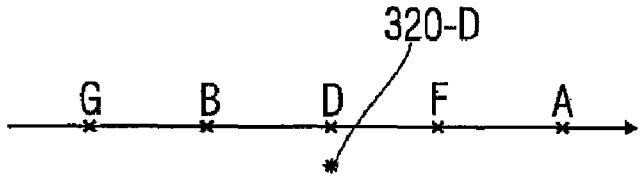
FIG. 6A shows a schematic illustration of an angle range mapped to a straight line with an accentuation of an angle allocated to a pitch class.

FIG. 6A shows the case where a sounding of a pitch with a pitch class D is indicated to the display control means 205. In this case, the display control means 205 controls the output field 210 such that the base pitch (and/or pitch class) corresponding to the pitch is marked in the pitch space of the output field 210, i.e. when the corresponding pitch sounds. In the example illustrated in FIG. 6A, on the output field 210 a marking and/or an accentuation 320-D appears, which is, for example, an optical signal, i.e. a lighting up of a corresponding area of the output field 210. In the example illustrated in FIG. 6A, thus the pitch D sounds, which is then illustrated on the output field 210.

Figure 6B:
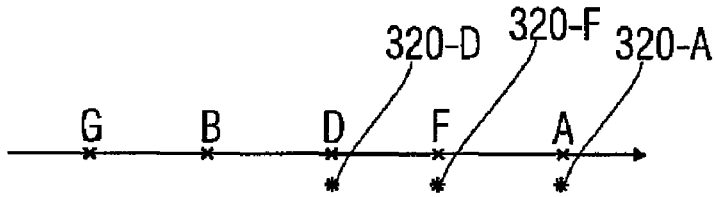
FIG. 6B shows a schematic illustration of an angle range mapped to a straight line with an assignment of pitch classes and an accentuation of three consonantly and/or harmonically sounding pitch classes.

FIG. 6B shows the case that several pitches sound simultaneously, which result in a sensible pitch combination. In this case, in the pitch space which is illustrated on the output field 210, adjacent base pitches are marked and/or accentuated. From this it may be deduced that the spatial concentration of active base pitches and/or pitch classes in the pitch space is a measure for meaningfulness, i.e. for the perceived consonance. In particular, FIG. 6B illustrates this using a d minor chord, which corresponds to a sensible pitch combination. In this case, when the corresponding chord sounds in the pitch space, i.e. on the output field 210, the base pitches D, F and A are accentuated by corresponding markings and/or accentuations 320-D, 32-F and 320-A.

Figure 6C:
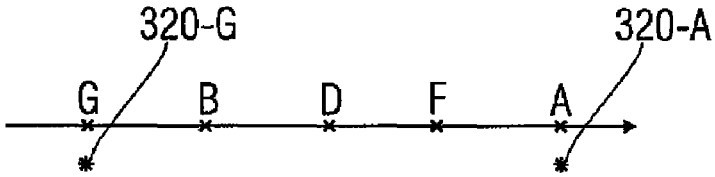
FIG. 6C shows a schematic illustration of an angle range mapped to a straight line with an assignment of pitch classes and an accentuation of two pitch classes not sounding very harmonic.

If pitches resulting in a less sensible pitch combination sound simultaneously, then the corresponding base pitches in the pitch space and thus on the output field which spatially models the pitch space are very far apart. From this it may be deduced that the spatial extension of active base pitches in the pitch space is a measure for senselessness, i.e. for the perceived dissonance. In the example illustrated in FIG. 6C, the pitches G and A sound, i.e. a corresponding input signal is provided to the display control means 205 via the input signal terminal 220, so that on the output field 210 the associated base pitches G and A are marked by markings and/or accentuations 320-G and 320-A. The interval generated by these pitches is one second, which is generally perceived to be relatively dissonantly sounding. FIG. 6C thus shows a marking of the pitch space on the output field 210 when a less sensible pitch combination sounds, i.e. a second.

With several sounding pitches it is possible not only to mark the associated base pitches, but also to calculate a corresponding area on the output field 210 which includes the sounding pitches, and a center of mass (focus; gravity) of all sounding pitches in the pitch space and represent the same by a corresponding marking. Such a calculation is possible with the help of the sum vector, which is explained mathematically further below, which is included in the analysis signal. The center of gravity again enables to assess the sound color of complicated pitch combinations as it is explained in more detail in the further course of the invention.

Figure 6D:
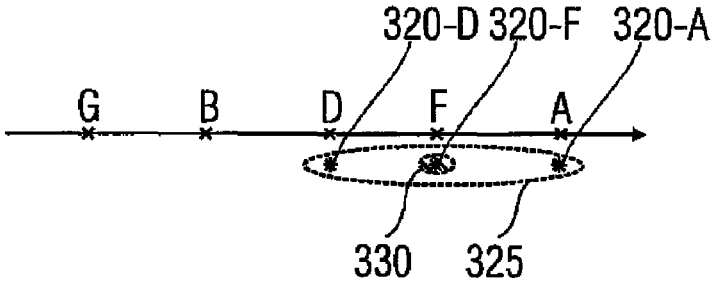
FIG. 6D shows a schematic illustration of an angle range mapped to a straight line with an assignment of pitch classes, three angles associated to harmonically sounding pitch classes and two accentuated angle ranges.

FIG. 6D shows an example for a display on a corresponding output field 230 for a D minor chord. Thus, in the example illustrated in FIG. 6D, not only the base pitches D, F and A are marked by the markings 320-D, 320-F and 320-A already illustrated in FIG. 6B, but rather also an area 325 is indicated which includes the sounding base pitches and/or their markings. In addition to that, also the position of the center of mass is illustrated by an additional marking 330.

FIG. 6D shows an example for a display on a corresponding output field 210 for a D minor chord. Thus, in the example illustrated in FIG. 6D, not only the base pitches D, F and A are marked by the markings 320-D, 320-F and 320-A already illustrated in FIG. 6B, but rather also an area 325 is indicated which includes the sounding base pitches and/or their markings. In addition to that, also the position of the center of mass is illustrated by an additional marking 330.

Positioning Variants of Base Pitches in the Pitch Space

What is a "sensible pitch combination" and what is a "senseless pitch combination"? There is no general answer to this question. What we think to be sensible and what we think to be senseless or what we think to be consonant and/or to be dissonant strongly depends on subjective factors like taste, culture, education, etc. and may differ from person to person. Just as no global answer can be given to the above question, it is not possible to find an arrangement of base pitches in the pitch space which provides valid statements for all people and all musical styles. It is, however, possible to find positioning variants, with the help of which statements about tonal connections and perceived sound perceptions may be made which hold true for a great number of persons. The circle of thirds and the symmetry model, which are explained in the following paragraphs, are two systems which enable exactly this.

The Symmetry Model

The symmetry model enables defining and/or analyzing many tonal connections for pieces of music which follow the classical major cadence. The technical use of the symmetry model is new. The explanations in this sections are based on the example of the C major scale and may be applied to all other major scales. In summary, it may be said that the key differentiation features of the symmetry model are 1. the selection of the mapped pitches
2. the sequence and
3. the symmetrical arrangement of these pitches around the symmetry axis.

Figure 7:
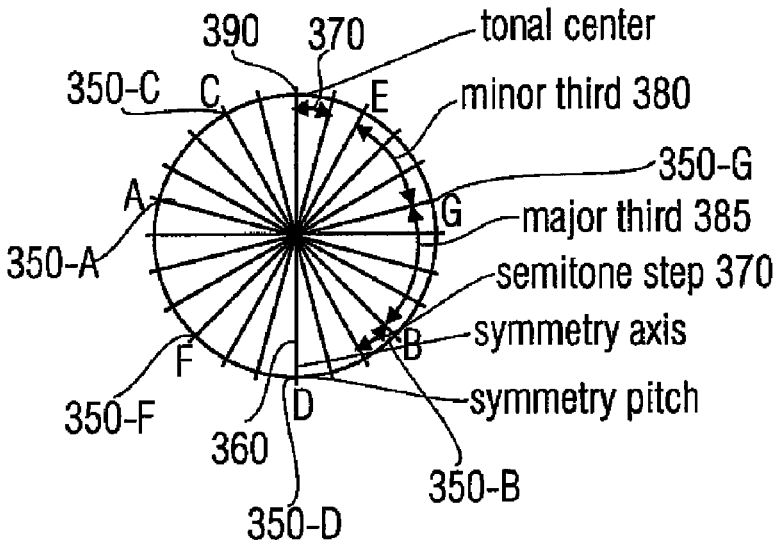
FIG. 7 shows an illustration of the symmetry model and/or the cadence circle based on the example of the diatonic scale C major and/or a minor.

FIG. 7 shows a graphical illustration of the symmetry model in the form of the so-called cadence circle or the C major scale and/or for the a minor scale. Within the scope of the present application, the terms "symmetry model" and "cadence circle" are partially used synonymously. The symmetry model positions the seven pitches of the diatonic scale and/or the seven pitch classes of the diatonic scale 350-D, 350-F, 350-A, 350-C, 350-E, 350-G and 350-B on a circle or an oval/circular arrangement. In particular the sequence of the pitches on the circle is new here. The pitches and/or pitch classes are not positioned in equal distances on the circle, but—starting from the second pitch 350-D, i.e. the pitch D—alternatingly in minor and major thirds under a defined angle.

A second, very critical feature is the symmetrical arrangement of the pitches around an imaginary symmetry axis 360. The symmetry axis 360 runs exactly through the location 350-D of the second pitch of the scale (D), which is why the same is referred to as symmetry pitch. The remaining and/or further pitches of the scale are positioned symmetrically left and right around the symmetry pitch 350-D.

If the order and the symmetry of the pitches is maintained, different possibilities remain to determine the exact position of the base pitches. One possibility which is used within the scope of the symmetry model is to position the pitches on the circle according to their pitch interval. For this purpose, the circle is divided into 24 segments 370, with an opening angle of the segment of 360°/24=15°. Each segment 370 corresponds to a semitone interval, as it is indicated in FIG. 7. As a minor third corresponds to three semitones and a major third corresponds to four semitones, two pitches forming a minor third are positioned at a distance of three segments 370 and two pitches forming a major third are positioned at a distance (an interval) of four segments 370. To a distance of a minor third, thus in the symmetry model and angular distance of 3×15°=45° is assigned, while to a distance of a major third analogously an angular distance of 4×15°=60° is assigned.

In FIG. 7, an example for such a minor third 380 between the two pitches E and G and an example for a major third 385 between the two pitches G and B(H) is indicated. FIG. 7 thus all in all shows the arrangement of the base pitches in the pitch space according to the symmetry model. The pitches are—as already mentioned above—positioned symmetrically around the symmetry axis 360 passing through the symmetry pitch D 350-D. The symmetry results from the pitch intervals of the base pitches.

The pitches (tones) and/or pitch classes 350-E to 350-C are thus not distributed equidistantly on a circle with regard to the angle. Rather, they are spaced apart correspondingly with regard to the respectively smallest pitch distance to the neighbor pitch and/or to the neighboring pitch class. Because, as it was explained above, the symmetry model is based on a division of the circle into 24 segments 370, an output of angle, which is assigned to a certain pitch class and/or a certain pitch may take place by introducing a designator n'. The designator n' is an integer number from the amount of numbers {2, 5, 9, 12, 15, 19, 22} and designates the angle, under which a certain pitch class appears, according to the linear mapping $$\alpha_T = n' \cdot 2\Pi/24 \bmod 2\Pi$$

wherein $\alpha_t$ represents the angle of a pitch class in radian measure depending on the designator n' of the pitch class and p is the circle number. An exact assignment of the pitch classes T, the designators n', the angles in degree and the angles in radian measure is listed in the following table.

| | pitch class T | | | | | | |
|---|---|---|---|---|---|---|---|
| | E | G | B and/or H | D | F | A | C |
| n' | 2 | 5 | 9 | 12 | 15 | 19 | 22 |
| angle | 30° | 75° | 135° | 180° | 225° | 285° | 330° |
| angle/2Π | 1/12 | 5/24 | 3/8 | 1/2 | 5/8 | 19/24 | 11/12 |

By a simple extension of the designator n, the same may represent the angle $\alpha_T$ of the pitch classes not only with regard to an octave, but further enables a representation of all pitches of the corresponding major scale. Here, for each octave the designator n' has to be increased or decreased by 24. If, for example, by definition, the pitch C' has a designator n'=22, then in this case the pitch C" would have a designator n'=46 and the pitch C would have a designator n'=−2.

Here, a tonic area is an area of the symmetry model illustrated in FIG. 7 which includes the four pitch classes A (350-A), C (350-C), E (350-E) and G (350-G), i.e. is located in the area of the tonal center 390. In the illustration selected in FIG. 7, an area designated the dominant area extends as a symmetry model starting from the tonal center 390 in a clockwise direction approximately into the area of the symmetry pitch D (350-D). The dominant area includes the four pitch classes E (350-E), G (350-G), B and/or H (350-H) and D (350-D). Accordingly, an area referred to as the subdominant area extends, starting from the tonal center 390, in a counterclockwise direction also up to the symmetry pitch D (350-D), wherein the same includes the pitch classes C (350-C), A (350-A), F (350-F) and D (350-D). More details regarding this and the importance of the tonic area, the subdominant area and the dominant area are contained in the dissertation by David Gatzsche with the title "Visualisierung musikalischer Parameter in der Musiktheorie" (dissertation of the Frank Liszt School of Music Weimar 2004).

From the symmetry model, many sensible tonal connections result which may, on the one hand, be used for the synthesis and, on the other hand, for the analysis of audio and pitch information. In the following, some of these connections are listed:

1. Dissonantly sounding pitch combinations are represented by base pitches positioned far apart, consonantly sounding pitch combinations by geometrically adjacent base pitches. The further two base pitches are positioned apart from each other, the more dissonant the pitch combination generated by the same sounds.
2. Any third intervals, major and minor chords, seventh chords, 7th-9th chords and diminished chords which may be generated using the pitches of the diatonic major scale are illustrated by adjacently positioned base pitches. This especially results from the sequence of the pitches and their circular arrangement.
3. The model geometrically reflects connections regarding functional theory and/or music theory. On the one hand, the base pitches of major chords and parallel minor chords are geometrically directly adjacent. On the other hand, the pitches of tonic chords (a minor and C major) are positioned in the center with regard to the symmetry axis 360, those of subdominant chords (F major and d minor) are arranged on the one side, e.g. left of the symmetry axis 360 and those of dominant chords (G major and e minor) on the other side (e.g. on the right) of the symmetry axis 360.

4. Pitches which have a great strive for resolution, like, for example, the pitch B and/or H, also referred to as the leading note, or the fourth pitch of the scale (F), are positioned geometrically on the symmetry circle remote from a point 390 referred to as the tonal center, the tonic area. Pitches which have a small strive for resolution are positioned close to the tonal center 390.
5. From the symmetry model, the principle of Riemann of six-fold pitch representation may easily be deduced, which is described in the publication of Hugo Riemann "Ideen zu einer 'Lehre von den Tonvorstellungen'", Jahrbuch der Musikbibliothek Peters, Jahrgang 21/22 (1914/15), p. 11. According to this principle, each pitch may be a base pitch, a third and a fifth, both of a major chord and also a minor chord. From the symmetry model for each pitch three of these six possibilities result. Thus, for example, the pitch C may be part of the triads F-A-C, A-C-E and C-E-G.
6. At the point where the circle is closed, i.e. at the symmetry pitch D 350-D, there is neither a minor chord nor a major chord, but a diminished triad which is made up of two minor thirds. This chord is the only chord which consists of two equal intervals in the cadence circle and/or the symmetry model in FIG. 7. This chord contains the symmetry pitch 350-D in the center and is thus formed symmetrically, which is why it is also referred to as symmetry chord within the scope of the symmetry model.

The symmetry model and/or the cadence circle is described, explained and discussed regarding music theory in more detail in the above-cited dissertation by David Gatzsche.

In other words, the symmetry model, compared to the diatonic scale, enables a playful and thus pedagogically more valuable introduction to principles of music theory, which are in the following again summarized and explained. Here, the focal point is on conveying knowledge about music theory to children. Principles of pedagogic/music theory are generally very obscure. As the description of this embodiment will show, the musical instruments described here presents such an input method for infants which is so simple that even infants or highly handicapped persons may be musically creative.

The question now is, why there are exactly seven pitch classes? The answer is as follows: the most common scale in western latitudes is the so-called diatonic scale. This scale has seven pitches. On the piano, seven adjacent white keys exactly correspond to the diatonic scale for C major and/or a minor. A substantial innovation of the symmetry model is the arrangement of pitch classes:

on the piano, the pitch keys are arranged in semitone steps and whole steps. From this, the pitch sequence and/or pitch class sequence C-D-E-FG-G-A-(B and/or h)-C results. In the symmetry model, however, the keys are arranged in intervals of thirds: starting with the pitch D minor and major thirds alternate. Thus, the following pitch sequence and/or pitch class sequence results: D-F-A-C-E-G-(B and/or H)-D.

The pitch classes are not arranged on a line like on a piano, but on a circle, i.e. the symmetry circle of the symmetry model. Basically, also other oval/circular arrangements, as defined in the introductory sections of the present application, are possible here. The circle comprises a circle center. A vertical imaginary axis runs through the circle center and is referred to in the following as the symmetry axis 360. With the help of the symmetry axis 360, every pitch class 350-C to 350-A may be represented by an angle α between the symmetry axis 360 and a connecting line between the corresponding pitch class and the circle center.

The white keys on the piano are of equal width, no matter whether two neighboring keys represent a whole step or a semitone step. In the symmetry model, the pitch classes are not arranged at equal intervals and/or angles, due to the oval/circular arrangement, but at an (angle) interval (distance) which corresponds to the pitch interval and/or pitch step between the two pitch classes. This means that two adjacent pitch classes which correspond to a (smallest) pitch interval of a major third are arranged further apart on the circle and/or the symmetry circle 915 than two pitch classes which have an associated (smallest) pitch interval which corresponds to a minor third. Thus, the distances of the individual pitch classes with regard to each other represent the (smallest) pitch interval of the associated pitches and/or pitch classes.

The exact arrangement and/or positioning of the pitch classes is calculated as follows: first of all, the symmetry circle is divided into 24 segments, which thus all in all correspond to two octaves. Each of these segments represents a semitone step. The opening angle of such a semitone segment is thus 360°: 24=15°. A major third corresponds to four semitones, a minor third accordingly to three semitones. Thus, the following intervals on the circle result: if the tonal interval, i.e. the (smallest) pitch interval between two adjacent pitch classes is a major third, then the angle spanned by the two pitch classes is 4×15°=60°. If the tonal interval between two adjacent pitch classes is a minor third, then the interval/distance is 3×15°=45°.

The pitch classes are subsequently positioned and/or arranged on the circle as follows: the pitch class 350-D, which corresponds to the pitch class D, is arranged at the bottom center of the circle, i.e. under an angle α=180° with regard to the circle center point and a zero direction which runs vertically upwards in FIG. 7. From here, the other pitches are spaced apart symmetrically to the left, i.e. in a clockwise direction, and also to the right, i.e. in a counterclockwise direction. The following Table shows such an example for the exact angles of the pitch classes 350-C to 350-A. It is important to note here, however, that also a deviating distribution is possible regarding the angles.

| Pitch classes | Angle α | Reference numeral |
|---|---|---|
| E | +030° | 350-E |
| G | +075° | 350-G |
| B | +135° | 350-B |
| D | ±180° | 350-D |
| F | −135° | 350-F |
| A | −075° | 350-A |
| C | −030° | 350-C |

To illustrate the arrangement of the pitch classes 350-C to 350-A in a better way, a plurality of dotted orientation lines are plotted starting from the circle center in FIG. 7.

The pitch D (350-D) is referred to as the symmetry pitch as it is the only pitch which lies exactly on the symmetry axis 360 and because all other pitches of the scale are arranged mirror-symmetrically around this pitch. Opposite the symmetry pitch, the tonal center 930 is located (D=0°). It is referred to as the tonal center because common melodies in western latitudes usually start with pitches and end with pitches which are close to the tonal center.

From the above-described arrangement of the pitch classes 350-C to 350-A, implicitly a number of connections regarding music theory open up, which currently still have to be learned with much effort. The symmetry model is especially also suitable for infants, as it allows a linking between geometrical positions and tonal connections. By this, it is a lot easier for the infant to learn connections regarding music theory later on.

In the following sections, an illustration of tonal connections and/or connections regarding music theory are summarized and/or repeated, which are conveyed by the symmetry model.

1. The child may assign consonantly and dissonantly sounding pitch combinations. Dissonantly sounding pitch combinations are characterized by remotely positioned pitch class combinations. Adjacent pitch classes, however, result in consonantly sounding pitch combinations. The further two pitch classes are apart, the more dissonant the represented pitch combination will sound.
2. The child learns the setup of the most common major and minor chords. A selection of pitches, chords and harmonies are indicated in the following: One single pitch class represents one single pitch of the scale. Two adjacent pitch classes represent a third. Three adjacent pitches represent a major, minor or diminished triad. Four adjacent pitches represent a seventh chord. Five adjacent pitch classes represent a 7th-9th chord. By this, a child may easily learn the setup of triads and $4^{th}$ chords.
3. The child playfully learn to assign major chords and parallel minor chords. This is possible, because the pitch classes of the major chord and its parallel minor chord are arranged adjacently on the symmetry circle (Example: C major chord C-E-G and parallel a minor chord A-C-E)
4. The child automatically gets to know the common pitches of different chords. For example, the a minor chord and the C major chord have the two common pitch keys C and E. On the symmetry circle, those common pitches are represented by the same pitch classes. The child further automatically learns from which chords mixed chords are put together. For example, the a minor 7th chord is put together from the chords a minor and C major.
5. The child also learns connections regarding functional theory and/or music theory: the pitch classes of tonic chords (a minor and C major) are arranged centrally, those of subdominant chords (F major and d minor) are arranged to the left and those of dominant chords (G major and e minor) to the right of the tonal center 930.
6. The child learns to feel which pitches of a given major and/or minor key have a greater strive for resolution and which pitches have a smaller strive for resolution. The pitches which have a small strive for resolution are arranged close to the tonal center 930, pitches which have a high strive for resolution are placed very far away from the tonal center 930 on the symmetry circle. Example: if you play a melody on the C major scale and end at the pitch h/b minor, we generally have the feeling that the piece has to continue, i.e. to C and/or the third C-E. This feeling is referred to as a strive for resolution.
7. The child can very easily deduce using which chords it can accompany a given pitch of a given key. For this purpose, he/she only has to select adjacent pitch keys which comprise the given pitch. If, for example, the pitch C is given, the child may then accompany this pitch with the pitches C-E-G (adjacent), A-C-E (adjacent), F-A-C (adjacent) or D-F-A-C (adjacent). The child used to have to remember these variants. Now it can deduce the allowed chords by simple geometric connections, which presents a significant advantage of the symmetry circle.
8. The child may easily read from the symmetry circle, what the parallel minor chord and/or the parallel minor key of a certain major key and/or a certain major chord is. The child has to know now, that the base pitch of the parallel minor key in the symmetry model (and in the circle of thirds explained later) is directly to the left, i.e. counterclockwise, next to the base pitch of the major key. The child may thus find out the corresponding minor key.

As children generally do not know names of pitches yet and cannot read the labeling of the pitch classes 350-C to 350A, it would be obvious to optionally provide the pitch classes with a coloring and/or with symbols. One possible coloring is explained in the above-mentioned dissertation by David Gatzsche. Here, the color yellow is assigned to the tonic area which includes the pitch classes C and E. Red or orange are assigned to the dominant area which includes the pitch classes G and B. Blue is assigned to the subdominant area which includes the pitch classes A and F, while the color violet is assigned to the area which includes the pitch class D.

This coloring was chosen with regard to a "thermal feeling", wherein bluish colors are assigned to the subdominant area, as the same implicates "cold". The dominant area has associated reddish pitches here, as "warmth" is associated with the same. The tonic area has the associated color yellow being the "neutral area", while violet is associated with the area in which the subdominant area and the dominant area abut. In areas between the tonic area and the subdominant area, between the tonic area and the dominant area and the area between the subdominant area and the dominant area, here the resulting mixed colors are assigned. In addition to that, the pitch classes, deviating from the illustration in FIG. 7, may be provided with symbols which symbolize the major triads or minor triads and the diminished triad. One possibility is represented by the already explained use of upper case and lower case letters.

The Circle of Thirds

Figure 8:
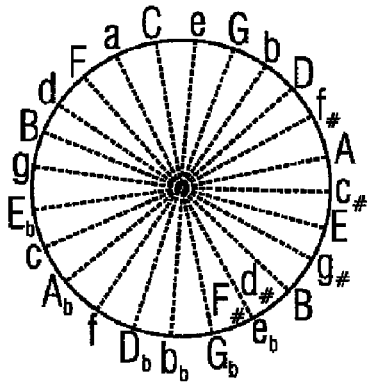
FIG. 8 shows an illustration of a circle of thirds.

In the same way as the symmetry model maps connections within a diatonic key, the circle of thirds illustrates connections across keys, as is illustrated in FIG. 8. The circle of thirds not only maps the seven pitches of a diatonic scale in the pitch space, but all twelve pitches of the chromatic scale, ovally/circularly and/or in a closing arrangement. Further, each base pitch not only occurs once, but twice in the circle of thirds. This is why the circle of thirds contains 24 pitches and/or pitch classes. The order of the pitches basically corresponds to the pitch order of the symmetry model. The pitches are arranged in intervals of thirds, i.e. alternatingly in minor and major thirds. While there is a location of discontinuity in the symmetry model at the location of the diminished chord, i.e. at the symmetry pitch 350-D, such a discontinuity may not be found in the circle of thirds. In contrast to the symmetry model, however, with the circle of thirds no difference is made between a distance of a major third and a distance of a minor third. Rather, the 24 pitch classes are distributed on the circle of thirds equidistantly regarding their angle, i.e. with a distance with regard to an angle of 360°/24=15°. By this arrangement of the basic pitches in the pitch space according to the circle of thirds, a number of connections regarding music theory result which are explained in the following.

Figure 9:
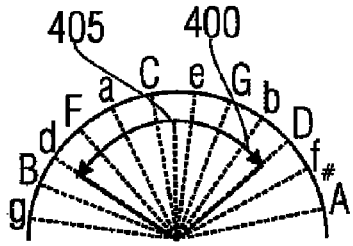
FIG. 9 shows an illustration of the diatonic key C major and/or a minor in the circle of thirds.

FIG. 9 shows a section of the circle of thirds illustrated in FIG. 8. Diatonic keys, like, for example, C major or a minor are illustrated and/or mapped in the circle of thirds by a single continuous segment of a circle. The segment of a circle 400 is limited at both sides by the symmetry pitch D of the key. A symmetry axis 405 passes through the center of the circle segment. If this circle segment 400 is removed out of the circle of thirds and opened like a fan so far that the two straight sides contact, then exactly the symmetry model described in the above paragraphs results. FIG. 9 thus shows an illustration of a diatonic key in the circle of thirds.

Figure 10:
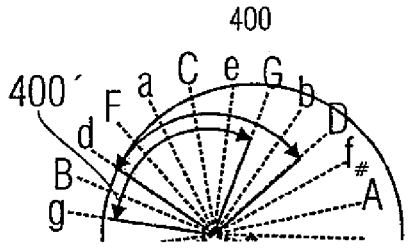
FIG. 10 shows an illustration of the common pitch classes of two adjacent keys at the circle of thirds.

In FIG. 10 the things two adjacent keys have in common are illustrated. For this purpose, in FIG. 10 the already indicated circle segment 400 which corresponds to the key C major and/or a minor is illustrated together with a further circle segment 400', which corresponds to the key F major. Neighboring keys like C major and F major are thus directly next to each other in the circle of thirds. In the illustration selected in FIG. 10, common pitches are thus in an area represented by overlapping circle segments.

Figure 11:
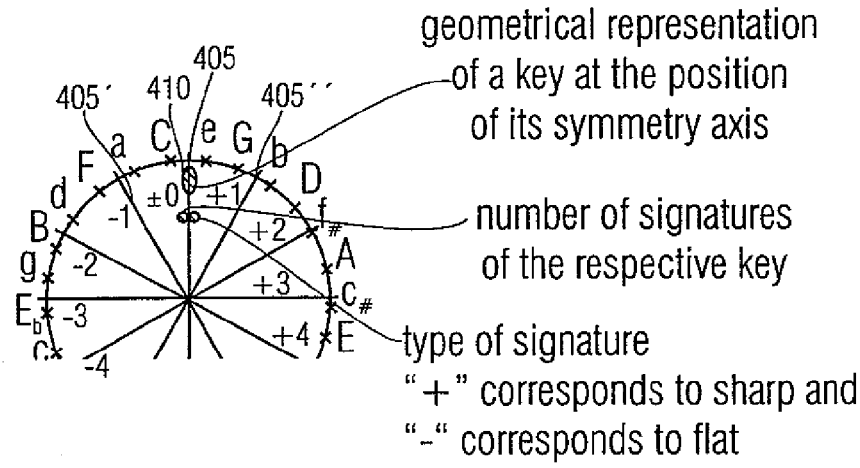
FIG. 11 shows an illustration of contexts regarding music theory at the circle of thirds.

With regard to a section of the circle of thirds, FIG. 11 illustrates that the symmetry axis of a diatonic key, for example the symmetry axis 405 of the key C major exactly passes through a center of mass 410 of the circle segment 400 representing the key. In other words, the center of mass 410 of the area 400 of a diatonic key (in FIG. 11 of the key C major) is located at the position of the symmetry axis 405. For this reason it is sensible to represent keys like C major or a minor not at the location of their keynote, i.e. the pitches C (major) and/or a (minor), but at the location of their symmetry axis 405.

The circle of thirds is further perfectly suitable for illustrating relationships between keys. Related keys, i.e. keys which have many common pitches, are illustrated adjacently in the circle of thirds. Keys which have little to do with each other are positioned remotely in the circle of thirds. Based on the symmetry axis 405 of the key C major and/or a minor, thus also the type and the number of key signatures belonging to a key may easily be determined. Thus, for example in FIG. 11 a symmetry axis 405' of the key F major is indicated which is rotated 30° counterclockwise in the circle of thirds with regard to the symmetry axis 405. The keys C major and F major are only slightly different with regard to the seven pitches of the underlying diatonic scale. Only the pitch b and/or H is replaced by the semitone which lies below the same by one minor second, so that the key F major compared to the key C major has an additional signature (b flat). A corresponding consideration also holds true for the key G major represented by a symmetry axis 405". In contrast to the key F major, the key G major has a # as a signature. Accordingly, the symmetry axis 405" for the key G major is rotated clockwise by 30° in the circle of thirds compared to the symmetry axis 405 for the key C major.

Figure 12:
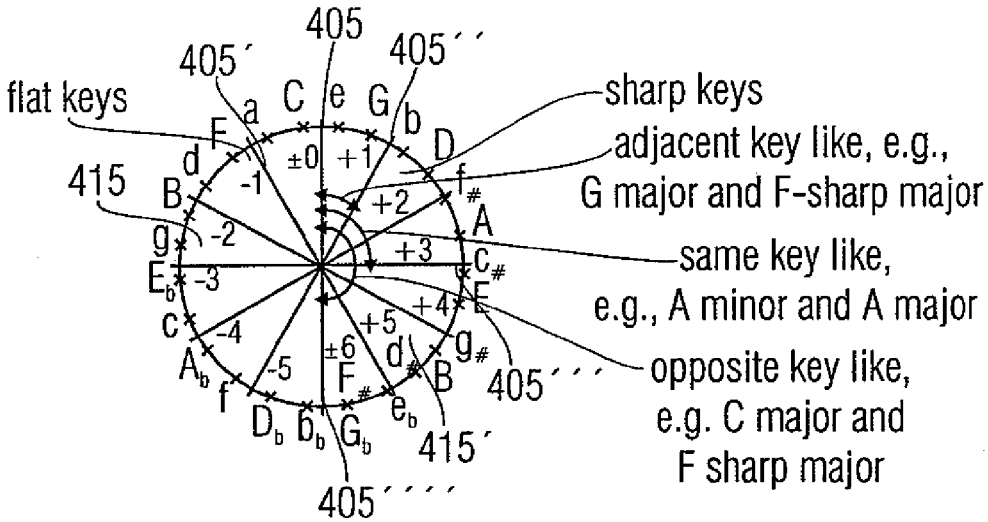
FIG. 12 shows an illustration of the relationships between keys in music theory at the circle of thirds.

This consideration may also be used for all further keys, as it is also illustrated in FIG. 12. Thus, all flat keys occupy the left half of the circle and/or the circle of thirds. These keys all have a negative signature/sign (−). The sharp keys which have a positive signature (+) occupy the right half 415' of the circle and/or the circle of thirds. Keys of the same letter, such as a minor and A major, are positioned at a distance of 90° in the circle of thirds, as a comparison of the symmetry axes 405 and 405'" shows. Further, the circle of thirds illustrates that keys which have very little to do with each other are positioned far apart from each other. Thus, e.g. opposite keys, such as C major with the symmetry axis 405 and F sharp major with a symmetry axis 405"" are positioned exactly opposite from each other, i.e. in an angular distance of 180°. FIG. 12 thus shows that the circle of thirds may map/indicate relationships between keys very well.

Figure 13:
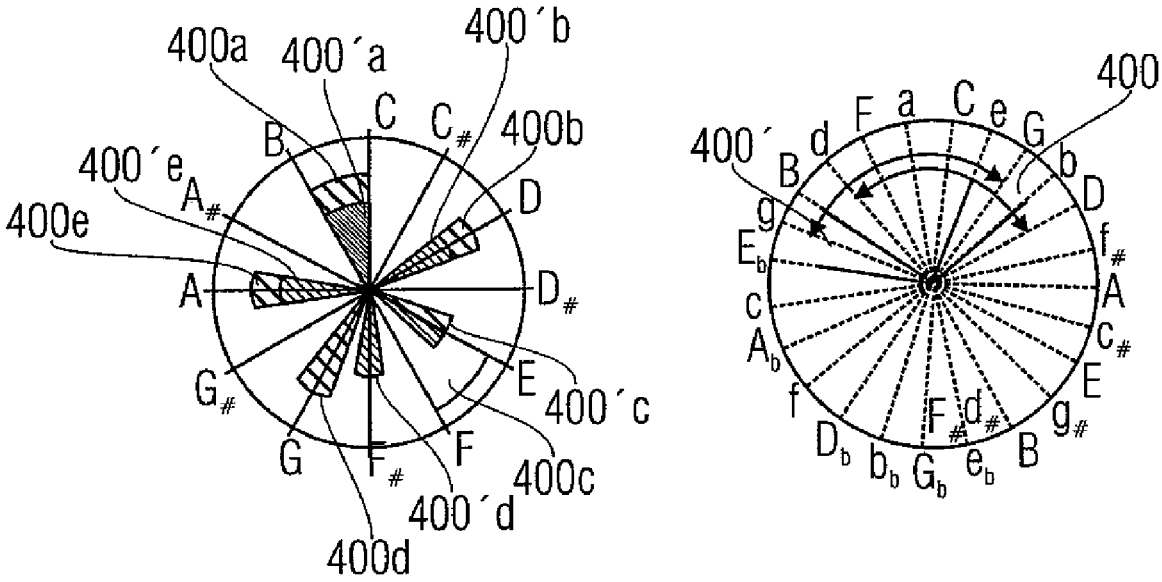
FIG. 13 shows an illustration of two adjacent keys in a chromatic arrangement of the pitch classes (left) and an arrangement of the pitch classes corresponding to the circle of thirds (right)

FIG. 13 illustrates that, in contrast to other base pitch arrangements, like, e.g. a chromatic arrangement which is illustrated on the left in FIG. 13, common pitches of adjacent keys in the circle of thirds are next to each other without gaps in between, as the right side of FIG. 13 illustrates. Thus, on the right side in FIG. 13, the circle segment 400 belonging to the key C major and the circle segment 400' belonging to the key F major are illustrated. The illustration on the right side of FIG. 13 thus corresponds to an arrangement of thirds and/or arrangement of the circle of thirds. A chromatic base pitch arrangement is confronted with this arrangement in FIG. 13. The individual segments 400*a*-400*e* and the circle segments 400'*a*-400'*e* correspond to the circle segments 400 and/or 400', as they are illustrated on the right in FIG. 13. FIG. 13 thus shows that the circle of thirds, compared to a chromatic base pitch arrangement, illustrates relationships between adjacent keys in a significantly better way.

Figure 14:
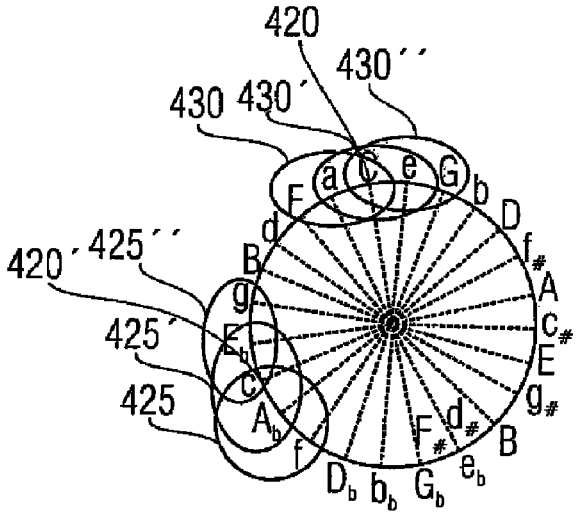
FIG. 14 shows an illustration of the principle of the sixfold pitch utilization based on the example of the pitch class C in the circle of thirds.

FIG. 14 shows that the principle of a six-fold use of pitches in the circle of thirds is perfectly mapped and/or illustrated. Based on the example of the pitch and/or pitch class C, FIG. 14 shows the Riemann principle of six-fold pitch utilization. According to this principle, a pitch may be a base pitch, a third and a fifth both of a minor chord and also of a major chord. The pitch and/or the pitch class C appears at two positions 420, 420' in the circle of thirds. In more detail, the pitch C occurs in a major context (C major), which corresponds to the position 420, and in a minor context (c minor), which corresponds to the position 420'. The pitch C is here part of the chords f minor (area 425), A flat major (area 425') and c minor (area 425"). Further, the pitch C is part of the chords F major (area 430), a minor (area 430') and C major (area 430"). Thus, the symmetry model reflects the principle of Riemann on the six-fold pitch utilization. As illustrated in FIG. 14, these connections may be deduced from the circle of thirds very easily. It remains to be mentioned that further the base pitches of major chords and parallel minor chords are directly adjacent.

It is a further positioning alternative for the circle of thirds and the symmetry model (symmetry circle) to mirror the circle of thirds and/or the symmetry model each around an axis which runs horizontally in the figures, so that in the case of the symmetry model the tonic area of a certain (major) key lies at the bottom, while the diminished area would go to the top. This would offer different didactic advantages. In particular, it is thus possible to perform a pendulum analogy between a (western) piece of music and a description, for example in the symmetry model. A (attenuated) pendulum is deflected into one direction, then swings for a while and comes to rest. The stronger the pendulum is deflected to one side, the stronger it will also swing in the other direction.

A pendulum which, for example, is hung up at a central point of the symmetry model, as it is, for example, illustrated in FIG. 7, which is, however, mirrored around the horizontal axis, is initially hung up deflected in the tonic range. When it is excited to swing, it starts to swing and after a while again ends up in the tonic area. The stronger the pendulum is deflected in this case, for example, into the subdominant area, the stronger it subsequently swings into the dominant area. Many harmonic courses of very popular chord sequences in western music here follow the principle that after chords positioned in the subdominant area often chords follow which lie in the opposing dominant area. Further, many songs and pieces of music end in the tonic area which impressively completes the analogy to a swinging pendulum, as described above.

Even if, within the scope of the present application, the circle of thirds, as it is, for example, illustrated in FIG. 8, and the symmetry model, as it is, for example, illustrated in FIG. 7, are described and illustrated uniformly, of course also a horizontally and/or vertically mirrored positioning variant of the base pitches in the pitch area may be used. In addition to that, any arrangement of the base pitches rotated around any angle and/or a positioning variant of the base pitches mirrored around any axis in the plane may be used. Even if the illustration of the embodiments within the scope of the present invention is generally based on an arrangement of the base pitches in the symmetry model (see FIG. 7) and the circle of thirds (see FIG. 8), this is not to be regarded in a limiting sense. Mirrored or rotated base pitch arrangements may thus, for example, be used within the context of a display device of an inventive system, like e.g. a measurement system or a system.

Mathematical Model Description

Pitch Class

As it has already been described in the introductory paragraphs of the present invention, reference is made to a pitch class when, regarding a pitch, it may be disregarded to which octave it belongs. On the piano the twelve pitch classes D, D sharp, E, F, F sharp, G, G sharp, A, A sharp, B, C and C sharp are defined, wherein in this enumeration the indication of enharmonic equivalencies has been omitted for clarity. Each pitch class t has an associated basic index $m_t$ and an extended index $n_t$. The basic index $m_t$ and the extended index $n_t$ are both integer numbers, wherein Z illustrates the amount of integer numbers. The following applies:

$$0 \leqq m_t \leqq 11, m_t \epsilon Z \tag{1}$$

$$-\infty < n_t < +\infty, n_t \epsilon Z \tag{2}$$

The basic index $m_t$ is a one-time or unique numbering of all 12 pitch classes. The extended index $n_t$ deals with the fact that the pitch classes logically form a circle and/or may be arranged periodically on the same, wherein after the last pitch class again the first pitch class follows. For this reason it is desirable that the extended index $n_t$ may be counted on infinitely. Each pitch class thus has many extended indices. Using the following calculation rules the basic index and the extended index may be converted into each other:

$$n_t = m_t + k \cdot 12, k \epsilon Z \tag{3}$$

$$m_t = [(n_t \bmod 12) + 12] \bmod 12 \tag{4}$$

It is an important question which pitch class t is provided with which basic index $m_t$. According to the prior art, the pitch and/or pitch class C is provided with the basic index $m_t=0$ to indicate the fact that this pitch is the base pitch of the simplest key C major which has no signature. At this point within the scope of the present application a different definition is used, however, which leads to some simplifications for the following calculations: the basic index $m_t=0$ is not associated to the pitch C, but to the pitch D, because the pitch D is the symmetry pitch of the key C major which has no signature and thus also forms the geometric center of mass of the key in the third and symmetry circle. Thereby, the following index assignment and/or assignment of basic indices $m_t$ to the pitch classes t results, which is illustrated in the following Table 1. The following applies:

| | Pitch class t | | | | | | | | | | | |
|---|---|---|---|---|---|---|---|---|---|---|---|---|
| | D | D sharp | E | F | F sharp | G | G sharp | A | A sharp | B | C | C sharp |
| Basic index $m_t$ | 0 | 1 | 2 | 3 | 4 | 5 | 6 | 7 | 8 | 9 | 10 | 11 |

Circle of Thirds

The circle of thirds consists of 24 pitches in a distance of major and minor thirds. These pitches are referred to as real pitches r because they represent actually sounding pitches. To be able to place the real pitches r geometrically on the circle of thirds, an addition of auxiliary pitches h is required. Two adjacent auxiliary pitches have a semitone interval (second) and, similar to the pitch classes, they have a basic index $m_h$ and an extended index $n_h$. Two adjacent auxiliary pitches thus have the extended indices $n_h$ and $(n_h+1)$. Similar to the above paragraph, the following applies:

$$-42 \leqq m_h < +42 \tag{5}$$

$$-\infty < n_h < +\infty \tag{6}$$

The auxiliary pitches h are used to define the semitone raster consisting of 84 elements which lies behind the circle of thirds: the basic index $m_h$ of the auxiliary pitches h does not go from 0 to 11 like with the pitch classes, but from −42 to +41, as equation 5 shows. Auxiliary pitches which contribute to the definition of keys having a negative signature (flat keys) thus obtain a negative signature. Auxiliary pitches which contribute to the definition of keys with a positive signature (sharp keys and/or # keys) have a positive signature. The basic index $m_h$ and the extended index $n_h$ may be converted into each other according to the following rule:

$$n_h = f_1(m_h) = m_h + 84 \cdot k,\ k \in Z \tag{7}$$

$$m_h = f_2(n_h) = \left\{84 + \left[\left(n_h + \frac{84}{2}\right) \bmod 84\right]\right\} \bmod 84 - \frac{84}{2} \tag{8}$$

To each auxiliary pitch h having the extended index $n_h$, a pitch class t having the extended index of the pitch class $n_t$ is associated. By the definition of Table 1, no conversion of the indices $n_h$ and $n_t$ into each other is required. Rather, for the pitch class t of an auxiliary pitch h having the extended index $n_h$ it applies that the extended index $n_t$ of the pitch class t corresponds to the extended index $n_h$ of the auxiliary pitch. Thus, the following equation applies:

$$n_t(n_h) = n_h \tag{8a}$$

The conversion of the extended index $n_t$ into the basic index $m_t$ of the pitch classes t is then performed according to equation 4. The following table 2 exemplarily shows the assignment of pitch classes t having the extended index $n_t$ to auxiliary pitches h having the extended index $n_h$ and/or vice versa:

| | | | | | | | | |
|---|---|---|---|---|---|---|---|---|
| $n_h$ | −42 | −41 | ... | 0 | ... | 40 | 41 | 42 |
| $n_t = n_h$ | −42 | −41 | ... | 0 | ... | 40 | 41 | 42 |
| $m_t = f_3(n_t)$ | 6 | 7 | ... | 0 | ... | 4 | 5 | 6 |
| T | G-sharp | A | ... | D | ... | F-sharp | G | G-sharp |

Geometrically, each auxiliary pitch h having the extended index $n_h$ may also be represented and/or presented as the vector $\vec{h}_{n_h}$. This vector $\vec{h}_{n_h}$, as compared to a zero vector, has an angle $\alpha$. The calculation of the angle $\alpha$ is here performed such that the auxiliary pitch h with the extended index $n_h=0$ has the angle 0°. A vector $\vec{h}_0$ is associated to the auxiliary pitch h having the extended index $n_h=0$. The vector $\vec{h}_0$ is thus designated as the zero vector. Thus, the pitch class and/or the pitch D is associated with the auxiliary pitch h having the extended index $n_h=0$.

Apart from the angle $\alpha$, also a length and/or a magnitude (absolute value) is associated to each auxiliary pitch, which is in the following also referred to as energy s of the auxiliary pitch. In other words, the energy s of the auxiliary pitch h reappears in the form of the absolute value of the vector $\vec{h}_{n_h}$. The following applies:

$$\vec{h}_{n_h} = s \cdot e^{j\alpha} = s \cdot e^{j2\Pi\frac{n_h}{84}} \tag{9}$$

wherein the formula symbol j is the imaginary variable. The following applies:

$$j=\sqrt{-1}; j^2=-1 \tag{9a}$$

Apart from the auxiliary pitches h, there are also the real pitches r. The real pitches are the 24 pitches actually present on the circle of thirds and form a subset of the set of auxiliary pitches $M_h$. Each pitch r is either the base pitch of a major chord (+) or the keynote/base pitch of a minor chord (−). For this reason, the set of real pitches $M_r$ may be divided into a subset $M_{r+}$ and $M_{r-}$. The following applies:

$$M_{r\pm}:=\{h_{n_h} | n_h=7k\pm2, k\in Z\} \tag{10}$$

With the help of the mathematical fundamentals declared so far it is also possible to represent pitch mixes in the circle of thirds. Here, a vector $\vec{r}$ is associated to each real pitch r. A sum of two real pitches $r_a$ and $r_b$ in the circle of thirds may thus be realized by the sum of the vectors $\vec{r}_a$ and $\vec{r}_b$ belonging to the two real pitches $r_a$ and $r_b$. The result of such a summation is the so-called sum vector $\vec{r}_{sum}$, which points to the geometric center of mass of the two pitches:

$$\vec{r}_{sum}=\vec{r}_a+\vec{r}_b \tag{11}$$

Each pitch class t reappears on the circle of thirds in the form of two real pitches r, i.e. once as a base pitch of a major chord $r_{nr+}$ and as the base pitch of a minor chord $r_{nr-}$. Equation 12 shows a calculating rule, using which the associated real pitches $r_{nr-}$ and $r_{nr+}$ of a circle of thirds associated to a given pitch class t having an extended index $n_t$ may be found.

$$n_{nr\pm}=f(n_t)=7^2 n_t\pm12 \tag{12}$$

It was noted above that a set of real pitches in the circle of thirds may be described by a sum vector $\vec{r}_{sum}$. It was further determined that each pitch class t reappears in the form of two real pitches $r_{nr-}$ and $r_{nr+}$ in the circle of thirds. Thus, it is possible to represent a pitch class t with an extended index $n_t$ by a sum vector $$\vec{r}_{sum}=\vec{r}_{nr-}+\vec{r}_{nr+} \tag{12a}$$

in the circle of thirds. The following applies:

$$\vec{r}_{sum} = \vec{r}_{nr-} + \vec{r}_{nr+} = e^{j2\pi\frac{nr-}{84}} + e^{j2\pi\frac{nr+}{84}} \tag{13}$$

-continued $$= e^{j2\pi\frac{7^2 n_t-12}{84}} + e^{j2\pi\frac{7^2 n_t+12}{84}} \approx 1.25 \cdot e^{j2\pi\frac{7^2 n_t}{84}}$$

The factor 1.25 results for all pitch classes and may thus be disregarded. Using the connections of equation 13 it is possible to represent a set of pitch classes $M_t$ by a circle of thirds sum vector $\vec{r}_{sum}$. The following applies:

$$\vec{r}_{sum} = f_4(M_t) = \sum \vec{r}_{sum_t} \text{ mit } \vec{r}_{sum_t} = s_{n_t} \cdot e^{j2\Pi\frac{7^2 n_t}{84}}, n_t \in M_t \tag{14}$$

From the circle of thirds sum vector in turn the key and/or signature number v and the type of signatures may be derived. The circle of thirds sum vector has an angle $\alpha$ which fulfils the relationship $$\alpha = \frac{2\Pi n_{h_{sum}}}{84} \tag{15a}$$

wherein $n_{hsum}$ represents the "extended index" of the circle of thirds auxiliary pitch to which the sum vector $\vec{r}_{sum}$ points. The following applies:

$$n_{h_{sum}} = \frac{84\alpha}{2\pi} \tag{15b}$$

so that for the number of signatures v the following applies:

$$v = \frac{n_{h_{sum}}}{7} = \frac{84\alpha}{14\Pi} = \alpha\frac{6}{\Pi} \tag{15c}$$

It is further interesting that the circle of thirds sum vector $\vec{r}_{sum}$ belonging to a pitch class t is identical to the symmetry vector of the key represented by the pitch class. Thus, for example for the pitch class D, the following applies:

$$\vec{r}_{sum}(t=D)=\vec{h}_0 \tag{15d}$$

Symmetry Circle

The mathematical description of the symmetry circle is similar to the description of the circle of thirds. The following explanations only hold true for diatonic keys without signatures like C major or a minor. To be able to illustrate the following embodiments also for transposed versions, a so-called transposition factor $\tau$ has to be introduced to consider the fact that the symmetry circle relates to a certain diatonic key. The symmetry circle and/or the cadence circle of the symmetry model contains seven real pitches $r_m$ in a distance of minor and major thirds. The same are placed on a semitone raster consisting of 24 auxiliary pitches h. Each of the auxiliary pitches also has a basic index $m_h$ and an extended index $n_h$, with the help of which an auxiliary pitch h may be uniquely identified on the circle of thirds. The following applies:

$$-12\leqq m_h<+12 \tag{16}$$

$$-\infty<n_h<+\infty \tag{17}$$

The indexing of the auxiliary pitches h in the circle of thirds is selected such that auxiliary pitches h having a negative index, in particular a negative basic index $m_h$ belong to the subdominant area and auxiliary pitches h with a positive index and/or a basic index $m_h$ belong to the dominant area. A very small absolute index value $|m_h|$ indicates that the real pitch r is close to the tonic area and/or the tonal center. The absolute value of the index $|m_h|$ is a measure for how far a pitch is apart from the tonic area and/or the tonal center. Thus, the basic index $m_h$ and the extended index $n_h$ may be converted into each other according to the following rule:

$$n_h = f_5(m_h) = m_h + 24 \cdot k,\ k \in Z,\ \tau \in Z \tag{18}$$

$$m_h = f_6(n_h) = \left\{24 + \left[\left(n_h + \frac{24}{2}\right) \bmod 24\right]\right\} \bmod 24 - \frac{24}{2} \tag{19}$$

The assignment of a pitch class t with an extended index $n_t$ to an auxiliary pitch h with an extended index $n_h$ happens in the same way as with the circle of thirds: by the selected indexing of the pitch classes according to Table 1, a conversion of the indices of the pitch classes $n_t$ into the indices of the auxiliary pitches of the symmetry circle $n_h$ is not required. The following applies:

$$n_h = n_t \tag{20}$$

The real pitches of the symmetry circle r are a subset of the auxiliary pitches. The real pitches of the symmetry circle may be divided into three groups: into real pitches forming the base pitch of a 1. major chord ($r_{n+}$),
2. a minor chord ($r_{n-}$) or
3. a diminished chord ($r_{n0}$)

The set of real pitches $M_r$ is set up as follows:

$$M_r := M_{r\pm} \cup M_{r0}$$

$$M_{r\pm} := \{h_n, n = 7k \pm 2, |k| \leqq 1\} \tag{21}$$

$$M_{r0} := \{h_{12}\}$$

Each auxiliary pitch h with the extended index $n_h$ may also be represented as a vector $\vec{h}_{nh}$. Also this vector $\vec{h}_{nh}$ comprises an angle α which is here selected such that the symmetry pitch of the key $h_0$ represented by the symmetry circle has the angle 0. The vector $\vec{h}_0$ is therefore also called the zero vector. Also in this case again the absolute value and/or the length of the vector is referred to as energy s. In other words, the energy of the pitch is indicated using the formula sign s:

$$\vec{h}_{nh} = s \cdot e^{j\alpha} = s \cdot e^{j2\Pi \frac{n_h}{24}} \tag{22}$$

A set of given pitch classes $M_t$ may also be described by a sum vector $\vec{r}_{sum}$ in the symmetry circle. The symmetry circle does not contain all pitches, but only the pitches of the selected diatonic key. If one wants to represent an amount (a set) of given pitch classes $M_t$ on the circle of thirds, first of all the intersection $M_t \cup M_r$ has to be formed from the given pitch classes $M_t$ and the real pitches present on the symmetry circle and/or the amount of real pitches $M_r$ present on the symmetry circle. For this intersection, subsequently the sum vector $\vec{r}_{sum}$ may be formed.

$$\vec{r}_{sum} = f_7(M_t) = \sum \vec{r}_n \text{ mit } \vec{r}_n = s_n \cdot e^{2\Pi \frac{n}{24}},\ n \in M_t \cap M_r \tag{23}$$

Symmetry Model-Based and Circle of Thirds-Based Harmony Analysis

On the basis of the hitherto laid fundamentals, i.e. the synthesis and analysis of sensibly sounding pitch combinations, the introduction into different pitch spaces (e.g. symmetry model and circle of thirds) and the mathematical basics for describing the pitch spaces and the sum vectors following therefrom, in the following sections possible scenarios of use for the sum vector are described. The main focus is here on the possibilities, which the sum vector offers as it is provided by the inventive device 100 for analyzing an audio datum in the form of the analysis signal.

Circle of Thirds-Based Harmony Analysis

With the help of a circle of thirds-based key analysis, as it is explained in more detail in the following section, valuable information about content features of an audio and/or pitch signal may be obtained. In particular, according to equation 13, any amount of pitch classes may be summarized and described in the form of a sum vector $\vec{r}_{sum}$. The same provides valuable conclusions on content features of the underlying audio and/or pitch signal.

As already explained in connection with equations 15a-15c, the angle α of the sum vector $\vec{r}_{sum}$ indicates in which key a piece of music is at a certain point of time. Thus, for example the sum vector has the angle α=0 for the pitch classes of the C major scale. This corresponds exactly to the point on the circle of thirds and/or is exactly at the location where the symmetry pitch and thus the representation of the key C major is located.

The absolute value of the sum vector $|\vec{r}_{sum}|$ is in addition to that an estimate which describes how sure it is that a certain diatonic key is present and/or how defined the tonal context is. If the absolute value is very high, then it is quite sure that the pitch classes belong to a certain key. In other words, with an increasing absolute value of the sum vector $|\vec{r}_{sum}|$ the probability increases that the pitch classes belong to a certain key. If the absolute value is very small, however, either only very few different pitch classes are present, so that the key may not be reliably determined, or the pitch classes belong to completely different keys.

Figure 15:
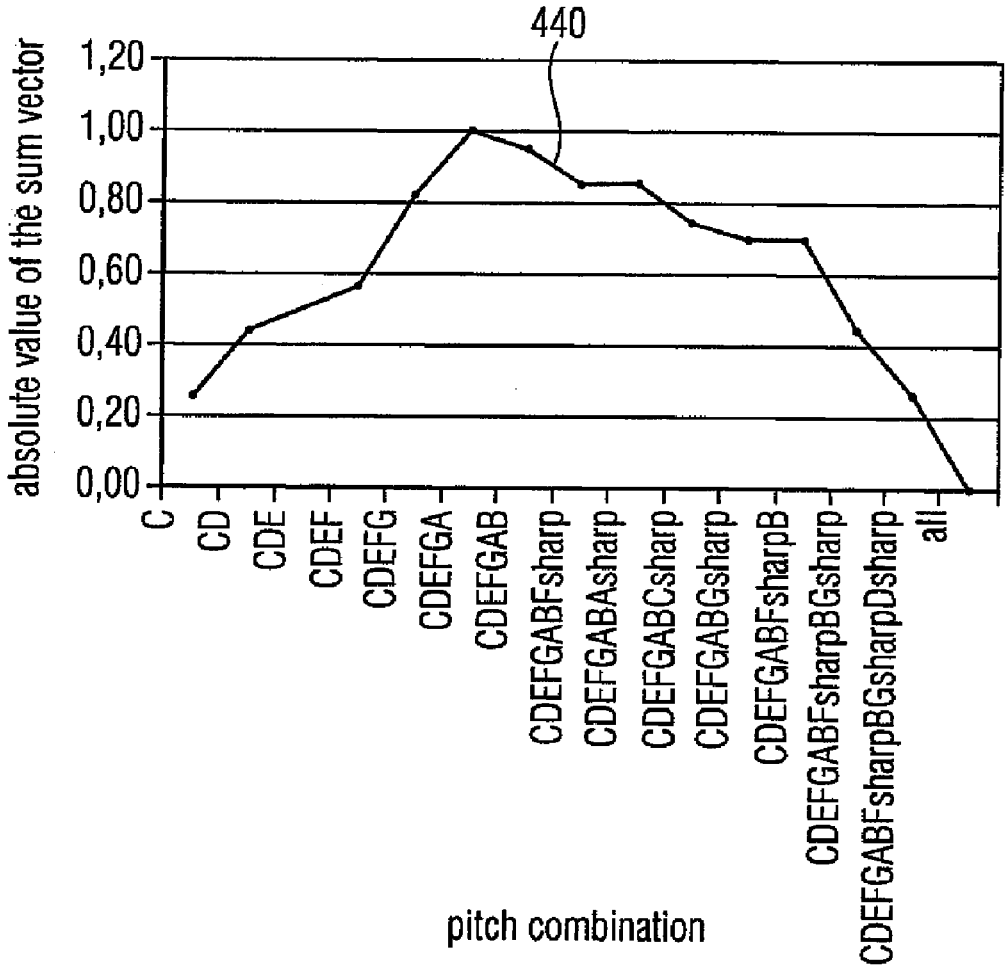
FIG. 15 shows an illustration of the course of a length of the circle of thirds sum vector for different pitch class combinations.

FIG. 15 shows an example for the definedness of the tonal context for different pitch combinations. In particular, FIG. 15 shows a course 440 of the absolute value of the sum vector for different pitch combinations and/or pitch class combinations plotted on the abscissa. The absolute value of the sum vector $|\vec{r}_{sum}|$ increases for so long and/or basically remains at its length as long as pitch classes belonging to the key are added to the amount of pitch classes. Thus, the absolute value of the sum vector increases, based on the individual pitch class C, by adding further C major scale pitch classes, until the same reaches a maximum value in a pitch class combination CDEFGA. Adding the pitch class B and/or H also belonging to C major only results in a slight decrease. Adding further pitch classes of another key, however, causes a clear decrease of the absolute value of the sum vector. The absolute value of the sum vector thus decreases again as soon as pitch classes of other keys are added. This means, the greater the absolute value of the sum vector, the higher the probability that a certain key is present. The absolute value of the sum vector is thus a measure for the definedness of the tonal context.

Apart from that, the sum vector provides information about a change of key and/or modulations: a key occupies an area of 24 semitone steps on the circle of thirds. This corresponds to an angle of $4/7\pi$. If a piece of music remains within the limits of a diatonic key, then the sum vector $\vec{r}_{sum}$ moves within a circle segment which does not exceed this opening angle. If the sum vector $\vec{r}_{sum}$ leaves such a circle segment, however, probably a change of key has occurred.

Figure 16:
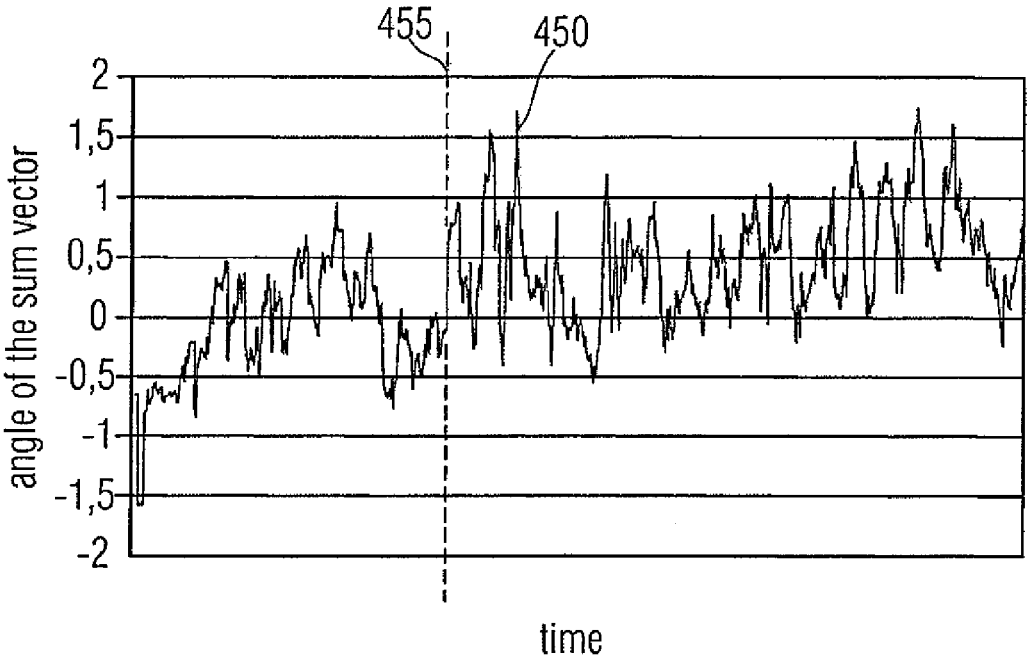
FIG. 16 shows an illustration of the course of an angle of the circle of thirds sum vector over time for the first ten seconds of the Brandenburg Concerto by Bach (No. 1, Allegro)

FIG. 16 shows such a course of the angle of the circle of thirds sum vector $\vec{r}_{sum}$ in a piece by Bach. In more detail, FIG. 16 shows a course 450 of the angle of the sum vector $\vec{r}_{sum}$ for the first ten seconds of Bach's Brandenburg Concerto No. 1, Allegro. Changes of chord and Changes of key may be detected by means of greater angle changes. An example for this is the point of time which is designated by a dashed line 455. The key represented by an angle may be determined with the help of equations 15a-15c.

The sum vector $\vec{r}_{sum}$ additionally enables correcting analysis errors in the harmony analysis and the key analysis. Modulations into adjacent keys are more probable than modulations into non-adjacent keys. Rare temporary outliers of the angle of the circle of thirds sum vector indicate that an analysis error has to be present with high probability.

It is further possible to differentiate between tonal and non-tonal music with the help of the sum vector $\vec{r}_{sum}$. With non-tonal music, the absolute value of the sum vector is very small. With tonal music, however, it becomes ever longer as a function of time, wherein an integration and/or summation across the complete already elapsed time of the piece of music is performed.

If, in addition to that, the audio signal underlying the analysis is integrated temporally until the absolute value of the resulting sum vector has a maximum, then this allows a conclusion to a change of key. It may here be required to possibly design a criterion regarding the presence of a maximum to be "soft". In other words, short-term deviations of the absolute value or the length of the sum vector may well result here, which are to be attributed to statistical fluctuations of the occurring semitones, without a change of key being present. Accordingly, it may be advisable, in the case of a detection system, as illustrated in FIG. 3E regarding the evaluation device 250, to introduce a corresponding correcting element, for example in the form of a filter element which averages over a time period.

Symmetry Model-Based Harmony Analysis

As it was explained in the last section, for the analysis of connections across keys the circle of thirds and/or the circle of thirds-based harmony analysis is used. With the help of the circle of thirds, thus, for example, the key used at a certain time may be determined from a pitch signal and/or audio signal and/or audio data. If the key is determined and/or given, then the symmetry model may be determined and/or used. This, in turn, is very suitable for determining connections within a key. Also within the scope of symmetry model-based harmony analysis, the sum vector $\vec{r}_{sum}$ introduced in the section on mathematical model description of the symmetry model is used.

From the angle of the sum vector $\vec{r}_{sum}$, the current chord may be estimated, as the same points to the geometrical center of mass and/or the tonal center of the pitch classes played at a certain point of time. In addition to that, from the angle of the sum vector $\vec{r}_{sum}$ changes of chord may be determined and/or analyzed. A sudden change of the angle of the sum vector allows to suggest a change of chords.

Figure 17:
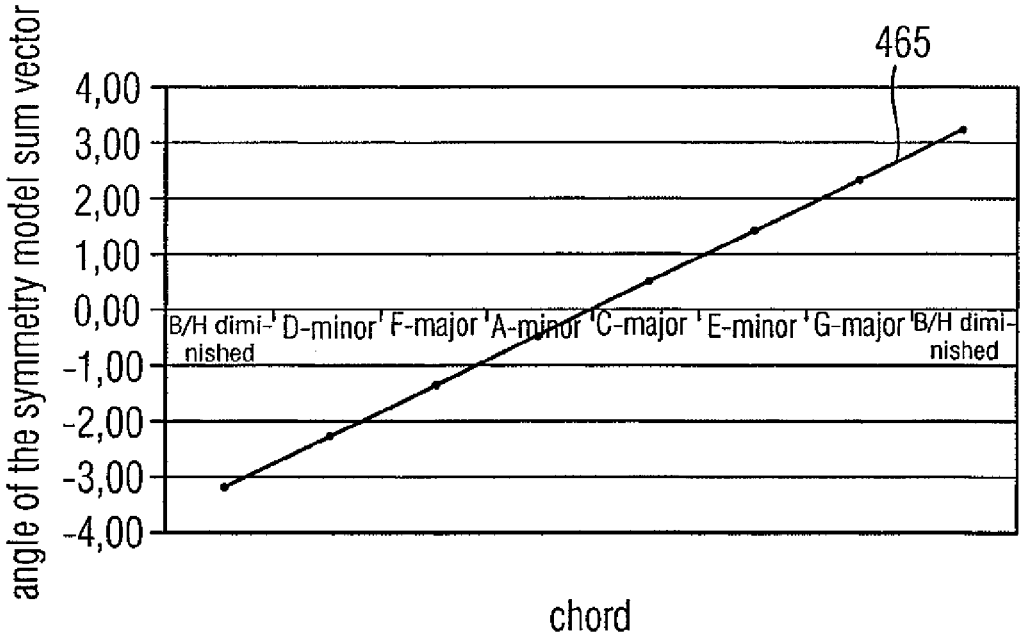
FIG. 17 shows an illustration of the course of an angle of the symmetry circle sum vector for different triads.

The angle of the symmetry circle sum vector again gives an indication whether a pitch combination tends to be associated to the subdominant area, the tonic area or the dominant area. FIG. 17 thus shows a course 465 of the angle of the symmetry circle sum vector (in radian measure) for different chords. FIG. 17 shows that a pitch combination is to be allocated to the subdominant area when the angle has a negative sign. If the angle has a positive sign, however, the pitch combination is to be allocated to the dominant area. The greater the angle of the pitch combination regarding its absolute value, the stronger the pitch combination extends into the corresponding area. An exception to this is the triad B diminished and/or H diminished, to which in FIG. 17 the angles $\pm\pi$ are associated. Here, the special character of the triad B diminished and/or H diminished is reflected which connects the subdominant area and the dominant area with each other, as it is explained in the above-cited dissertations by David Gatzsche. If the absolute value of the angle is very small, however, this allows the conclusion that the pitch combination belongs to the tonic area. In addition to that, the course 465 of FIG. 18 further illustrates the strive for resolution of different chords with regard to the basic key C major and/or a minor.

Figure 18:
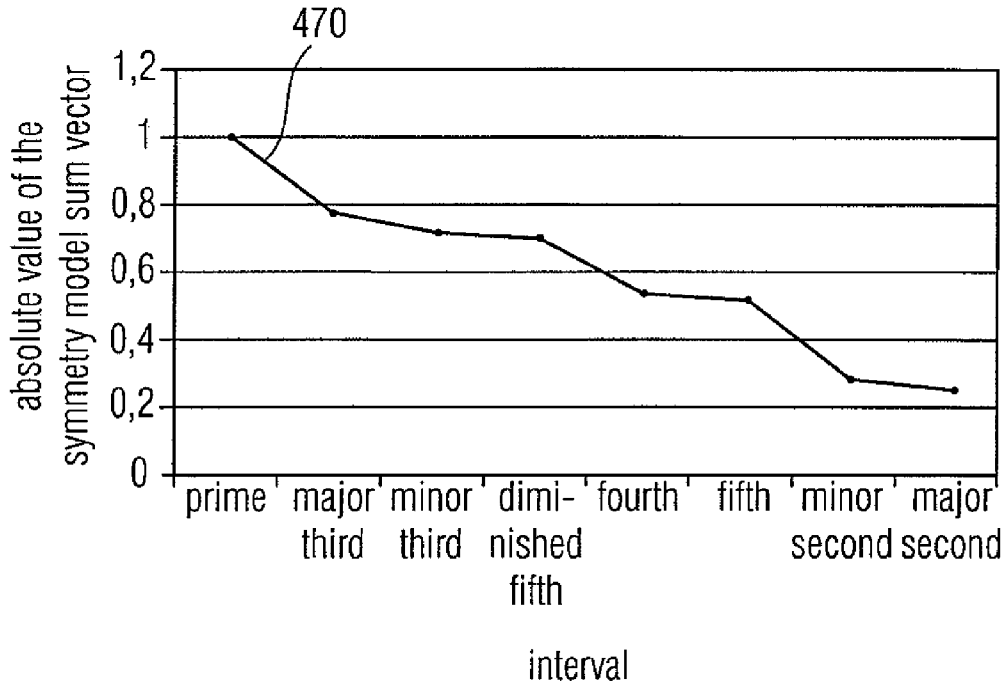
FIG. 18 shows an illustration of the course of the length of a symmetry circle sum vector for different intervals.

FIG. 18 thus shows the angle of the symmetry circle sum vector for different triads, wherein the symmetry circle is based on the key C major and/or a minor.

From the absolute value of the symmetry circle sum vector $|\vec{r}_{sum}|$, the perceived consonance and/or dissonance, i.e. the pleasantness of a given pitch combination of pitch classes may be estimated. The longer the vector, the more pleasant and/or consonant the analyzed pitch combination is perceived to be. Accordingly, a pitch combination is perceived to be more dissonant and/or unpleasant the shorter the symmetry model sum vector is. In other words, the shorter the vector, the more dissonant and/or unpleasant the perception of the respective pitch combination.

FIG. 18 thus shows a course 470 of the absolute value of the symmetry circle sum vector $|\vec{r}_{sum}|$ for different intervals, i.e. for two pitch classes each which have different intervals and/or pitch intervals regarding each other. Here, the arrangement of the intervals on the abscissa of FIG. 18 was selected with a decreasing consonance and/or pleasantness of the corresponding intervals. FIG. 18 thus shows that the absolute value of the symmetry circle sum vector becomes increasingly smaller with a decreasing consonance and/or pleasantness. The absolute value of the angle of the angle of the symmetry circle sum vector $\vec{r}_{sum}$ may thus be interpreted and/or seen as a measure of estimate for a strive for resolution of a certain pitch combination within the scope of an existing tonal context (key). FIG. 18 illustrates this with regard to the course 470 of the absolute value of the symmetry circle sum vector $|\vec{r}_{sum}|$ for different pitch intervals. In other words, the course 470 thus illustrates that the absolute value of the symmetry circle sum vector $|\vec{r}_{sum}|$ decreases starting from intervals perceived to be consonant and/or pleasant towards intervals perceived to be less consonant and/or pleasant.

Figure 19:
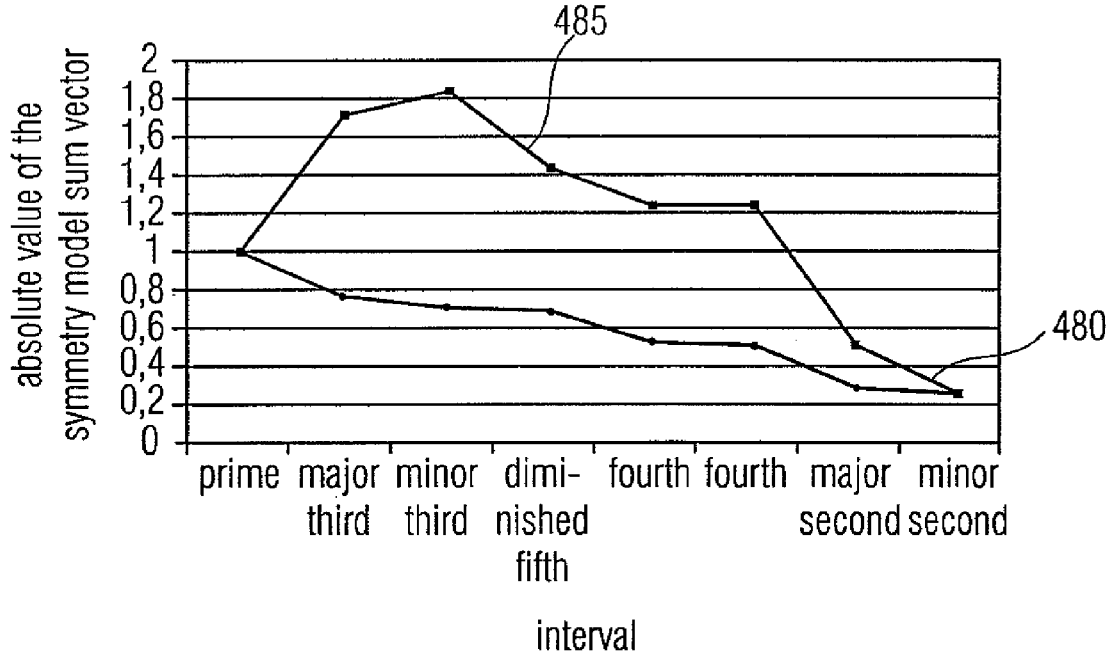
FIG. 19 shows an illustration of two courses of the length of circle of thirds sum vectors for different intervals.
Figure 20:
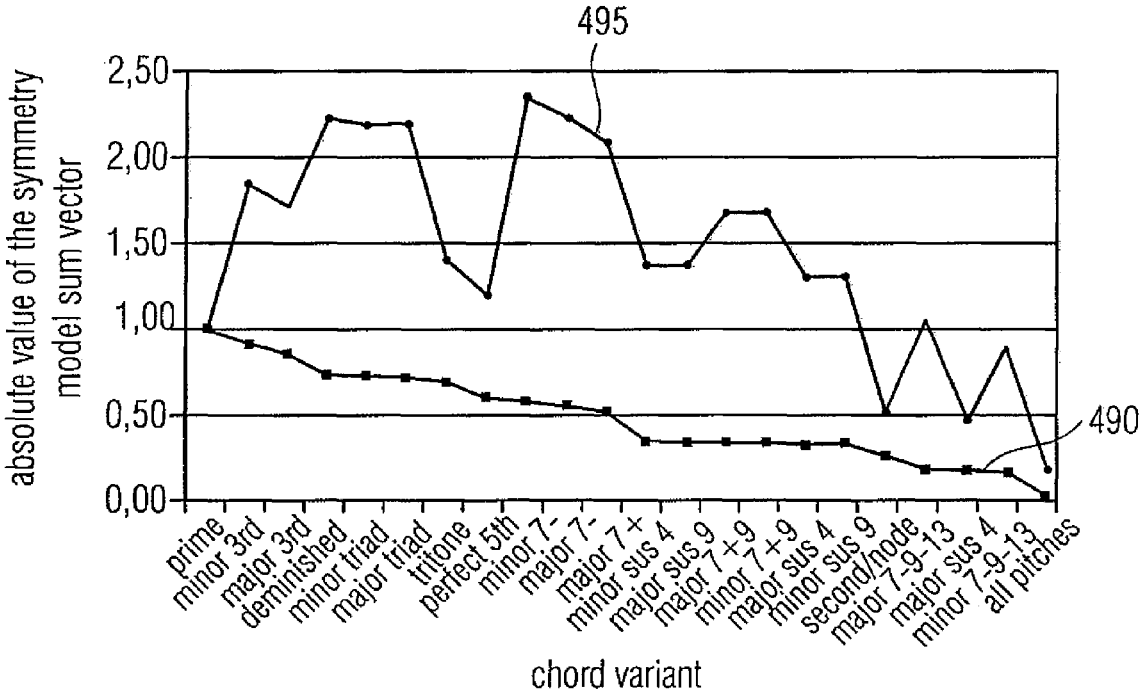
FIG. 20 shows an illustration of two courses of the length of the symmetry circle sum vector for different chord variants and/or pitch combinations.

FIG. 19 shows a course 480 of the absolute value of the symmetry model sum vector $|\vec{r}_{sum}|$ for different intervals, wherein the overall energy is normalized to 1. Here, the calculation of the course 480, but also the courses further below in FIGS. 19 and 20, are respectively based on a vector which contains the energies of the 12 pitch classes and/or the 12 semitones disregarding the octaving. In this context, a normalization to the energy 1 means that each of the semitone energies of the vector is multiplied by a factor such that the sum of the energies of all semitones from the semitone vector, i.e. the sum of the components of the corresponding vector, has the value 1. If, for example, the following semitone vector is given,

| D | D-sharp | E | F | F-sharp | G | G-sharp | A | A-sharp | B | C | C-sharp |
|---|---|---|---|---|---|---|---|---|---|---|---|
| 0 | 0,2 | 0 | 0,3 | 0 | 0 | 0 | 0 | 0 | 0 | 0 | 0 |

the sum of all energies, i.e. the components of the semitone vector, has the value 0.5. By multiplying all components of the semitone vector by a factor of 2 (=1/0.5), the following semitone vector results, whose energy is summed up to the value of 1.

| D | D-sharp | E | F | F-sharp | G | G-sharp | A | A-sharp | B | C | C-sharp |
|---|---|---|---|---|---|---|---|---|---|---|---|
| 0 | 0,4 | 0 | 0,6 | 0 | 0 | 0 | 0 | 0 | 0 | 0 | 0 |

The sum of all energies has now the value of 1.

Apart from that, FIG. 19 shows a further course 485 of the absolute value of the symmetry model sum vector and/or the symmetry circle sum vector for the same intervals, wherein the overall energy is in this case not normalized. Also in FIG. 19, the arrangement of the intervals on the abscissa is selected such that the same are arranged in a decreasing order of the perceived consonance and/or pleasantness of the corresponding intervals. In particular the course 480 shows that the absolute value of the symmetry circle sum vector and/or symmetry model sum vector represents an estimate and/or estimation measure for the consonance and/or pleasantness of different intervals, as the same, like the course 480 shows, illustrates a monotonously decreasing course with a decreasing consonance of the corresponding intervals. The course 485 tends to show the same effect, wherein, due to the fact that with a prime interval only one single pitch class is affected, the absolute value of the symmetry circle sum vector is inevitably smaller than an absolute value of the symmetry circle sum vector which is based on two different pitch classes. As a consequence, the course 485 first increases, starting from the prime interval, in intervals before it shows a further course which is similar to the course 480.

Similar to the courses 480, 485 indicated in FIG. 19, FIG. 20 also shows two courses 490, 495 of the absolute value of the symmetry model sum vector for different, virtually random pitch combinations. In contrast to FIG. 19, in which only intervals, i.e. pitch combinations of a maximum of two pitch classes each are shown, in FIG. 20 different chord variants are shown on the abscissa according to a decreasing consonance and/or pleasantness, beginning with a prime up to a sounding of all pitch classes. The course 490, similar to the course 480 of FIG. 19, is based on a normalization of the overall energy to 1, while the course 495, similar to the course 485 of FIG. 19, is not based on a corresponding normalization of the overall energy.

The course 490 shows, with a decreasing consonance and/or pleasantness of the respective chord variants, a monotonously decreasing course of the absolute value of the symmetry circle sum vector. Starting from a value 1 in the case of a prime, the course 490 continuously drops to a value of approximately 0 when all pitch classes are considered. Accordingly, the course 490 clarifies the suitability of the absolute value of the symmetry circle sum vector as an estimate for the assessment of the consonance and/or pleasantness of different pitch combinations. Here, the course 490 clearly shows that a pitch combination and/or pitch class combination is perceived and/or sensed to be more consonant and/or pleasant, the higher the absolute value of the corresponding symmetry circle sum vector is. In contrast to the course 490, the course 495 shows, similar to the course 485 of FIG. 19, a somewhat more complicated behavior, which may be attributed to the fact that with the different chord variants a different number of pitch classes is affected.

FIGS. 19 and 20 additionally show that also the harmonic definedness of the current chord may be derived from the absolute value of the sum vector. The higher the absolute value of the vector, the more reliably it may be assumed that a harmonically sounding chord is present in the mixture of pitches.

Figure 21:
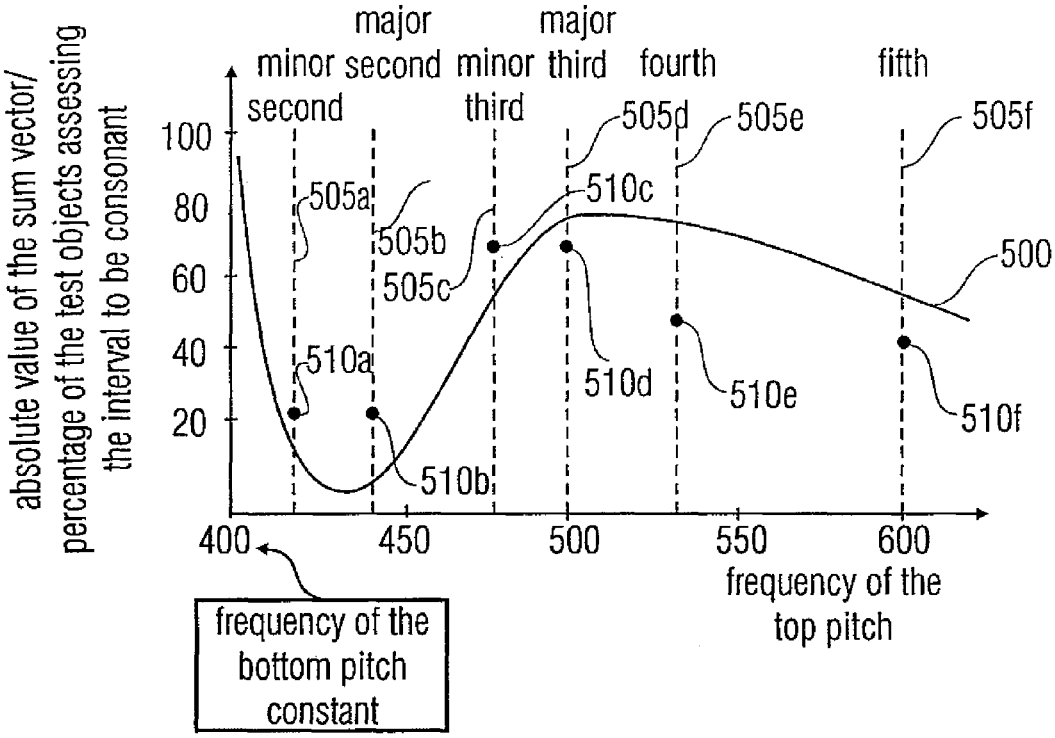
FIG. 21 shows an illustration of the course of a psychometric examination for evaluating the sensation for consonance with regard to the symmetry model.

FIG. 21 shows a result of an evaluation of simultaneous intervals with regard to their consonance according to a psychometric analysis of R. Plomb and W. Levelt, (R. Plomb and W. Levelt, Tonal Consonance and Critical Bandwidth, 3. Accoust. Soc. Am. 38, 548 (1965) cited by Guerino Mazzola in "Die Geometrie der Töne—Elemente der mathematischen Musiktheorie", Birkhäuser-Verlag, 1990). In particular, FIG. 21 shows a course 500 which indicates a percentage of test subjects who assessed an interval to be consonant depending on a frequency of an upper pitch within the scope of the psychometric analysis of Plomb and Levelt. Within the scope of the psychometric analysis of Plomb and Levelt, apart from the upper pitch, the frequency of which was changed, also a second, lower pitch was played to the test subjects, the frequency of which was maintained constant at 400 Hz.

Apart from the course 500, in FIG. 21 further six frequencies of the upper pitch are marked by vertical, dashed lines 505*a*-505*f*, which correspond to the intervals of a minor second (505*a*), a major second (505*b*), a minor third (505*c*), a major third (505*d*), a fourth (505*e*) and a fifth (505*f*) with regard to the consonant frequency of the lower pitch of 400 Hz. With increasing frequency of the upper pitch, starting from the frequency of the lower pitch, i.e. a prime, the course 500 shows a significant decrease which lies in the area of the vertical markings 505*a* and 505*b*, i.e. in the area of the intervals of a minor and a major second, and takes on a minimum of less than 10%. Subsequently, the course 500 increases again until it reaches a maximum in the area of the marking 505*d*, i.e. in the area of the major third. With a further increasing frequency, the course 500 shows a slightly decreasing further course.

Apart from that, in FIG. 21 for the frequencies and/or intervals 505*a*-505*f* marked by the six vertical lines, of the lengths 501*a*-510*f* each of the symmetry circle sum vector and/or the symmetry model sum vector for the corresponding intervals are indicated. It may be seen that the markings 510*a*-510*f* corresponding to the lengths of the symmetry model sum vector model the course of the course 500 well. It is thus reflected that the symmetry model and in particular the analysis on the basis of the symmetry model confirm existing examinations regarding the topic of consonance and dissonance and/or are consistent with the same, which verifies the suitability of the symmetry model for the analysis of audio signals, audio data and pitch information. This indicates that an analysis on the basis of the symmetry model with the help of the sum vector provides important information about a sequence of pitches and/or pitch combinations or also pieces of music.

The inventive device for analyzing an audio datum thus provides an analysis signal based on the sum vector to further components. As the embodiments explained in the following will show, the analysis signal provided by the inventive device for analyzing audio data may be supplied to a display device 195 which graphically, in text form, mechanically or in another way represents the information which the sum vector includes based on the analysis signal. In addition to that, the analysis signal may also be provided to an automatic accompaniment device as an input signal, which generates an accompaniment which goes with the audio data based on the analysis signal.

Symmetry Model-Based and Circle of Thirds-Based Musical Instruments

In the following sections, further embodiments of the inventive device for analyzing an audio datum are described. The embodiments of the inventive device for generating a note signal described in the following among others include symmetry model-based and circle of thirds-based musical instruments which may be integrated into an inventive device, be coupled or couplable to the same.

The fundamentals set so far and explained in the above sections represent the starting point to describe new musical instruments in the form of embodiments of the present invention. In other words, the laid fundamentals are perfectly suitable for developing the new musical instruments described in the further process.

First of all, in the following sections, in the form of a block diagram, a principle setup for a musical instrument is introduced which works on the basis of the hitherto presented fundamentals. This instrument principle realized by a block diagram implements the concepts summarized in the introductory sections regarding the topics of the synthesis of sensibly sounding pitch combinations and the analysis of present pitch combinations. The basic features and/or characteristics of the inventive musical instruments are summarized in the following.

The concept for musical instruments (instrument concept) is based on a logic basic system which allows the geometrical positioning of base pitches in a pitch space. Optionally, the instrument concept additionally allows the definition of a spatial pitch distribution function and/or the definition of a spatial single pitch distribution function. As a further option, a selection weighting function may be introduced within the scope of the inventive instrument concept. Further, the instrument offers an operating means and/or a user interface which enables selecting and/or defining an input angle or an input angle range and/or a spatial section of the logical pitch space (range) in the form of an input signal. The selection of the spatial section may then be optionally indirectly supplied to a sound generator.

The arrangement of the base pitches and/or the pitch classes in the pitch space follows an arrangement with smallest pitch intervals which correspond to a major or a minor third. Following the defaults of the circle of thirds and/or the symmetry model and/or the symmetry circle and/or the cadence circle has shown to be especially sensible within this context. Hereby it is possible, with an extremely low number of base pitches and a consequent number of operating elements and/or input means, to generate sensible pitch combinations. For this reason, this instrument concept is especially suitable for the pedagogic field. Apart from that it is also suitable for fast and efficiently generating note signals which may be used via a connected sound generator for generating harmonically and/or consonantly sounding accompaniments or improvisations. This input, which is very fast and very simple, together with the pedagogic suitability of the inventive instrument concept, enables to playfully introduce people to music who have little musical pre-education.

This instrument concept may thus, for example, enable the infinite cross-fading of sound combinations into other sound combinations, without the result of unwanted dissonances. This essentially takes place on the basis of geometric adjacent arrangement and/or arrangement of sensible base pitches and the input of a user in the form of an input angle or an input angle range. Optionally, the instrument concept may be further refined here by introducing the spatial distribution function and/or the spatial single pitch distribution function, which is assigned to individual basic pitches, as well as the optional possibility of infinitely changing/varying the selected section in the pitch space regarding its position, extension and spatial weighting.

The instrument concept optionally provides an analysis part which is able to analyze audio information, audio data and pitch information of other instruments and map the same into its own pitch space. The active pitches of other instruments may then be marked and/or accentuated on a display device 195. By the geometric arrangement of the output field radial directions and/or the output areas of coherent base pitches in the pitch space and on the operating surface of the instrument, it is possible with a minimum of musical knowledge to generate a suitable accompaniment music to a given pitch signal.

Figure 22:
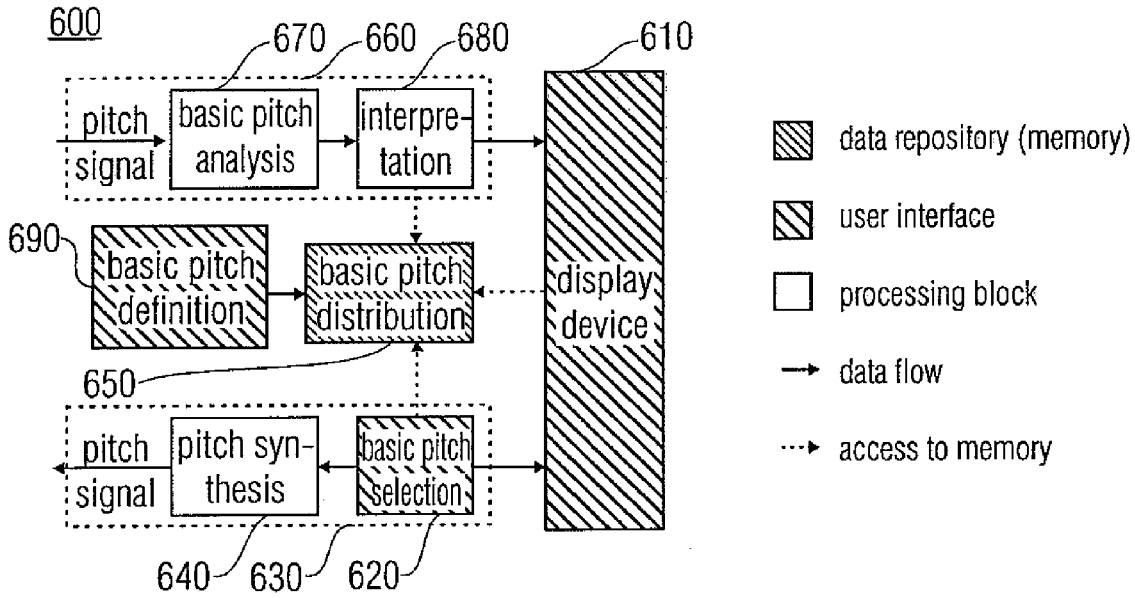
FIG. 22 shows a schematic block diagram of an embodiment of an inventive device for generating a note signal and an inventive device for outputting an output signal indicating a pitch class.

FIG. 22 shows a block diagram of such a musical instrument and/or symmetry circle instrument 600 as a system. In particular, the musical instrument 600 comprises a display device 610, which is a device for outputting an output signal indicating a pitch class. In addition to that, the musical instrument 600 further comprises an operating device 620, also referred to as basic pitch selection in FIG. 22, as a device for generating a note signal upon a manual input. The operating device 620 is part of a synthesis branch 630 which comprises a sound generator 640 for the synthesis of pitches (pitch synthesis) apart from the operating device 620. The operating device 620 is here both coupled to the display device 610 and also to the sound generator 640. The operating device 620 includes an operating means to enable a user to define an input angle or an input angle range. Apart from that, the operating device 620 may optionally transmit a corresponding signal to the display device 610, so that the display device 610 may illustrate the input angle or input angle range defined by the user on the output field. Alternatively or additionally, the operating device 620 may, of course, also provide the generated note signals to the display device 610, so that the display device may illustrate the pitches and/or pitch classes corresponding to the note signals on the output field. Apart from that, the operating device 620 is coupled to an optional memory (data repository) 650 for storing a base pitch distribution. For this reason, the operating device 620 is able to access the base pitch distribution stored in the memory 650. The base pitch distribution may be stored in the memory 650, for example as an assignment function, which may assign no, one or several pitch classes to each angle. The sound generator 640 is, apart from that, coupled to an output of the musical instrument 600, for example a loudspeaker or a terminal, via which pitch signals may be transmitted. This may, for example, be a line-out terminal, a midi terminal (midi=musical instrument digital interface), terminals for digital pitch signals, other terminals or also a loudspeaker or another sound system.

Apart from the synthesis branch 630, the musical instrument 600 also comprises a device for analyzing an audio datum as an analysis branch 660. The same includes a base pitch analysis device and/or semitone analysis device 670 and an interpretation device 680 and/or vector calculation means 680, which are coupled to each other. In addition to that, the base pitch analysis device 670 receives a pitch signal as an audio datum via an input, which may assign no, one or several pitch classes to each angle. The interpretation device 680 is coupled to the display device 610 and may also access the memory 650 and the basic pitch distribution stored in the memory via a corresponding coupling. This coupling, i.e. the coupling of the interpretation device 680 and the memory 650, is optional. Also the coupling between the operating device 620 and the memory 650 is optional. In addition to that, the memory 650 may optionally also be connected to the display device 610 so that the same may also access the base pitch distribution stored in the memory 650.

Apart from the connections of the memory 650 to the interpretation device 680, the display device 610 and the operating device 620 already described above, the same may optionally also be connected to a base pitch definition input device 690, so that a user may influence, change or reprogram the base pitch distribution in the memory 650 via the base pitch definition device 690. The display device 610, the operating device 620 and the base pitch definition input device 690 thus represent user interfaces. The base pitch analysis device 670, the interpretation device 680 and the sound generator 640 thus represent processing blocks.

In the case of the musical instrument illustrated in FIG. 22, the base pitch analysis device 670 includes two means which are not illustrated in FIG. 22 and are connected to each other within the base pitch analysis device 670. In particular, these are a semitone analysis means to analyze the pitch signals and/or audio data provided to the base pitch analysis device 670 with regard to a volume information distribution via an amount of semitones, and a pitch class analysis means which forms a pitch class volume information distribution based on the volume information distribution over the amount of pitch classes from the volume information distribution of the semitone analysis means.

For an exact description of the functioning of the analysis branch 660, i.e. for the inventive device for analyzing an audio datum, reference is made to FIGS. 1 to 3 and the associated passages in the description.

While synthesizers today are specialized in particular on two things, i.e. modeling the amplitude courses and the frequency courses of single pitches, and thus only offer insufficient methods to generate, merge or otherwise process complex harmonies, the musical instrument 600 indicated in FIG. 22 closes the mentioned gaps. As a central idea, the system and/or musical instrument 600 is based on the base pitch distribution in the pitch space, which is defined and/or given by the assignment function. With the musical instrument 600 illustrated in FIG. 22, the base pitch arrangement and/or the definition of the assignment function may, already or in the future, be stored in the memory 650. The same is firmly specified in the form of the circle of thirds or the symmetry model or may be designed freely via the user interface of the base pitch definition input device 690. Thus it is possible to select a certain assignment function from a plurality of assignment functions, for example via the base pitch definition input device 690 or also have a direct influence on the concrete implementation of the assignment function. Based on the optional coupling of the interpretation device 680, the display device 610 and the operating device 620 illustrated in FIG. 2, the respective base pitch distribution is available for these three components of the musical instrument 600 at the same time, for example in the form of the assignment function.

If a pitch signal is provided to the musical instrument 600 via its input terminal, and thus to the base pitch analysis device 670, the semitone analysis device of the base pitch analysis device 670 first of all analyses with regard to a volume information distribution over an amount of semitones. Subsequently, the pitch class analysis means of the base pitch analysis device 670 determines a pitch class volume information distribution over the amount of pitch classes on the basis of the volume information distribution. This pitch class volume information distribution is then supplied to the interpretation device 680, which is the vector calculation means, which determines a two-dimensional intermediate vector for each semitone or for each pitch class, calculates a sum vector based on the two-dimensional intermediate vectors, wherein the individual intermediate vectors are weighted based on the volume information distribution or the pitch class volume information distribution with regard to their lengths. Finally, the interpretation device 680 outputs an analysis signal to the display device 610 which is based on the sum vector. Alternatively or additionally, the interpretation device 680 may provide a display signal to the display device 610 which comprises information regarding the volume information distribution or the pitch class volume information distribution.

The display device 610 may then, on the basis of the analysis signal and/or the display signal, indicate the pitch classes, corresponding to the incoming pitch signal, to the user on an output field of the display device 610 by accentuating output field radial directions or by accentuating output areas. Here, the display device 610 may perform the illustration on the output field based on the base pitch distribution stored in the memory 650.

The user of the musical instrument 600 may then define an input angle or an input angle range via the operating device 620, so that the operating device 620, with the help of its control means and optionally based on the base pitch distribution stored in the memory 650 in the form of the assignment function, then generates note signals from this and provides the same to the sound generator 640. The sound generator 640 then in turn generates pitch signals based on the note signals of the operating device 620 which are then output at the output of the musical instrument 600.

In other words, the optional memory 650, which includes the basic pitch distribution stored within the same and the possibility of changing the same via the base pitch definition input device 690, represents central components of the inventive musical instrument 600. A further important component is the display device 610. The same represents the pitch space and the base pitches contained therein, marks selected or analyzed pitches or also maps the spatial pitch distribution function and/or the spatial single pitch distribution function and/or the selection weighting function. Further, the concept of the musical instrument 600 provides the analysis branch 660 and the synthesis branch 630. The analysis branch 660 is able to analyze the base pitches transported within pitch signals (for example audio signals or midi signals) and interpret the same according to the base pitch distribution, mark them in the pitch space and display the same via the display device 610. This functionality may, e.g., be used so that a musician B may generate a suitable accompaniment to an audio signal provided by a musician A. Apart from the analysis branch 660, there is also the synthesis branch 630. The same contains an interface for selecting base pitches, i.e. the operating device 620 also referred to as the base pitch selection in FIG. 22. The selected pitches are transmitted to the pitch synthesis, i.e. the sound generator 640, which generates a corresponding pitch signal. The sound generator 640 may be a midi generator, an automatic accompaniment or a sound synthesizer. The sound synthesis and analysis concept introduced here offers many interesting possibilities which are explained and examined in more detail in the following embodiments.

Basically it is possible that the interpretation device 680, the display device 610 and the operating device 620 access different base pitch distributions which are stored in the memory 650. Thus, it is, for example, possible that the display device 610 uses a representation which exactly models the symmetry model and/or the cadence circle, which means that with regard to the angle the distance of two adjacent pitch classes depends on whether the smallest pitch interval is a minor third or a major third. Simultaneously, the operating device 620 may work on the basis of an assignment function, wherein the seven pitch classes of the symmetry circle and/or the cadence circle are equidistantly distributed with regard to the angle.

In the form of a block diagram, FIG. 22 thus shows a very general principle of a technical system for realizing the sound synthesis concept and the inventive analysis concept.

In the following sections, the selection of the active spatial section by the user, i.e. the definition of the input angle or the input angle range, is considered in more detail. In this connection, some embodiments of the operating means are given and explained in more detail. Here, the following explanations are made using a base pitch arrangement following the symmetry model. Without limitations, the same may, however, also be applied to the circle of thirds or another arrangement of the base pitches and/or pitch classes.

Here, the active spatial section in the symmetry model, in the circle of thirds and other arrangements of the base pitches is defined via one single input angle or via one circle segment. This may, for example, be done via a starting angle and an opening angle, and, if applicable, also optionally via a radius. The term "active spatial section" here also includes the case that the opening angle of the circle segment disappears and/or has an opening angle of 0°, so that the active spatial section may also consist of only one single input angle. In this case, consequently the starting angle and the input angle are the same.

Figure 23:
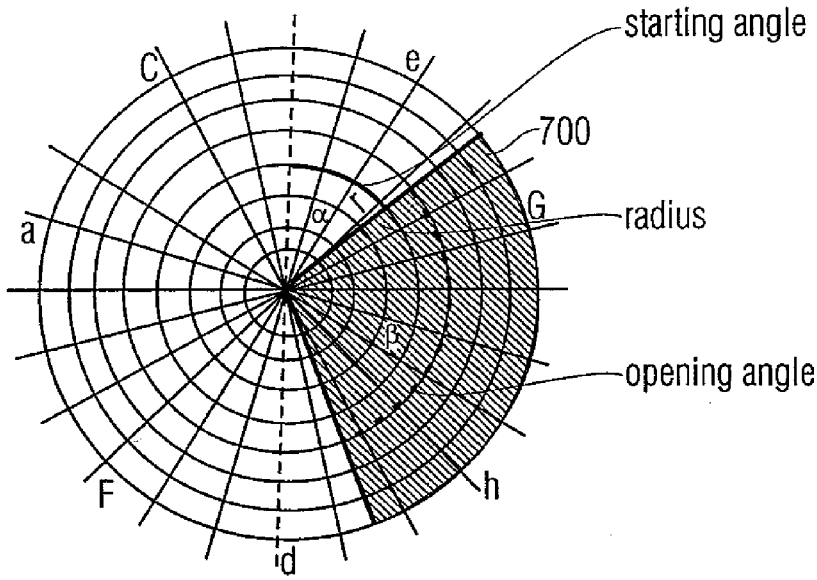
FIG. 23 shows an illustration of an embodiment of an operating means of an inventive device for generating a note signal.

FIG. 23 shows an embodiment of an illustration on an output field of a display device. The illustration shown in FIG. 23 is based on the symmetry model for the keys C major and/or a minor. FIG. 23 shows a selected circle segment 700 which starts between the pitches and/or pitch classes e and G and ends between the pitches h and d. The circle segment 700 is here defined via the starting angle α and the opening angle β. Optionally, it is also possible to further specify the circle segment in more detail via a radius r. In the case of the circle segment 700 illustrated in FIG. 23, thus the pitches G and h are completely marked and will thus, for example, be completely audible in the case of the musical instrument 600 due to the sound generator. The pitches e and d are not covered by the circle segment 700, but may, depending on the appearance of their spatial single pitch distribution function and/or the spatial pitch distribution function, be audible with an identical volume, quieter or not at all. FIG. 23 thus illustrates the new instrument concept which provides for the selection of the active pitch space section via the definition of a circle segment by a starting angle, opening angle and optionally by a radius. This again enable defining sensible harmonic correlations also using very limited input possibilities.

Figure 24:
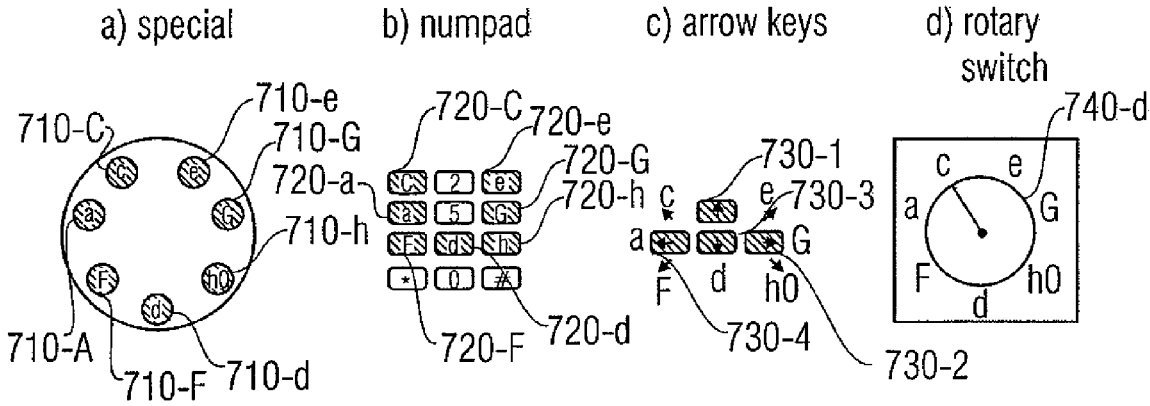
FIG. 24A show an illustration of four embodiments of input to 24D means for defining a starting angle.

FIG. 24 shows different possibilities of defining the starting angle α of the selected circle segment of the symmetry model using hardware elements. FIG. 24A here shows a special arrangement of seven (discrete) keys 710-C, 710-*e*, 710-G, 710-*h*, 710-*d*, 710-F and 710-*a*, which are associated with the pitch classes C, e, G, h0, d, F and a, to put it simple. In more detail, the seven keys 710-C to 710-*a* are associated with a plurality of angles to which again the corresponding pitch classes are associated. The geometric arrangement of the keys on the operating surface and/or the operating means is according to the arrangement of the basic pitches in the pitch space. Thus, the seven keys 710-C to 710-*a* spatially model the assignment function of the key C major and/or a minor of the symmetry circle. A more detailed description of this special geometric arrangement of keys and/or input means is explained in more detail further below in connection with FIG. 27.

If a fixed arrangement of keys has already been predefined, a sensible assignment of the base pitches to individual keys may be performed. One example for this is given in FIG. 24B using a ten-key pad (Numpads). In this case, an input angle may be associated, for example, with the key 720-C, to which usually the number 1 is associated, wherein the angle corresponds to the pitch class C. Accordingly, to the key 720-*e*, to which usually the number 3 is associated, an input angle may be associated, which corresponds to the pitch class e according to the assignment function. The same applies to keys 720-G (number 6), 720-*h* (number 9), 720-*d* (number 8), 720-F (number 7) and 720-*a* (number 4). Due to the simplicity of the symmetry model it is possible to make do also with an extremely small number of keys, as it is illustrated in FIG. 24B.

FIG. 24C shows an alternative, wherein partially more than one key has to be pressed. Compared to the variant illustrated in FIG. 24B, this variant requires an even smaller number of keys, i.e., for example, the four cursor keys 730-1, 730-2, 730-3 and 730-4 of a conventional PC keyboard. In this case, for example by pressing the key 730-3, an input angle or also a starting angle α may be defined which is associated with a pitch class d via the assignment function. If the cursor keys 730-1 and 730-4 are, for example, pressed simultaneously, an input angle or starting angle α may be associated with this key combination, to which a pitch class C is associated. Further key combinations and the pitch classes associated with the same are given in FIG. 24C.

Also using a simple rotary switch 740 the starting angle α and/or the input angle may be defined, as illustrated by FIG. 24D. The examples illustrated in FIG. 24 for the selection of the starting angle of the active area of the symmetry model may, of course, also be applied to other arrangements of the pitch classes and/or base pitches in the pitch space. FIG. 24 thus shows four embodiments wherein, using hardware keys or other hardware elements, the starting angle α or the input angle may be defined.

In this connection, it is important to note, that it is absolutely possible to let the musical instrument 600 for example operate in a mode which is based on the symmetry model of a certain scale, so that, for example, the display device 610 optically reflects the respective symmetry model, while the operating device 620 includes a rotary switch like the one illustrated in FIG. 24D, wherein the arrangement of the letterings indicating the pitch class is, for example, performed equidistantly with regard to the angle area of the complete angle.

Figure 25:
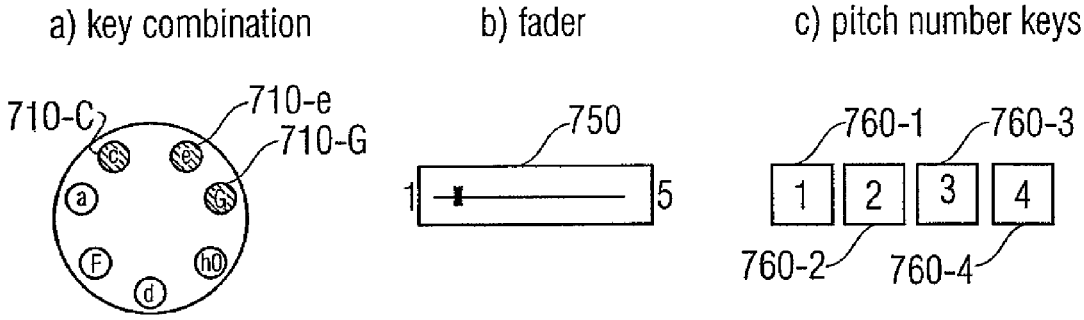
FIG. 25A show an illustration of three embodiments of an to 25C operating means for defining an opening angle.

FIG. 25 shows three embodiments of how the input of the opening angle β may take place. In the case of a key arrangement or a button arrangement, wherein an angle is associated with each key or button, to which again a pitch class is assigned, the opening angle β may be defined by pressing several adjacent keys or buttons. In this case, the starting angle and the opening angle respectively results from the pressed and adjacent "outer" keys. One example for this is illustrated in FIG. 25A, which illustrates the special keyboard from FIG. 24A. In the example illustrated in FIG. 25A, the three keys 710-C, 710-*e* and 710-G are pressed, so that the starting angle results from the angle associated with the key 710-C and the opening angle results from the difference of the angles associated with the keys 710-G and 710-C. By pressing several adjacent pitch keys, thus the opening angle may here be increased step by step.

FIG. 25B shows a further embodiment for inputting the opening angle β, which enables an infinitely variable changing of the opening angle via a fader and/or a sliding controller 750. By this, in the example illustrated in FIG. 25B, an infinitely variable changing of the opening angle β may take place, which corresponds to a change of the opening angle between one and five pitches.

FIG. 25C shows a further embodiment of an input means for the definition of the opening angle β. FIG. 25C shows an arrangement of four pitch number keys 760-1 to 760-4, using which the opening angle and/or the number of pitches and/or pitch classes to be played simultaneously may also be firmly set, depending on the implementation. The number of pitch number keys 760-1 to 760-4 may be varied here. In the case of the symmetry model, the same is typically between 2 and 7, better between 3 and 5. In the case of the circle of thirds, also more than 7 pitch number keys are possible. Thus, FIG. 25 all in all shows several possibilities for the definition of the opening angle of the active circle segment in the symmetry model using hardware elements.

A combined input of starting angle α and opening angle β may also take place using a joystick. Thus, for example, the starting angle α may be derived from the inclination direction of the joystick, and the opening angle β or the radius r of the circle segment may be derived from the inclination degree. Instead of the inclination axis of the joystick, also the inclination angle and the inclination degree of the head may be used. This is, for example, interesting for accompaniment instruments for paraplegics, as will be explained in more detail in the further course of the present application.

Very complex possibilities for the definition of the active circle segment are offered by screen-based input methods. In this case, the symmetry model or the circle of thirds may be mapped to a screen or a touch screen. The active circle segment may be selected using a mouse, by touching the touch screen or another type of a touch-sensitive surface. Here, possibilities like drag and drop, dragging, clicking, tipping or other gestures may be used.

Such an application and embodiment example is illustrated by the so-called HarmonyPad. The HarmonyPad is a special operating means or also instrument for generating, changing and cross-fading chords, on which the symmetry vector may be represented advantageously. The surface of the HarmonyPad may also be used to program the synthesizers and sound generators contained in circle of thirds-based and symmetry circle-based musical instruments and to configure their operating surface. In more detail, the HarmonyPad thus represents a system, which includes both a device for generating a note signal upon a manual input and a device for outputting an output signal indicating a pitch class, which may advantageously be coupled to an inventive device for analyzing an audio datum.

Figure 26:
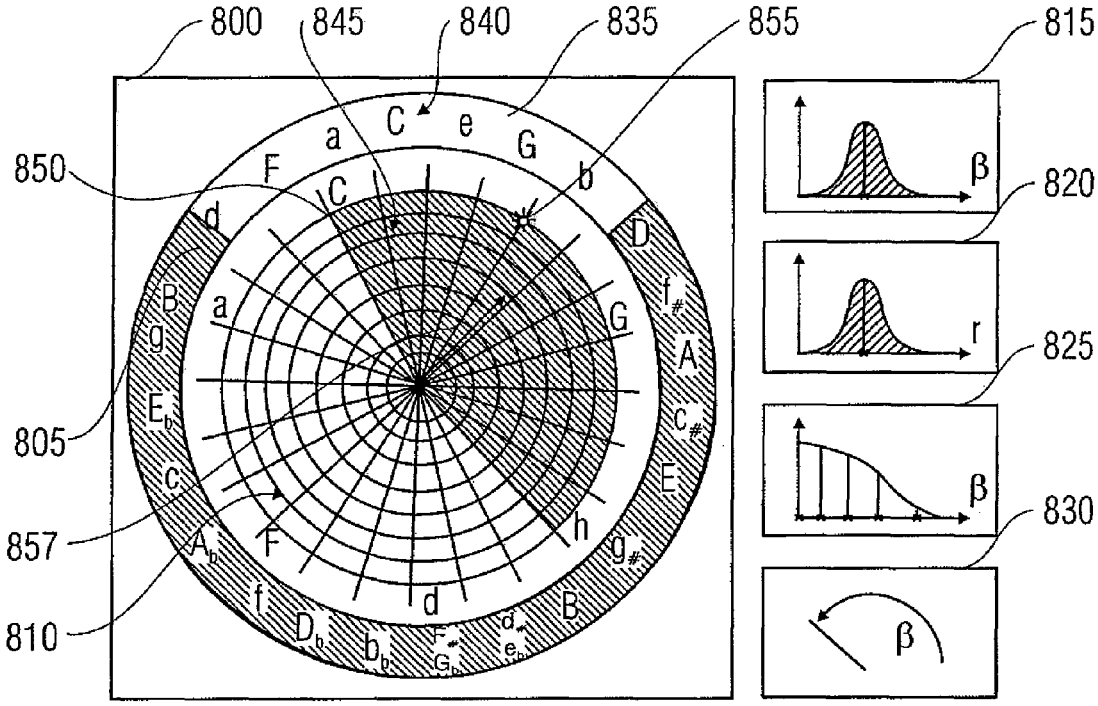
FIG. 26 shows an illustration of an embodiment of an operating means of an inventive device for generating a note signal and a device for outputting an output signal indicating a pitch class (HarmonyPad)

FIG. 26 shows an embodiment of an operating surface and/or interface and/or user surface/interface of the HarmonyPad. The same may be mapped to a touch-sensitive screen (touch screen) and comprises different elements which are explained in the following.

As it was explained in the application, which was filed concurrently to the present application, with the title "Device and method for generating a note signal and device and method for outputting an output signal indicating a pitch class", the HarmonyPad comprises an output field and a touch-sensitive field, which are arranged regarding each other so that the touch-sensitive field is arranged between a user of the HarmonyPad and the output field. The touch-sensitive field is here implemented transparently and/or semi-transparently, so that the user may look through the touch-sensitive field. By this, the user may perform an input "quasi directly" on the screen, i.e. the output field, which detects a detection means coupled to the touch-sensitive field and passes it on to an input control means.

First of all, the possible operating surface and/or surface comprises a harmony area 800, which includes a circle of thirds 805 and the symmetry model 810. The symmetry model 810 is here arranged and/or mapped concentrically in the center of the circle of thirds. The circle of thirds 805 and the symmetry model 810 thus comprise a common center point 812. The center point 812 simultaneously represents a center of the output field and the touch sensitive field. Starting from this center 812, one or several output field radial directions may be accentuated, i.e. optically accentuated and/or illuminated here.

On the right next to the harmony area 800 four input fields and/or input possibilities (e.g. buttons) 815, 820, 825 and 830 are arranged one below the other. Here, the input field 815 enables editing, changing, determining or defining the spatial single pitch distribution function and thus also the spatial pitch distribution function. Using the button 820 a user of the HarmonyPad may define, edit or influence an inversion weighting function, using the button 825 correspondingly the selection distribution function and using the button 830 the opening angle β of the active spatial section and/or the selected area.

The surface of the HarmonyPad illustrated in FIG. 26, as already illustrated by the inventive musical instrument 600, may be connected to a sound generator which may convert the user inputs into audible audio signals. The following operating examples show some of the possibilities offered by the HarmonyPad.

Selection of key: The current key is selected by touching the circle of thirds 805. In FIG. 26, C major and a minor are selected as the current key. This may be seen from the illuminated area 835 of the circle of thirds which includes the amount of pitch classes on the circle of thirds associated with these keys, as was already explained in connection with the description of the circle of thirds within the scope of the description of the positioning variants of base pitches in the pitch space. In order to now set a different key, the user of the HarmonyPad has to touch the circle of thirds 805 at a corresponding location, which may, for example, be the center of mass and/or the tonal center of the associated scale. In the case of the C major and/or a minor scale it would in this case, for example, be an area 840 which is arranged, with regard to the orientation illustrated in FIG. 26 of the HarmonyPad seen from a center of the circle of thirds on the circle of thirds 805, directly perpendicular above the center between the plotted pitch classes C and e. The circle of thirds 805 then "rotates" such that the newly selected key appears on top in the illuminated area 835. Further, the designation of the base pitches in the symmetry model 810 is changed and/or switched so that the pitches of the C major key no longer appear, but the pitches of the newly selected key.

Alternatively, it is, for example, also possible that the illuminated area 835 is shifted corresponding to the newly selected key, so that a new orientation of the circle of thirds may be omitted. The circle of thirds 805 in this embodiment thus represents an embodiment of an additional operating means, with the help of which a selection of different assignment functions may be performed by the user between angles and pitch classes. By this, the HarmonyPad may be switched to and fro between different keys.

Selection of the chord to be played: To make a certain chord and/or a certain pitch combination sound/play, first of all the opening angle β of the circle segment to be selected and/or the active spatial section has to be determined. This may, for example, take place graphically via the input field 835 and/or the associated window. Alternatively or additionally, this may, of course, also be done via a connected hardware interface or via an input means, as it was described in connection with FIG. 25. If the opening angle β is specified, the selection weighting function may be graphically edited via the input field 825. Now, by touching a location on the symmetry circle and/or the symmetry model 810, the starting angle α and optionally also the radius r of the circle segment to be selected may be determined. The selected circle segment is illustrated in an accentuated manner on the symmetry circle 810 as a marked area 845. Here, both in the area of the input field 825 and also on the symmetry model 810 within the scope of the marked area 845 the set selection weighting function may be illustrated with the help of transparency effects.

Fading between chords: In FIG. 26, currently the C major 7 chord is selected, as the marked area 845 illustrates. For this purpose, the corresponding opening angle β was specified via the input field 830 and the user touched the angle associated with the base pitch C on the HarmonyPad. To cross-fade the C major 7 chord into an a minor 7 chord, only the finger of the user has to be drawn to the left onto the angle which is associated with the pitch and/or the pitch class A minor. By this, the starting angle α of the selected circle segment is shifted from the pitch C to the pitch A minor. According to the shifting of the selected circle segment, the C major chord is softly or also instantaneously cross-faded into an a minor chord.

Fading between conversions: Optionally, the HarmonyPad offers the possibility of using and/or interpreting the radius of the selected circle segment for the selection of different chord conversions. By this it is possible, by a change of the radius r, to obtain a desired octaving of individual base pitches. Here, within the scope of the present application, the octaving of a pitch or a pitch class is a determination and/or definition of an octave position. The indication of an octaving thus, for example, defines to which octave a pitch with a certain pitch class belongs. With the help of octaving, it is thus defined which of the pitches C, C', C'', C''', . . . are played/sound and/or are to be associated with the pitch class C. In other words, the octaving determines a basic frequency of a pitch in the form of a factor $2^{o}$ with an integer number o, which is also referred to as the octaving parameter.

Thus, for example, the standard pitch A has a basic frequency of 440 Hz. If now, for example, instead of the standard pitch A minor a pitch of the pitch class A minor is to play one octave higher, then the octaving parameter has to be set at o=1, so that the new basic frequency of the pitch is 880 Hz. Accordingly, the basic frequency of a pitch of the pitch class a is one octave below the standard pitch a (o=−1) with 220 Hz.

If, on the HarmonyPad, for example the basic setting of the C major chord is selected, then, for example, the first conversion of this chord may be achieved by the user drawing and/or moving a finger along a radially directed C line 850 which leads from the center of the symmetry circle radially outward under an angle which is associated with the pitch class C, in the direction of the circle center point and/or the center. By this, the radius r of the selected circle segment is reduced and the basic setting of the C major chord is slowly converted into the first conversion. Via a connected sound generator, the user may then hear the first conversion of the C major chord.

A conversion of a chord is here an arrangement of the pitches of a chord such that the sounding pitch having the lowest basic frequency is not necessarily also the base pitch, for example in the case of a C major chord the pitch C and/or the pitch class C. In the case of a C major chord, an arrangement of the sounding pitches with increasing frequency in the order E-G-C for example represents the first basic setting. Apart from that, of course also other assignments of the radius r are possible with a certain octaving of a pitch and/or a pitch class or also a certain conversion of a chord.

Just like the spatial single pitch distribution function may be edited and/or defined via the input field 815, by introducing an optional conversion distribution function which may be edited and/or defined via the input field 820, an octaving of the sounding pitches may be influenced. Thus it is possible, based on the selected conversion distribution function, to assign volume information values to single pitches regarding a certain pitch class, so that, for example in the selection of the pitch class C via the active spatial section, more than one pitch of the corresponding pitch class sounds. Likewise, it is possible that the conversion distribution function is used, based on the input of the radius r by the user, to make different conversions of the corresponding pitch combination and/or the corresponding chord sound via a connected sound generator. In order to enable this, the surface of the HarmonyPad offers the corresponding window and/or input field 820.

Fading between single pitches and chords: The HarmonyPad may, for example, be equipped with a midi interface or another control interface, to receive or also to transmit note sequence signals. Using this midi interface or the control interface, now optionally a controller, for example a foot controller, a momentary foot switch, a joystick or another input means may be connected. It is now possible to route the data of this input means (foot controller) to the opening angle β and/or interpret the same influenced by the input via the foot controller. This means that the opening angle may be controlled as an angle parameter by the user using the foot controller. Advantageously, the foot controller enables making a quasi continuous input of data possible which are, for example, associated with the foot position of the user. Hereby, the user may influence the opening angle β using the foot controller within predetermined or variable limits. If the user touches the foot controller so that it is at the bottom stop, this foot position may, for example, be associated with an opening angle of 0°. If the user now touches the HarmonyPad in the area of the symmetry model 810 at the location of the pitch and/or the pitch class C, via the connected sound generator, only the pitch C will sound and/or may be heard, as the opening angle is β=0°. If the user now slowly moves the foot controller in the direction of the top stop, it is possible to correspondingly increase the opening angle β so that the additional pitches and/or pitch classes E minor, G major and B/H minor are added and faded in one after the other in the case illustrated in FIG. 26.

Finding pitches which match existing pitches (improvisation): Optionally, the HarmonyPad (just like the musical instrument 600) may be equipped with an analysis functionality which analyzes pitch signals and/or audio data present in the form of audio signals or midi signals and marks the corresponding basic pitches on the surface of the HarmonyPad (pad surface) by a corresponding accentuation. FIG. 26 shows this based on the example of an optical marking 855 of the pitch class E minor on the symmetry model 810. In this case, an audio signal or a midi signal was provided to the HarmonyPad as an input signal which has a pitch with a pitch class E minor. If a musician, as the user, wants to find matching accompaniment pitches to the given signal and/or the input signal, he only has to select a circle segment which includes the marked pitches or is close to the marked pitches.

In addition to that, it is further optionally possible with the help of the HarmonyPad to graphically represent the result of an analysis of an audio datum which may be provided to the HarmonyPad in the form of an analysis signal. The inventive device for analyzing an audio datum may here be both implemented as a component of the HarmonyPad and also as an external component to the HarmonyPad. In the first case, the HarmonyPad thus represents a system which comprises a display device and a device for generating a note signal upon a manual input apart from the inventive device for analyzing an audio datum. In the second case, the analysis signal may be transferred to the HarmonyPad, for example via an external interface, for example a plug, a radio connection, an infrared connection, or another data connection.

Apart from a marking and/or accentuation of the pitch classes included in the audio signal by an accentuation of individual output field radial directions of the symmetry model 810 or larger coherent areas on the symmetry model 810, thus also the sum vector provided in the form of the analysis signal may be illustrated on the output field 810. Here, the angle of the sum vector may be indicated starting from the output field center and/or the center of the symmetry model 810 by an accentuation (e.g. in the shape of an arrow) of an output field radial direction, as it is shown in FIG. 26. By this it is possible, while a piece of music is playing, to illustrate the center of mass and/or thus the tonal center in a time-resolved way on the HarmonyPad quasi in real time, so that an accompanying musician may play based on this.

Optionally, it is also possible to accentuate the output field radial direction accentuated on the basis of the angle of the sum vector not as a whole, but to accentuate, based on the length of the sum vector starting from the output field center, only a part of the corresponding output field radial direction, as it is shown by the accentuated, arrow-shaped output field radial direction 857 in FIG. 26. By this, additionally the length of the sum vector $|\vec{r}_{sum}|$ may optically be indicated to the user on his/her control panel. As it was explained in connection with the analysis of audio data, the user may thus classify the played music better, on which he is, for example, improvising, as the absolute value of the sum vector is, among other things, an estimate of the tonal context of the sounding/playing music.

Optionally it is also well possible to temporally integrate the incoming audio signals with the help of an input value integrator for so long until the absolute value and/or the length of the resulting sum vector reaches a (temporally local) maximum, as it was already explained in connection with FIG. 3E. As, depending on the underlying basic pitch arrangement in the pitch space, maxima again indicate chords in the case of the symmetry model or key changes in the case of the circle of thirds, based on the integrated audio data also the representation on the HarmonyPad may be adapted correspondingly. Thus it is, for example, possible to determine the diatonic scale underlying the symmetry model 810 on the basis of the integrated audio signal and indicate the same on the symmetry model 810.

FIG. 26 thus shows a possible operating surface of the HarmonyPad, which includes many optional components, like, for example, the input field 820 for the reverse distribution function. Of course, also geometrical arrangements other than the one illustrated in FIG. 26 are possible. Apart from that, of course also the output field 810 may not operate on the basis of the symmetry model but on the basis of the circle of thirds. The HarmonyPad thus represents an embodiment which combines a device for generating a note signal upon a manual input with a device for outputting an output signal indicating a pitch class, which may be supplemented by an inventive device for analyzing an audio datum, based both on its implementation as a touchscreen and the associated possibility for inputting data by touching the surface of the touchscreen and also for an output via the display surface of the touchscreen.

In the following paragraphs, an inventive measurement device and an inventive analysis device for tonal-harmonic correlations are explained and described in more detail. In other words, in the following sections a further embodiment of a measurement system is explained, as it was already described in connection with FIG. 3B-FIG. 3D. For this reason, here reference is additionally made to the description pages and paragraphs of the present invention relating to the above-mentioned figures. The possibilities described within the scope of the symmetry model-based and circle of thirds-based harmony analysis may be implemented in the form of a measurement device which receives an audio signal or a note sequence signal as an audio datum, transforms the same into the symmetry model or the circle of thirds, calculates the corresponding absolute value parameters and angle parameters and (optionally) outputs the same on a display device. The display device may be similar to that of the HarmonyPad of FIG. 26 regarding its user interface.

Figure 27:
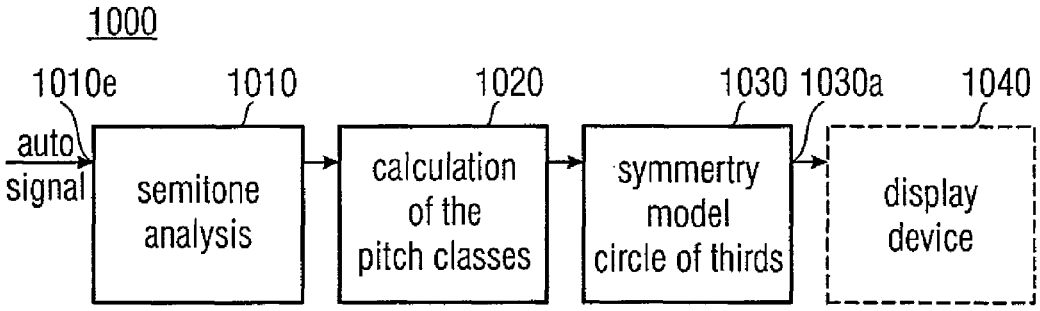
FIG. 27 shows a schematical block diagram of an embodiment of an inventive device for analyzing an audio datum.

FIG. 27 shows a block diagram of a device for analyzing an audio datum and/or a measurement device 1000. The device 1000 comprises a semitone analysis means 1010 to which an audio signal or a note sequence signal is provided at an input 1010*e*. Downstream to the semitone analysis means a pitch class analysis means 1020 for calculating the pitch classes is connected. Downstream to the pitch class analysis means 1020 a vector calculation means 1030 is connected, which outputs an analysis signal at an output 1030*a*. The analysis signal may then be provided to an optional display device 1040 as an input signal.

The semitone analysis means 1010 then analyzes the audio datum provided at its input 1010*e* regarding a volume intensity distribution across an amount of semitones. The semitone analysis means 1010 thus implements (among others) equation 4. The pitch class analysis means 1020 determines a pitch class volume information distribution on the basis of the volume information distribution over the amount of pitch classes as the underlying amount. The vector calculation means 1030 is then provided with the pitch class volume information distribution, wherein the vector calculation means 1030 forms a two-dimensional and/or complex intermediate vector for each pitch class on the basis of the same, calculates a sum vector based on the two-dimensional intermediate vectors and outputs the analysis signal at the analysis signal output 1030*a* on the basis of the sum vector. The downstream (optional) display device 1040 may then, based on the analysis signal, for example output the sum vector, the angle of the sum vector and/or also the absolute value and/or the length of the sum vector.

In other words, the measurement device 1000 is fed with an audio signal, i.e., for example, an (analog) line signal or a digital audio signal, from which the semitone analysis means 1010 analyzes the semitones. This may, for example, take place by the constant-Q transformation already explained in connection with FIG. 3. The semitones are then summarized into a one-octave area by the pitch class analysis means 1020. In other words, the pitch class analysis means 1020 calculates the pitch classes and the associated volume information on the basis of the result of the semitone analysis means 1010. The vector calculation means 1030 calculates the respectively assigned sum vector, on the basis of the pitch classes gained this way and the assigned pitch class volume information distribution, with the help of equation 14 in the case of an analysis according to the circle of thirds, or according to equation 23 in the case of an analysis according to the symmetry model. Again in other words, the vector calculation means converts the pitch classes gained according to equation 14 or equation 23 into the circle of thirds sum vector or the symmetry model sum vector.

The angle and/or the absolute value of the corresponding sum vector may then be represented by the display device 1040.

The input terminal 1010*e* of the measurement device 1000 and/or the semitone analysis means 1010 may be a microphone input, an analog audio input or also directly a digital input, so that the measurement and display device, if the display device 1040 is also implemented, may in principle analyze both analog and also digital audio data. Depending on the implementation, also note sequence signals, i.e. also control signals like, e.g., midi control signals may be provided to the measurement device 1000. In the case of an analog input, depending on the implementation of the system, an analog/digital converter (ADC) may also be implemented, if it seems advisable.

FIG. 27 thus shows a block diagram of the measurement and display device, wherein in particular the basic structure of the same is illustrated.

The optional display device 1040 may, for example, comprise an output field, similar to the HarmonyPad illustrated in FIG. 26. In this case, it is possible, in the case of an analysis according to the symmetry model, to represent the angle information of the symmetry model sum vector in the form of an output field radial direction 857, which is accentuated starting from the center of the symmetry circle (810 in FIG. 26) over the complete radius of the symmetry circle as it was already explained in connection with FIG. 26. Optionally, it is possible here, to realize the absolute value and/or the length of the symmetry model sum vector by a length of the accentuation 857 of the output field radial direction which depends on the absolute value of the symmetry circle sum vector. Alternatively or additionally, also the angle of the symmetry circle sum vector may be represented by a spatially limited accentuated area which may, for example, be similar to the marking 855 in FIG. 26.

Basically, it is possible, within the context of the calculation of the pitch classes by the pitch class analysis means 1020, to perform a weighting of the analyzed semitones depending on their pitch level and/or their frequency f by introducing a weighting function g(f). The weighting function and/or the weighting describes how different the influence of two pitches of the same pitch class, which, however, belong to different octaves, is on the perception with regard to harmony. From this the possibility results, not only to perform the analysis of the semitones with regard to a volume information distribution which is based on a hearing-adapted variable, but it rather also allows considering the human perception of harmonies of different frequencies, which is more than a mere hearing-dependent variable. The weighting function g(f) thus enables to further refine the analysis with regard to human perception.

Apart from that, it is possible, additionally or alternatively, to integrate and/or include an input value integrator into the measurement device 1000, which temporally integrates the audio signal or a signal derived from the same until the absolute value of the resulting sum vector shows a maximum. By this, a detection system results, as it was already explained in connection with FIG. 3E. By this, apart from a display on a display device 1040, also a further use of the analysis signal, for example within the context of an accompaniment, is possible, as maxima of the absolute value of the sum vector indicate changes of chord in the case of the symmetry circle sum vector or changes of key in the case of the circle of thirds sum vector. In this connection, reference is made to the description of the systems illustrated in FIG. 3A-FIG. 3E.

In the following sections, some further embodiments of the present inventive device are explained and outlined.

In the patent application filed on the same day with the title "Device and method for generating a note signal and device and method for outputting an output signal indicating a pitch class" it is described, how a mobile phone may also be used as a musical instrument, by a user interface, which is similar to the HarmonyPad illustrated in FIG. 26, being displayed on the screen, which may be, depending on the mobile phone, also a touch-sensitive screen. If the mobile phone additionally comprises a polyphonic sound synthesizer, then the mobile phone may be used as a musical instrument. More details are contained in the above-cited patent application which was filed on the same day. In addition to that, it is described in the above-cited patent application, how several mobile phones may, for example, be networked via Bluetooth® or another network connection to synchronize the same rhythmically and to transmit the pitches played on one mobile phone by one player to another mobile phone to form a "mobile phone orchestra". These systems may be extended by an inventive device for analyzing an audio datum and optionally by an automatic accompaniment, so that also in a mobile phone, for example, an accompaniment system, as it was described in connection with FIG. 3A, may be implemented. In addition to that, on the screen and/or the display of the mobile phone also a graphical illustration of the sum vector may take place, as it was already explained in connection with FIGS. 3B-3D and FIG. 26.

Further, in the above-cited patent application a so-called DJ tool is explained. The same is an input and output device, i.e., for example, the HarmonyPad explained in FIG. 26, which may be positioned next to a record player or a CD/DVD player by a DJ on the table of the DJ. An inventive pitch and harmony analysis device detects the base pitches contained in the currently played pieces of music and/or tracks and passes the same on and/or routes the same onto the input and output device (e.g. HarmonyPad) of the DJ. The latter may now generate "cool" harmonic accompaniment effects by using the sound generation possibilities provided by the HarmonyPad. The DJ tool may now additionally be extended by an inventive device for analyzing an audio datum. By this, the DJ tool may be extended into a measurement system, as it was described and explained in connection with FIGS. 3B-3D. In addition to that, the DJ tool may also be extended to an accompaniment system, as it was described in connection with FIG. 3A, or to a detection system, as it was described in connection with FIG. 3E. Reference is thus made to the corresponding sections of the present application.

A further embodiment of the present invention is an extension of a keyboard or another electronic sound generator by an accompaniment system 170, described in connection with FIG. 3A. Analog to that, also the above-mentioned instruments may be extended by a detection system 230, as it is described in connection with FIG. 3E.

In the above-mentioned patent application which was filed on the same day, an integration of the HarmonyPad, also cited in FIG. 26 of the present application, into an iPod® is described as an embodiment. Here, the iPod® may be extended by the HarmonyPad, described in connection with FIG. 26, as an AddOn.

The current iPod® comprises a circular touch-sensitive area for operating the device. This circular area may be used as an input medium for the HarmonyPad. In addition to that, it is possible to extend the iPod® by a harmony analysis function and/or a harmony analysis device which operates on the basis of the sum vectors. This function analyzes the key and the starting angle and opening angle present at a certain point of time and makes the corresponding circle segment on the iPod® light up. In addition to that, optionally the iPod® may now also be equipped with a sound generator, so that bright kids may enhance their music with trendy accompaniment harmonies. It is to be noted, that this function may need suitable music. Also here, an inventive device for analyzing an audio datum in the form of an accompaniment system, a measurement system or a detection system, as it was explained in connection with FIGS. 3A-3E, may be extended.

A further embodiment of the present invention represents an automatic accompaniment system which includes an inventive device for analyzing an audio datum and an automatic accompaniment device, which are coupled to each other, as it was already described in connection with FIG. 3A. The inventive device for analyzing audio data and/or the measurement device described in FIG. 27 receives an audio datum and/or audio signals via a terminal of the automatic accompaniment system, analyzes the same and provides an analysis signal based on the audio datum to the automatic accompaniment device. The harmony data in the form of the analysis signal gained using the measurement device are then used to control the automatic accompaniment device and/or the accompaniment automatic. The accompaniment automatic is implemented such that it is able, on the basis of the circle of thirds or the symmetry model, to find suitable accompaniment harmonies to the tonality information provided as the analysis signal in the form of sum vectors, and output the same in a suitable form. This may take place, for example, directly in the form of sounds, which may be output via a loudspeaker, in the form of analog audio data, in the form of control signals (e.g. midi control signals) or digital audio data. In this context reference is also made to the above-mentioned sections of FIG. 3A, which provide further explanations.

Further embodiments of the present invention represent systems, in which an inventive device for analyzing an audio datum or a device for generating a note signal is coupled to a space sound generator to enable a linking with a space sound or space sound event or other sound parameters. By the symmetry model and the circle of thirds, tonal information like in the form of the selected spatial section and/or the input angle and/or the input angle area, and the analysis signal based on the sum vector, are geometrically represented very efficiently. Today's reproduction systems and/or space sound systems make it possible to reproduce sound at certain spatial positions. There is thus the possibility, in the case of a coupling of a device for generating a note signal with a space sound system, for example to route the (starting) angle, the opening angle and/or the radius of the currently selected circle segment to spatial parameters like direction, diffusity, expansion of the sound in space, etc. and/or to perform a corresponding assignment. It is just as well possible, in the case of a coupling of an inventive device for analyzing an audio datum to a space sound system based on the audio system, i.e. in particular on the basis of the information contained within the same regarding the angle and/or the length of the sum vector, to perform a corresponding assignment to the parameters of the space sound system. In addition to that, it is possible to route these parameters to a frequency-dependent transmission function or to the time course, for example by means of ADSR envelopes (attack-decay-sustain-release) and thus link harmony, sound color and/or sound position with each other.

Another embodiment for an inventive device for analyzing an audio datum within the context of a measurement system, as it was already described and explained in more detail with reference to FIGS. 3B-3D, represents a system which is designed as a wall hanging. A corresponding system may comprise an LCD display or a TFT display (liquid crystal display; thin film transistor) within the context of the display device 195 integrated into the system.

Also smaller implementations are possible, which may be held in hand. Such systems, which may, for example, be implemented in the form of the already described HarmonyPad or the DJ tool enable making it possible for people who have no absolute hearing to quickly detect the played pitches of a piece of music and the tonal context.

Depending on the target group, one of the systems described within the scope of the present invention, i.e. in particular an accompaniment system, a measurement system, a detection system or the inventive method for analyzing an audio datum, may be realized in software and/or in the form of a computer program product for a computer, a PDA (personal data assistant), a notebook, a Gameboy®, a mobile phone or another computer system and/or another processor means. The same may optionally be implemented together with the method for generating a note signal upon a manual input and/or the method for outputting an output signal indicating a pitch class, as they were described within the scope of the above-cited patent application which was filed on the same day.

Optionally, here a networking of different systems is further possible, which may also run on physically separated computer systems and/or processor means. By this, individual components of the different systems may be networked to enable a data exchange, wherein the components run on separate processor means. Thus, it is, for example, possible, to network different Gameboys® of several children to enable the latter to play together within the context of a "Gameboy band". The children may in this case be supported by the inventive method for analyzing an audio datum, which runs on the Gameboys® in the form of software, by the software offering proposals to the children for accompanying the other children based on the analysis signal generated within the scope of the inventive method. Concretely, this may be done, for example, by the sum vector being represented on the display of the Gameboy®.

Another possibility is to couple a musical instrument with a melody analysis device and/or a device for analyzing an audio datum, which may be implemented as an external component or as part of the musical instrument. In the case of an external melody analysis device, the same may, for example, be coupled to the musical instrument via midi signals. In this case, the possibility results that a child or another person plays a simple melody, for example on a flute. The melody of the flute may be detected by a microphone or another sound reception means with the help of the melody analysis device and, for example, be converted into midi signals and provided to the musical instrument. If the melody analysis device represents no external component, a conversion into (midi) signals is maybe not needed. The signals are mapped and/or transmitted to the musical instrument of the first child and represented there. By this, the first child may now generate a suitable accompaniment to the melody of the flute.

A special advantage of the inventive device for analyzing an audio datum here comes to the fore, when more than one child is playing a flute. Should in this case even several children "not hit the right note", then the inventive device nevertheless enables a determination of the currently played chord and/or the currently played key with a very high reliability, as, due to the weighting of the intermediate vectors within the context of the vector calculation means with the volume information distribution and/or a distribution derived from the volume information distribution, also individual pitches which are not too loud do not strongly disturb the result of the analysis in the form of the sum vector and/or the analysis signal based on the sum vector. It is, rather, to be expected that only the length of the sum vector is slightly reduced and a slight inaccuracy with regard to the sum vector occurs. The inventive device for analyzing an audio datum and/or the inventive method thus also enables an analysis of an audio datum when "interfering components" are mixed among the audio datum (for example in the form of a child playing "wrong tones").

Depending on the circumstances, the inventive method for analyzing an audio datum may be implemented in hardware or in software. The implementation may take place on a digital storage medium, in particular a floppy disc, CD or DVD having electronically readable control signals, which may cooperate with a programmable computer system so that the inventive method for analyzing an audio datum is performed. In general, the invention thus also consists in a computer program product having a program code stored on a machine-readable carrier for performing the inventive method, when the computer program product runs on a computer. In other words, the invention may also be realized as a computer program having a program code for performing the method, when the computer program runs on a computer or another processor means.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A key determination system, comprising:

a device for analyzing an audio datum, comprising:

a semitone analyzer, which is implemented to analyze the audio datum with regard to a volume information distribution over a set of semitones; and a vector calculator, which is implemented to calculate a sum vector over two-dimensional intermediate vectors, wherein each intermediate vector is calculated for a semitone, based on the volume information distribution, or each intermediate vector is calculated for an element of a definition set, based on a distribution derived from the volume information distribution, wherein the definition set is based on the set of semitones, and to output an analysis signal based on the sum vector;

wherein the audio datum comprises a time course, wherein the semitone analyzer is further implemented to analyze the audio datum with regard to a time course of the volume information distribution, and wherein the vector calculator is further implemented to calculate a time course of the sum vector and output an analysis signal which is based on the time course of the sum vector, based on the time course of the volume information distribution or a distribution derived from the volume information distribution; and a key determinator, which is coupled to the device and is implemented to generate a key signal indicating a key based on the analysis signal of the device and provide the same at an output.

2. The system according to claim 1, wherein the vector calculator is implemented to perform, in the calculation, the determination of the two-dimensional intermediate vectors for each semitone or each element of the definition set by weighting a plurality of unit vectors associated with the respective semitones and/or the respective elements of the definition set with the volume information distribution or the distribution derived from the volume information distribution.

3. The system according to claim 2, wherein neighboring unit vectors correspond to pitch classes, which are alternatingly arranged in major and minor thirds starting from a predetermined pitch class.

4. The system according to claim 1, wherein the sum vector includes information regarding the tonal center of the audio datum.

5. The system according to claim 1, wherein the semitone analyzer is further implemented to analyze the audio datum with regard to the volume information distribution under consideration of a frequency-dependent weighting function to enable a consideration of perception.

6. The system according to claim 1, which further comprises a pitch class analyzer, which is implemented to form a pitch class volume information distribution as a derived distribution with a set of pitch classes as a definition set based on the volume information distribution.

7. The system according to claim 1, wherein the vector calculator is implemented so that the intermediate vectors respectively comprise an angular value in radian measure with regard to a preferential direction of $nt \cdot 2\pi \cdot 72/84$, wherein $\pi$ is the circle number and nt an extended index of the pitch class assigned to the respective intermediate vector.

8. The system according to claim 1, wherein the vector calculator is implemented so that the intermediate vectors respectively comprise an angular value in radian measure with regard to a preferential direction of $n' \cdot 2\pi/24$, wherein $\pi$ is the circle number and n' a designator of the pitch class in relation to a set of pitch classes of a predetermined major scale, wherein the pitch class is assigned to the respective intermediate vector.

9. The system according to claim 1, wherein the semitone analyzer is implemented to analyze the audio datum, wherein the volume information distribution comprises information regarding an amplitude, an intensity, a volume or a hearing-adapted volume.

10. The system according to claim 1, further comprising an integrator which is implemented to integrate the time course of the volume information distribution or the time course of the distribution derived from the volume information distribution regarding time and to provide a time-integrated volume information distribution as a derived distribution to the vector calculator.

11. The system according to claim 1, wherein the audio datum is selected from a group of audio data including a microphone signal, a line signal, an analog audio signal, a digital audio signal, a note sequence signal, a midi signal, a note signal, an analog control signal for controlling a sound generator, and a digital control signal for controlling a sound generator.

12. A key determination method, comprising:

analyzing the audio datum with regard to a volume information distribution over a set of semitones;

calculating a two-dimensional intermediate vector based on the volume information distribution or a distribution derived from the volume information distribution, which comprises a definition set based on the set of semitones, for each semitone or each element of the definition set; and calculating a sum vector based on the two-dimensional intermediate vectors; wherein the audio datum comprises a time course;

the step of analyzing comprises analyzing the audio datum with regard to a time course of the volume information distribution; and the steps of calculating are performed such that a time course of the sum vector is calculated based on the time course of the volume information distribution or a distribution derived from the volume information distribution;

the method further comprising:

outputting an analysis signal which is based on the time course of the sum vector; and generating a key signal indicating a key based on the analysis signal and providing the same at an output.

13. A tangible computer readable medium storing a computer program comprising a program code for performing, when the computer program runs on a computer, a key determination method, comprising:

analyzing the audio datum with regard to a volume information distribution over a set of semitones;

calculating a two-dimensional intermediate vector based on the volume information distribution or a distribution derived from the volume information distribution, which comprises a definition set based on the set of semitones, for each semitone or each element of the definition set; and calculating a sum vector based on the two-dimensional intermediate vectors; wherein the audio datum comprises a time course;

the step of analyzing comprises analyzing the audio datum with regard to a time course of the volume information distribution; and the steps of calculating are performed such that a time course of the sum vector is calculated based on the time course of the volume information distribution or a distribution derived from the volume information distribution;

the method further comprising:

outputting an analysis signal which is based on the time course of the sum vector; and generating a key signal indicating a key based on the analysis signal and providing the same at an output.

* * * * *